United States Patent [19]

Bos et al.

[11] Patent Number: 4,850,204

[45] Date of Patent: Jul. 25, 1989

[54] ADAPTIVE DEFROST SYSTEM WITH AMBIENT CONDITION CHANGE DETECTOR

[75] Inventors: Peter J. Bos, Manitowoc, Wis.; John J. Allard, Morrison, Ill.

[73] Assignee: Paragon Electric Company, Inc., Two Rivers, Wis.

[21] Appl. No.: 90,105

[22] Filed: Aug. 26, 1987

[51] Int. Cl.[4] ..... F25D 21/06

[52] U.S. Cl. ..... 62/234; 62/155; 62/156

[58] Field of Search ..... 62/155, 156, 154, 234, 62/157, 158, 140

[56] References Cited

U.S. PATENT DOCUMENTS

| | | | |
|---|---|---|---|
| Re. 26,596 | 6/1969 | Jobes . | |
| 3,164,969 | 1/1965 | Baker . | |
| 3,277,662 | 10/1966 | Winters . | |
| 3,312,080 | 4/1967 | Dahlgren . | |
| 3,399,541 | 9/1968 | Thorner . | |
| 3,541,806 | 11/1970 | Jacobs . | |
| 3,727,419 | 4/1973 | Brightman et al. . | |
| 4,056,948 | 11/1977 | Goodhouse . | |
| 4,209,994 | 7/1980 | Mueller et al. | 62/234 X |
| 4,251,988 | 2/1981 | Allard et al. . | |
| 4,251,999 | 2/1981 | Tanaka . | |
| 4,297,852 | 11/1981 | Brooks . | |
| 4,299,095 | 11/1981 | Cassarino | 62/158 X |
| 4,344,294 | 8/1982 | Gelbard . | |
| 4,358,933 | 11/1982 | Horvay . | |
| 4,432,211 | 2/1984 | Oishi et al. | 62/155 |
| 4,474,024 | 10/1984 | Eplett et al. | 62/140 |
| 4,481,785 | 11/1984 | Tershak et al. . | |
| 4,488,823 | 12/1984 | Baker . | |
| 4,538,420 | 9/1985 | Nelson | 62/140 |
| 4,573,326 | 3/1986 | Sulfstede et al. . | |

*Primary Examiner*—Harry B. Tanner

*Attorney, Agent, or Firm*—Foley & Lardner

[57] ABSTRACT

A defrost system adapted for use with refrigeration or heat pump systems wherein an evaporator coil defrost cycle is adaptively modified in response to changing environmental conditions. Under normal conditions, a defrost operation is effected at the end of a period of frost accumulation. The period of frost accumulation is adjusted in accordance with deviation of the time required to defrost a coil from a desired defrost time. During the frost accumulation period, the differential between the temperature of the coil and ambient temperature is determined, and the frost accumulation period terminated and a defrost operation initiated if temperature differential exceeds a target differential.

50 Claims, 24 Drawing Sheets

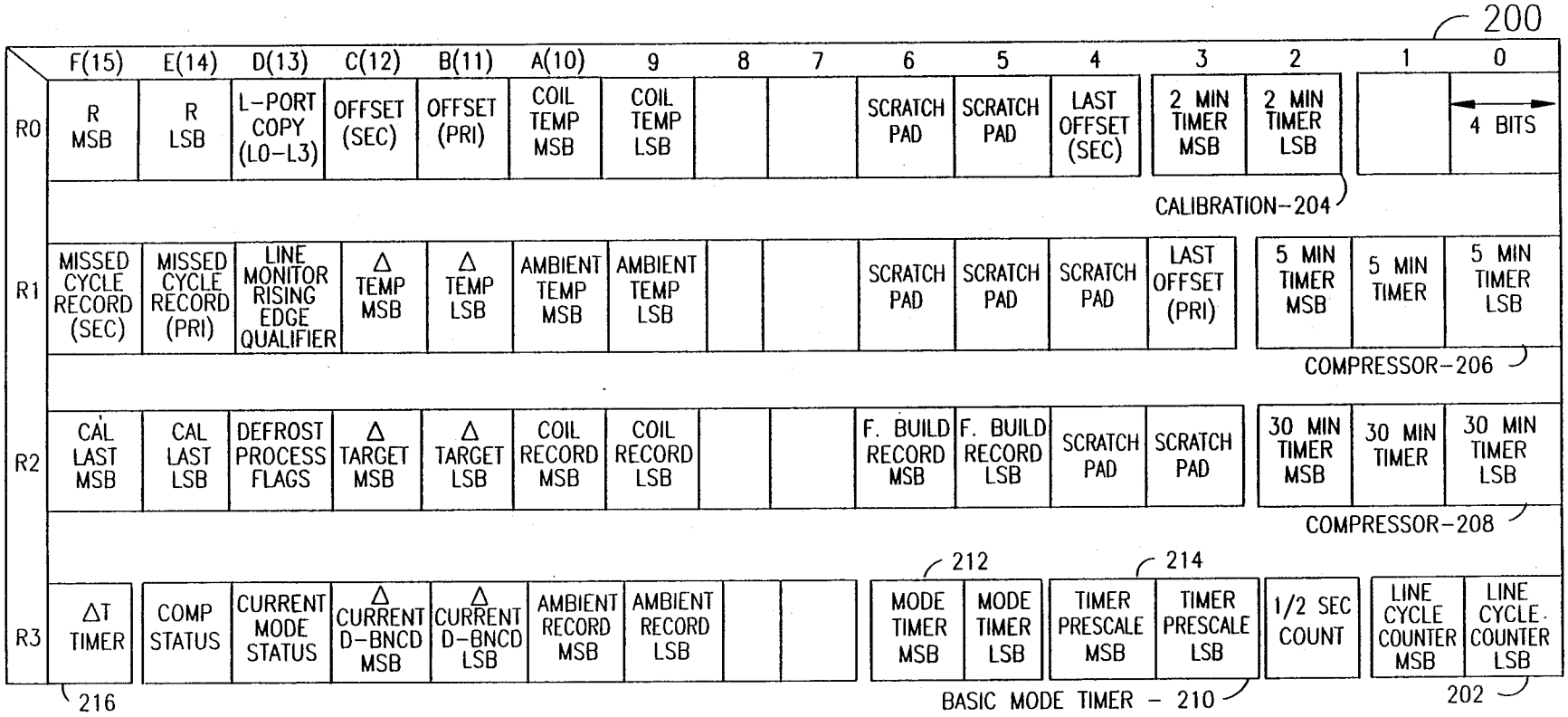
FIG 2 (1)

| RAM | BIT 3 | BIT 2 | BIT 1 | BIT 0 |
|---|---|---|---|---|
| 0,13 | SPEED (0= ACCELERATED TIME, 1=NORMAL REAL TIME) | FREQUENCY (0 = 60 Hz, 1 = 50 Hz) | LOCKOUT DELAY (0 = 8, 1 = 5) | LO STATUS (0 = CHARGING, 1 = DONE) |
| 2,13 | OPEN | COIL FAULT FLAG (1 = FAULT) | DEFROST INTERRUPT FLAG | 27° DETECTION FLAG |
| 3,13 | SPEED (1 = NORMAL, 0 = HIGH) | OPEN | DEFROST VIA $\Delta$T FLAG | MODE 0 = FROST BUILD, 1 = DEFROST |
| 3,14 | COMPRESSOR ENABLE (1 = ENABLED) | LAST STATUS | DEBOUNCE STATUS | CURRENT STATUS (0 = OFF, 1 = ON) |

FIG 2 (2)

ADAPTIVE DEFROST SYSTEM WITH AMBIENT CONDITION CHANGE DETECTOR

This invention relates to defrost systems and, specifically, to a defrost system adapted for use with refrigeration or heat pump systems wherein an evaporator coil defrost cycle is adaptively modified in response to changing environmental conditions.

BACKGROUND OF THE INVENTION

The efficiency of a refrigeration or heat pump system depends, to a large extent, on the amount of frost present on the evaporator coils thereof. Frost present on an evaporator coil tends to act as an insulator, and inhibits heat transfer between the evaporator coil and the atmosphere. Frost accumulation beyond a predetermined level can abruptly and drastically reduce the efficiency of the system.

Systems to control the amount of frost permitted to accumulate on the evaporator coils are known. Ideally, such systems prevent frost from accumulating beyond the predetermined level. However, in order to optimize efficiency of the system, it is desirable to maintain the frequency of the defrosting operation at the minimum necessary to prevent frost buildup beyond the critical limit.

Early systems employed mechanical cyclic timers which incorporated synchronous motors and complex gearing shemes to periodically actuate a fixed time defrost operation. Such early systems initiated defrost cycles without regard to changes in environmental conditions or to whether frost was actually present on a coil. This often resulted in unnecessary defrost cycling, the effect of which was to negatively impact the efficiency of the system. Examples of such systems are described in U.S. Pat. No. 3,277,662 issued Oct. 11, 1966 to T. B. Winters, and U.S. Pat. No. 3,541,806 issued Nov. 24, 1970 to H. W. Jacobs.

Later systems employing such timer motors included provisions intended to mitigate the problem of unnecessary defrost operations. For example, various systems inhibited (suspended) operation of the timer during periods when atmospheric conditions surrounding the evaporator coil were not contributory to a defrosting requirement. Examples of such systems are described in U.S. Pat. No. 3,164,969 issued to M. Baker on Jan. 12, 1965, and Pat. No. Re 26,596 reissued June 3, 1969 to H. W. Jobes. Other systems employing similar timer motors, such as that described in U.S. Pat. No. 4,358,933 issued Nov. 16, 1982 to J. B. Horvay, advance the motors only during periods when the compressor is running, or as in those systems described in U.S. Pat. No. 4,344,294 issued Aug. 17, 1982 to R. B. Gelbard, and U.S. Pat. No. 4,056,948 issued Nov. 8, 1977 to C. J. Goodhouse, which vary the frequency of the motors in accordance with a sensed parameter, e.g., temperature or humidity.

Other examples of defrost control systems are described in U.S. Pat. Nos. 4,481,785, issued to Tershak, et al., on Nov. 13, 1984; 4,251,999 issued Feb. 24, 1981 to Tanaka; 3,312,080 issued Apr. 4, 1967 to J. A. Dahlgren; 3,399,541 issued Sept. 3, 1968 to R. Thorner; 4,297,852 issued Nov. 3, 1981 to R. B. Brooks and 3,727,419 issued Apr. 17, 1973 to Brightman, et al.

Adaptive defrost control systems are also, in general, known. For example, such an adaptive system is described in U.S. Pat. No. 4,251,988, issued to Allard and Heinzen on Feb. 24, 1981, and is commonly assigned with the present invention. The Allard and Heinzen defrosting system automatically seeks to defrost a heat transfer unit such as an evaporator coil when the critical limit of frost has accumulated. The time required to actually defrost the coil is monitored, and the time period between defrosting operations is adjusted until no more than the critical amount of frost builds up on the coil before the next defrosting operation is initiated. More specifically, the Allard and Heinzen system monitors the actual defrost time of the evaporator coil for each defrost operation. An actual defrost time shorter than a predetermined optimal time indicates that less than the optimal amount of frost was allowed to accumulate and, concomitantly, that the defrosting operation is being performed more frequently than necessary. Accordingly, the system lengthens the time between successive defrost periods. An actual defrost time longer than the predetermined optimal time indicates that too much frost was allowed to accumulate. The system, therefore, shortens the time period between successive defrost operations. To this end, the Allard, et al, system operates according to the following relationship:

$$Ta = T_{(a-l)} + K(Dd - Da),$$

wherein

Ta = Length of the next frost accumulating period.

$T_{(a-l)}$ = Length of the last frost accumulating period.

Dd = Desired (optimal) defrost time period.

Da = Length of the actual defrost period.

K = System constant that determines the multiple by which the frost accumulating period will change for each minute of error in the defrost time.

In the context of systems such as a heat pump system, where the evaporator coil is relatively exposed to the elements, the known adaptive defrost systems may be susceptible to inefficiencies due to changes in the frost buildup characteristics caused by abrupt changes in environmental conditions. For example, exposure of the evaporator coil to weather phenomena such as fog, freezing rain, sleet, or snow can dramatically alter the rate of frost buildup. In some instances, changing environmental conditions may cause frost buildup to exceed a predetermined optimum level far in advance of the next defrost operation, particularly in those instances when the defrost cycle is scheduled based upon the previously measured defrost time. Likewise, changes in ambient temperature may vary the time period required to defrost the coils independently of the amount of actual frost buildup, thus interjecting an indefiniteness into the defrost period measurement.

Defrost controllers responsive to changes in ambient conditions are also known. For example, U.S. Pat. No. 4,573,326, issued Mar. 4, 1986 to Sulfstede, et al, describes an adaptive defrost control for a heat pump system wherein a defrost cycle is initiated when the difference between the ambient temperature and the temperature of the heat exchange unit exceeds a specified value. That value is calculated as a function of the difference between a temperature determined just after the preceding defrost cycle during stable conditions before new frost has begun to form on the heat exchange unit and a predetermined minimum differential temperature.

The use of thermistor temperature sensors to determine coil and ambient temperature is also known. For example, U.S. Pat. No. 4,488,823, issued on Dec. 18, 1984 to D. A. Baker, describes a temperature control system for an air conditioner wherein a capacitor is charged, in sequence, through a reference resistor, a thermistor at ambient temperature, and a thermistor disposed on an evaporator coil. The time required for each to charge the capacitor is measured, and the charging times are used to calculate the ambient and evaporator coil temperatures. The compressor is inhibited when the evaporator coil falls below a predetermined temperature to prevent significant frost buildup.

Frost can be removed from an evaporator coil in a number of ways. For example, an electrical heating element in physical contact with the evaporator coil may be activated. Alternatively, the flow of coolant may be reversed, thereby reversing the roles of the evaporator and condenser coils.

In systems employing coolant flow reversing techniques for defrosting, however, the compressor must run during the defrost cycle. In such systems, if the compressor is switched on and off by a thermostat in a remote zone of temperature regulation, interruptions of the defrost cycle can occur. Additionally, accumulated "head" pressures in the compressor will be at a maximum when the compressor turns off. A substantial amount of energy is required to restart the compressor until the "head" pressure dissipates. To address this problem, a time delay relay may be employed to disable the compressor for a fixed period of time immediately following a compressor shutdown. A temperature control system for an air conditioner employing a timer (implemented in a microprocessor) to prevent compressor startup for a predetermined period after the compressor cycles off, is disclosed in the aforementioned U.S. Pat. No. 4,488,823 to Baker. However, in heat pump systems, discrete time delay relay units, operating independently of the remainder of the system, have typically been employed.

SUMMARY OF THE INVENTION

The present invention provides an adaptive defrost control system of the type described in the Allard, et al, patent, particularly suited for systems having a heat transfer unit relatively exposed to the elements.

In accordance with one aspect of the present invention, changes in the time required to actually defrost the unit due to changes in ambient temperature are accounted for by measuring the time required to raise the temperature of the heat transfer unit from a first predetermined temperature to a second predetermined temperature, indicative of a defrosted condition. In the preferred embodiment, the time period required to raise the unit from 27° F. to 60° F. is measured.

In accordance with another aspect of the invention, abrupt changes in environmental conditions, such as, for example, freezing rain, are detected, and, responsively, the frost-accumulating period is set to a predetermined value, preferably a minimum period, and a defrost operation initiated. In the preferred embodiment, the difference between the coil and ambient temperatures is compared to a threshold value indicative of the expected temperature differential during the instantaneous portion of the frost accumulation period. During a first portion of the frost accumulation period, e.g., the first two-thirds, the temperature differential is compared to a threshold value equal to the temperature differential determined just prior to initiation of a defrost operation of an optimum duration. Thereafter, the temperature differential is compared to an increased threshold value, suitably increased by a predetermined percentage of the prior threshold value.

In accordance with another aspect of the present invention, the temperature determinations are effected by charging a capacitor of known value, through a thermistor, and developing a count indicative of the time period required to charge the capacitor to a predetermined voltage level, e.g., corresponding to a logic one. Upon commencing the charging process, the count is developed by the execution of a program loop entailing a predetermined number of instruction cycles per traversal of the loop, irrespective of the path of traversal through the loop. The loop is repetitively traversed until the predetermined voltage is reached, or a miximum count is obtained.

In accordance with another aspect of the invention, calibration of the resistance determination is effected by varying the number of instruction cycles per traversal of the loop, in accordance with deviations of a count attained for a predetermined calibration resistance from a predetermined value.

BRIEF DESCRIPTION OF THE DRAWINGS

A preferred exemplary embodiment of the present invention will be described in conjunction with the appended drawing wherein like numerals denote like elements, and:

FIGS. 2(1) and 2(2) are a memory map schematically illustrating the organization and operation of the Random Access Memory of the system of FIG. 1A–1D; In FIGS. 3–11A, by convention adopted herein, a dot indicates the route taken in response to an affirmative decision. In addition, a shorthand convention has been adopted whereby: the symbol "→" means "loaded into"; and the symbol "⇄" means "exchanged with the contents of." For example, "x⇄y" means "the contents of the location x are exchanged with the contents of the location y." Additionally, the individual cells of RAM 200 will hereinafter be referred to using matrix notation, i.e., RAM (BR, BD). For example, the first cell (cell 0) of register 0 will be referred to as RAM (0, 0). Similarly, the most significant cell of Register R3 will be referred to as RAM (3, 15). Additionally, specific bits of indicated locations will sometimes be referred to using subscripts; i.e., bit 2 of RAM (3, 13) will be indicated as RAM $(3, 13)_2$. Cooperative cells will also sometimes be referred to collectively, e.g., cells 0 and 1 of register R3 will be collectively referred to as RAM (3, 0-1).

DETAILED DESCRIPTION OF A PREFERRED EXEMPLARY EMBODIMENT

Figure 1:
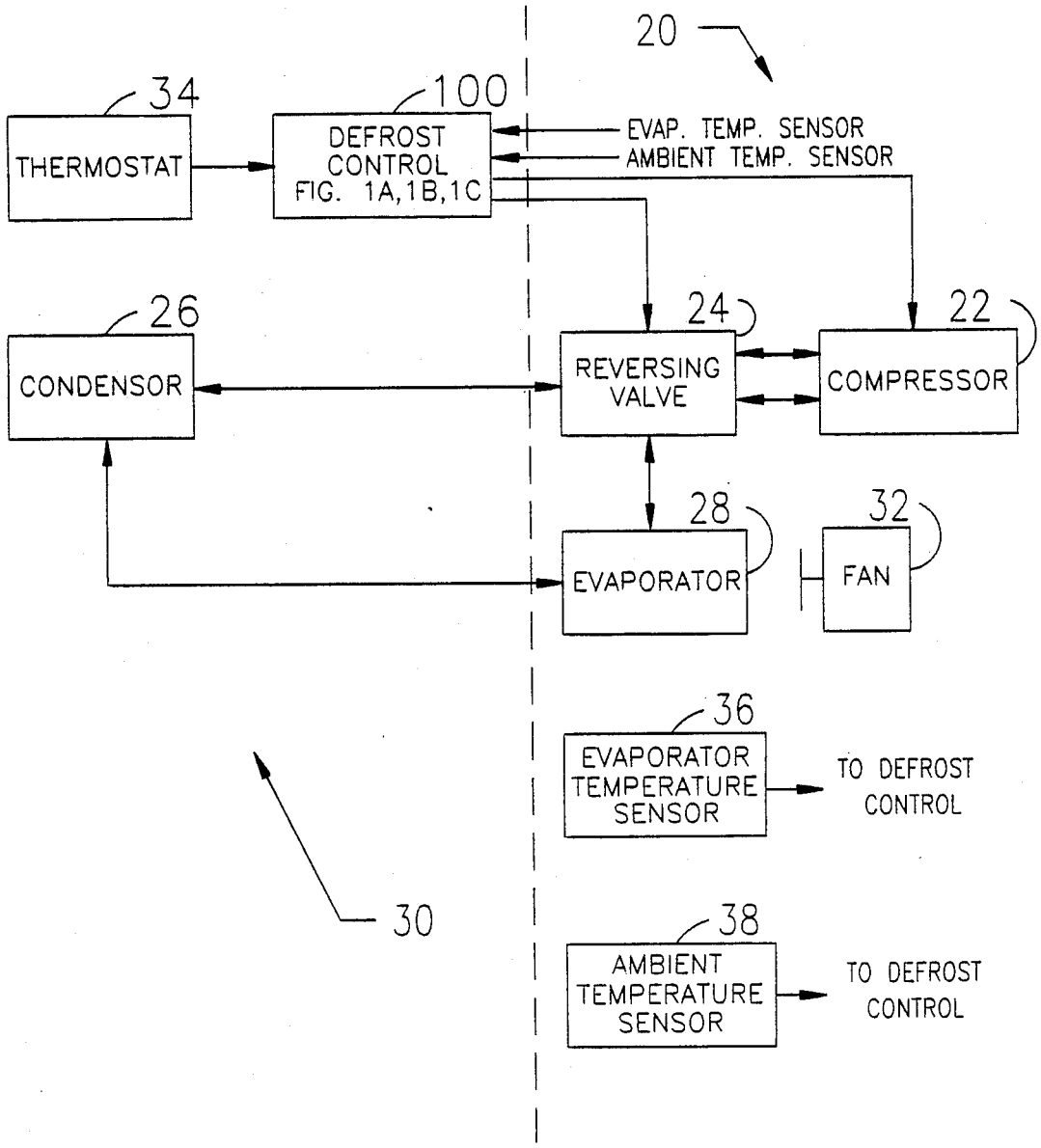
FIG. 1 is a block diagram of an exemplary heat pump system employing an adaptive defrost system in accordance with the present invention.

Referring now to FIG. 1, an exemplary heat pump system 20 in accordance with the present invention comprises a compressor 22, in fluidic cooperation with a reversing valve 24, and respective heat transfer units (condensor 26 and evaporator 28). Condensor 26 is suitably maintained in the interior of an enclosed area, generally indicated as 30, in which temperature is to be regulated.

Conversely, compressor 22, reversing valve 24, and the second heat transfer unit (evaporator) 28 are maintained outside of temperature regulated area 30 and are typically exposed to the elements. A fan 32 is selectively activated to facilitate heat exchange by evaporator 28 (control lines not shown).

A thermostat 34 is provided within temperature regulated area 30. In general, when the temperature within area 30 deviates from predetermined limits, thermostat 34 generates a control signal to selectively actuate compressor 22 and initiate coolant flow through the system.

An adaptive defrost control unit 100, in accordance with the present invention, selectively actuates reversing valve 24 to temporarily reverse the flow of coolant and effect defrosting of evaporator 28. Defrost control 100 is preferably operatively interposed between thermostat 34 and compressor 22, and cooperates with respective temperature sensors 36 and 38, respectively disposed to sense the temperature of evaporator coil 28, and the ambient temperature.

In general, defrost control 100 adaptively generates control signals to compressor 22 and reversing valve 24 to effect a defrost operation at intervals such that approximately the critical amount of frost builds up on the heat transfer unit between defrost operations. Upon initialization, an optimal defrost time period is assumed, and a defrosting operation is initiated, suitably after a relatively short predetermined interval corresponding to, e.g., one-half of the minimum frost accumulation period. Subsequent to the initial defrost operation, a minimum frost accumulation period is assumed for the next successive cycle. During the defrosting operation, defrost control unit 100 monitors the heat transfer unit temperature (through sensor 36), determining the time period (sometimes hereinafter referred to as the actual defrost period, or measured defrost period $D_m$) required to raise the temperature of the heat transfer unit from a first predetermined temperature, e.g., 27° F., suitably indicative of frost accumulation conditions, to a second predetermined temperature e.g., 60° F., suitably indicative of a defrosted condition. Thereafter, a frost buildup period of a duration $T_a$ is determined from the measured defrost period $D_m$ as follows:

$$T_a = T_{(a-l)} + K(D_t - D_m)$$

where $T_{(a-l)}$ is the length of the last frost accumulating period; $D_t$ is the optimal (target) defrost time period; and K is a system constant indicative of the factor by which the frost accumulation period changes for each minute of error in the defrost time.

In general, at the end of the frost accumulation period $T_a$, defrost control unit 100 will generate a control signal to effect the defrost, e.g., actuate reversing valve 24, and the cycle is repeated. However, the defrost operation is initiated prior to the end of period $T_a$ if an abrupt change in environmental conditions is sensed. Absent changes in environmental conditions, the difference between coil and ambient temperature typically does not exceed a threshold value related to the instantaneous point in the frost accumulation period. Ambient temperature sensor 38 is monitored on a periodic basis, and the difference between the ambient and heat exchange unit temperatures is calculated. The instantaneous temperature differential is compared to a stored threshold temperature differential value. If the instantaneous temperature differential exceeds the threshold value, the system immediately initiates a defrost operation, and assume a predetermined value for the frost buildup period $T_a$, typically a minimum value of 30 minutes. For a predetermined period after completion of a defrost operation, e.g. the first one-half or, preferably, the first two-thirds of the frost accumulation period, the threshold value is suitably set equal to the temperature differential determined just prior to a defrost operation of the optimum defrost time (hereinafter sometimes referred to as the normal operating differential). During those later portions of the frost accumulation period, when the temperature differential would be expected to reach the vicinity of the normal operating differential, the threshold value can be increased in accordance with the instantaneous point in the frost accumulation period. For example, a second, higher predetermined value, suitably the normal operating differential increased on a percentage basis, may be employed as the threshold value during the latter portion of the period. Alternatively, the initiation of the defrost operation, in response to exceeding the threshold, can be inhibited during the latter portion of the period.

Figure 1A:
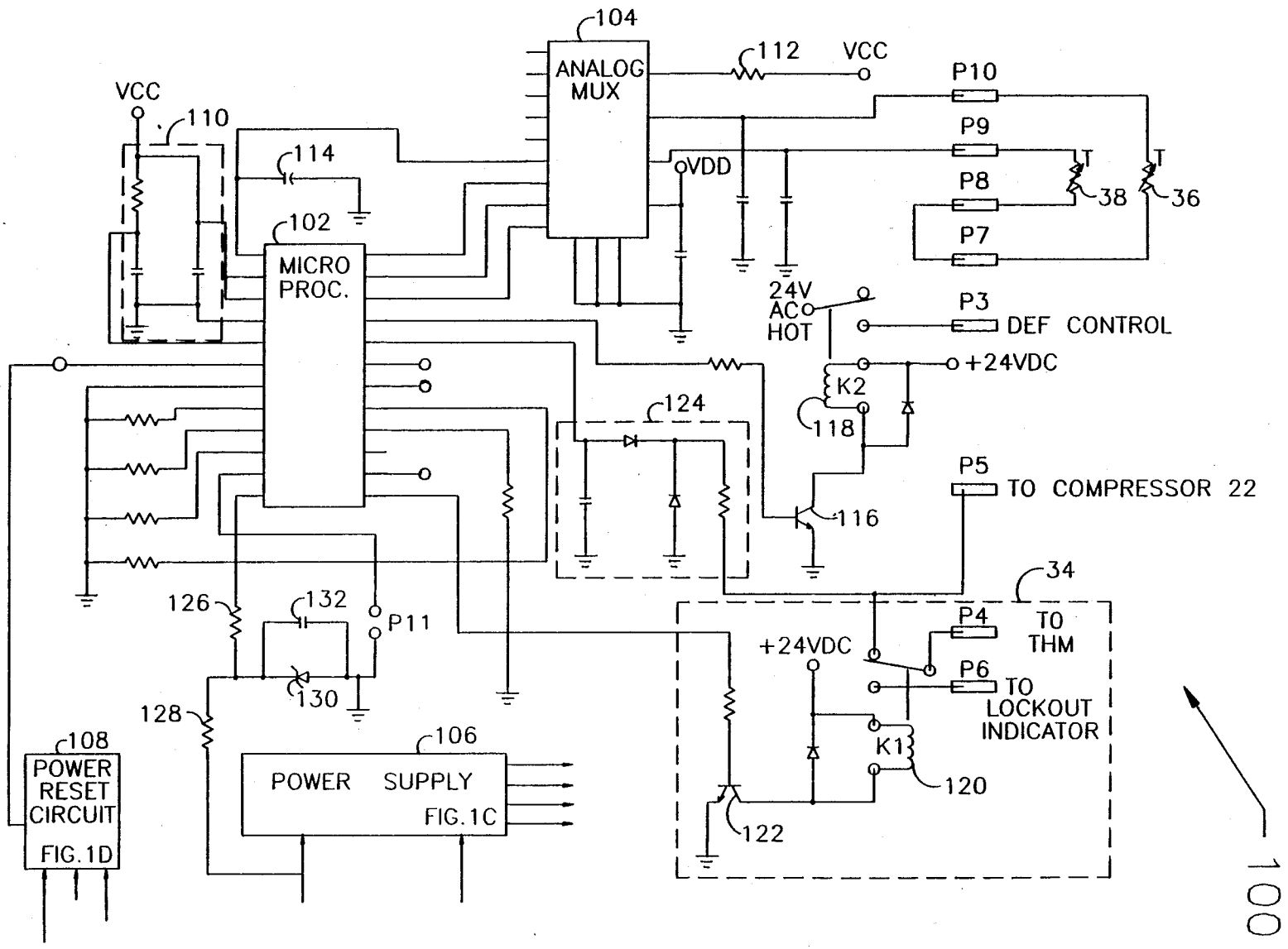
FIGS. 1A–1D are schematic block diagrams of a defrost control unit in accordance with the present invention.

Referring to FIGS. 1 and 1A, adaptive defrost control unit 100 will be described. Control unit 100 suitably includes a conventional microprocessor 102 cooperating with a conventional analog multiplexer 104, respective relays 118 and 120, suitable power supply circuitry 106 and power reset circuitry 108.

Microprocessor 102 provides sequencing and control signals for defrost control 100. Microprocessor 102 selectively accesses thermistors 36 and 38 through analog multiplexer 104 to determine the respective thermistor resistance and, thus, the corresponding temperature, and selectively generates control signals to relays 120 and 118 to effect operation of compressor 22 and reversing valve 24 (FIG. 1).

Microprocessor 102 suitably comprises an extended temperature range, mask programmable, single-chip N-channel microcontroller, such as a National Semiconductor COP321L, including internal provisions for system timing, logic, read only and random access memory (ROM and RAM) and input/output (I/O) logic. More specifically, referring to FIG. 1B, microprocessor 102 suitably includes an internal program memory comprising a 1K×8 read only memory (ROM) 170, cooperating with a 10-bit address register/program counter (PC), appropriate instruction decode/control skip logic 172, and three 10-bit subroutine save registers cooperating as a threelevel last in/first out (LIFO) stack 174. ROM 170 contains indicia of sequential instructions defining the operation of defrost control 100. The instructions are sequentially accessed (e.g., applied to the instruction decoder logic 172) in accordance with the contents of the PC register. The contents of the PC register are generally incremented or otherwise varied once during each instruction cycle. A 4-bit control register (EN) facilitates input/output control.

Microprocessor 102 also includes an internal 256-bit random access data memory (RAM) (generally indicated as 200) configured as four registers, each comprising 16 4-bit cells. The respective cells of RAM 200 are assigned specific functions, as illustrated schematically in FIG. 2.

RAM 200 is addressed through cooperating 2-bit and 4-bit RAM address registers (BR, BD, respectively). The contents of the 2-bit register (BR) identifies one of the four RAM registers, and the contents of the 4-bit register (BD) identifies a particular cell within the register. Power to RAM 200 is suitably provided separately from the various other components of microprocessor 102, suitably through input port CKO (FIG. 1A); pin CKO is coupled to 5V source VCC.

To effect arithmetic and logical functions, microprocessor 102 includes a 4-bit accumulator (alternatively referred to as ACC and the "A" Register), a 4-bit adder 176, and a 1-bit carry register (C). In addition, a 1-bit latch (SKL) cooperates with the bit carry register and other logic to selectively provide a logic controlled clock (e.g., the clock gated in accordance with the contents of the SKL latch) at a logic controlled clock port (SK). The SK driver suitably provides a push/pull output.

Figure 1B:
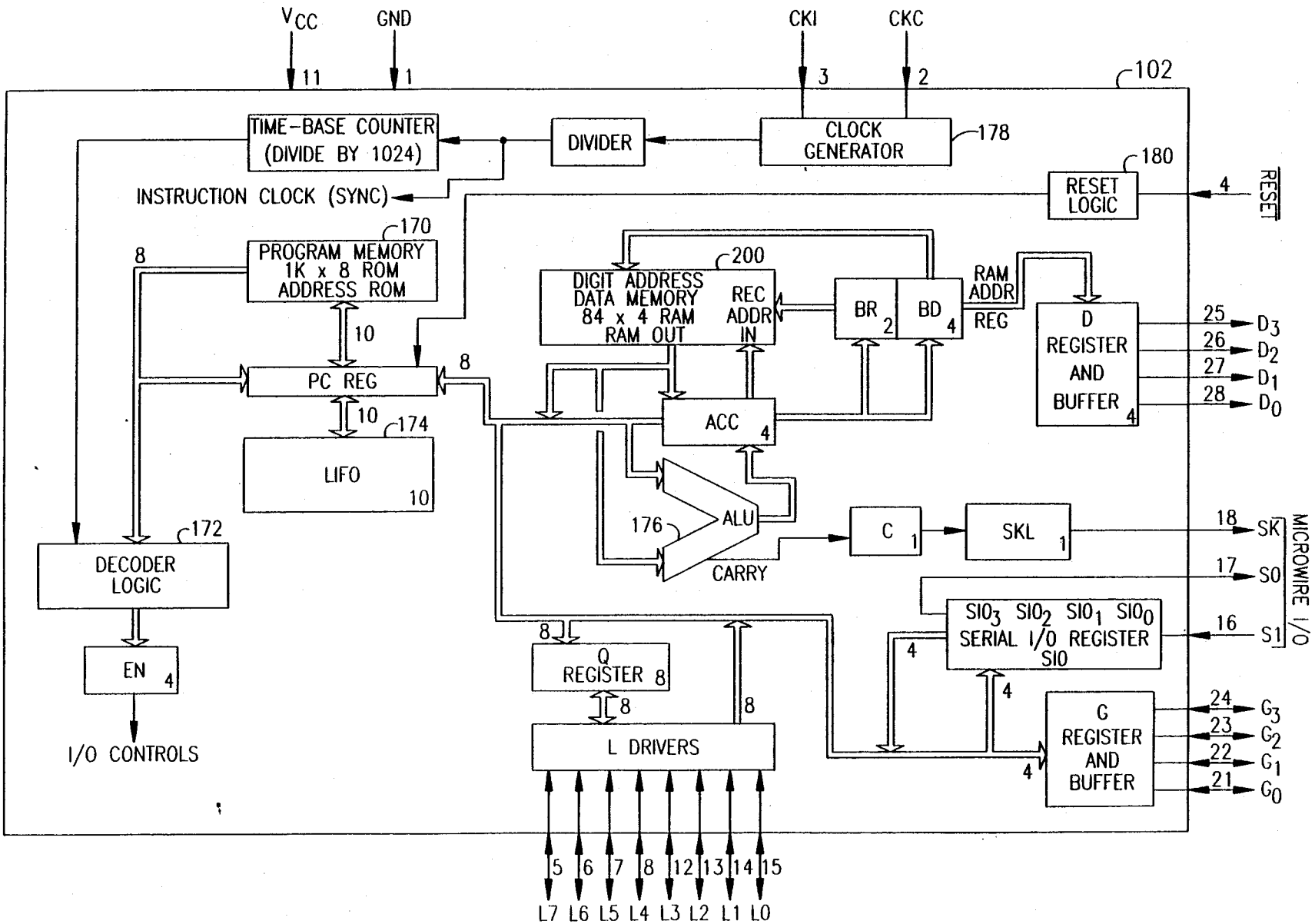

With reference to both FIGS. 1A and 1B, microprocessor 102 includes four general purpose output ports (D3-D0), four bidirectional input/output ports (G3-G0), eight bidirectional three-state ports (L7-L0), a serial input port (SI) and serial output port (SO). As used herein, the term "three-state" indicates that the device can assume any one of three characteristic states: a state wherein the port operates as a high impedence input port with all drive removed; a state wherein the port operates as a low impedence drive; or a state wherein the port operates as a high or low impedence drive.

General purpose output ports (D3-D0) are associated with a 4-bit output register and buffer (D). Ports D3-D0 are suitably mask programmed to provide high current standard outputs.

General purpose bidirectional input/output ports (G3-G0) are associated with a 4-bit bidirectional register and buffer (G). Ports G3-G0 are suitably similarly mask programmed to provide high current standard outputs.

Three-state bidirectional input/output ports (L7-L0) are associated with a latched 8-bit register (Q) cooperating with eight three-state driver circuits. Ports L7-L0 assume either a low impedance drive mode or a high impedance input mode in accordance with the contents of I/O control register EN. Ports L7-L0 are suitably configured through mask programming to provide a standard level output, but to accept higher voltage input levels than standard TTL input levels (logic one is sensed from 1.2 volt to 3.6 volts).

Serial input port (SI) and output port (SO) are associated with a 4-bit serial input/output register (SIO) controllably operating as a serial-in/serial-out shift register or as a binary counter, in accordance with the contents of I/O control register (EN). When in the shift register mode, a shift is effected each instruction cycle; data present on serial input port (SI) is loaded into the least significant bit of the shift register (SIO) and the most significant bit of the shift register (SIO) is provided on serial output port (SO). The SI input and SO driver are suitably configured as a load device to VCC and push-/pull output, respectively.

Internal buses are provided to permit selective communication between the various components.

The instruction cycle of microprocessor 102 is established by internal clock generator logic 178, suitably configured as a single pin RC controlled Schmidt trigger oscillator, adapted to cooperate with an external RC circuit 110 (FIG. 1A) coupled to a pin CK1. The instruction cycle suitably equals the oscillator frequency (establishment by RC circuit 110) divided by four.

Reset logic 180, suitably configured to be responsive to a Schmidt trigger input signal applied to a reset input port (RESET), is used for initializing the device upon powerup. Upon initialization, ROM address register (PC) is reset to a value corresponding to ROM address zero, and accumulator (ACC), RAM address registers (BR, BD), output register D, I/O control register (EN), and output register G are cleared.

Referring again to FIG. 1A, RC circuit 110 suitably comprises a high precision (1 percent) 45.3K ohm resistor and 120 PFD capacitor serially connected between the 5 volt supply VCC and ground. A 0.1 mfd bypass capacitor may be connected in parallel with the series combination to filter noise spikes created by the microprocessor in turning on and off outputs. Pin CK1 of microprocessor 102 is connected to the juncture between the series resistor and capacitor. In the preferred embodiment, the instruction cycle is thus approximately 17.36 microseconds. The precise frequency will, however, tend to vary between individual control units 100 due to, e.g., component tolerances and thermal drift. As will be explained, variations in instruction cycle frequency are accommodated by normalization (calibration) procedures.

Analog multiplexer (MUX) 104 is utilized to selectively access thermistor 36 and 38, and precision (e.g., 1 percent tolerance) calibration resistor 112, suitably 33.2 kiloohms. MUX 104 is suitably an SGS HCS4051B extended temperature range single 8-channel analog multiplexer-demultiplexer, having three binary control inputs (A, B, C), an inhibit input (INH), eight input terminals (Y7-Y0), only three used), and an output terminal (OUT/IN). In effect, MUX 104 couples one of the input ports (Y7-Y0) to the output port (OUT/IN) chosen in accordance with the signals applied to binary control inputs (A, B, C). It has been found that use of a slightly elevated power supply, e.g., VDD (5.6V), in connection with multiplexer 104, provides improved impedence characteristics of the data channels without increasing the logic high level to which the control inputs (A, B, C) respond.

Output ports D2-D0 and three-state I/O port L0 of microprocessor 102, in cooperation with analog MUX 104, are utilized in the acquisition of resistance (temperature) data. Heat transfer unit thermistor 36, ambient thermistor 38, and calibration resistor 112, are connected between the 5 volt source VCC and the Y4, Y2, and Y1 ports, respectively, of analog MUX 104. Connections to thermistors 36 and 38 are suitably effected through a connector unit P7-P10. Respective capacitors, e.g., 0.001 microfarad, may be connected from connectors P9 and P10 to ground as noise filters. A "charging" capacitor 114 of predetermined value, e.g., 1.5 mfd, is coupled between the output port (out/in) of MUX 104 and ground. Three-state port L0 of microprocessor 102 is connected across capacitor 114.

As will hereinafter be more fully explained, the value of the selected resistance and thus, in the case of thermistors 36 and 38, the temperature thereof, is determined from the time period required to charge capacitor 114 to a predetermined value (e.g. the logic high value) through the particular thermistor. Precision resistor 112 is utilized to normalize (calibrate) the measurements.

Defrost operations are effected by microprocessor 102 in cooperation with relay controlled switch 118, sometimes hereinafter referred to as the defrost relay 118. To initiate a defrost operation, microprocessor 102 generates a high level signal at output port D3. The high level output on port D3 actuates a transistor 116 to establish a current path through a coil K2 of relay 118. Relay 118 responsively couples the 24-volt AC line current to a relay or solenoid, not shown, in reversing valve 24. In practice, the reversing valve relay may be multi-pole, and utilized to, for example, additionally inhibit fan 32 (FIG. 1) during the defrost operation.

Microprocessor 102 also provides a compressor lockout function; operation of compressor 22 is selectively inhibited for a predetermined period each time the compressor is turned off to permit head pressure to dissipate. In the preferred embodiment, a five-minute or eight-minute lockout time period may be selected by coupling three-state port L1 to ground, either through a jumper, or through a low value resistance (e.g., 10 ohms). A five-minute lockout time delay is selected by coupling port L1 to ground; if L1 is not connected to ground, an eight-minute lockout delay time is adopted.

To effect compressor lockout, control unit 100 selectively breaks the connection between compressor 22 and thermostat 34 (FIG. 1). Single-pole double-throw relay-controlled switch 120 is interposed between thermostat 34 and compressor 22. The control line from thermostat 34 is coupled (connector P4) to the pole of relay switch 120. Relay 120 normally establishes a connection between the thermostat (connector P4) and a solenoid control start relay (not shown) in compressor 22 (connected to defrost unit 100 at connector P5). During the lockout period, however, during which time compressor 22 is to be inhibited, microprocessor 102 generates a high logic signal at I/O port G3, turning on a transistor switch 122 to provide a current path through the coil of relay 120. When relay 120 is actuated, the connection between thermostat 34 and compressor 22 is broken, preventing actuation signals from the thermostat from being transmitted to the start relay of compressor 22. During the lockout period, thermostat 34 is suitably connected to a lockout indicator such as a light, connected to defrost control unit 100 at connector P6, to provide indicia for the generation of compressor start signals by thermostat 34 during the lockout period.

The compressor status (i.e., whether or not running) is monitored by microprocessor 102, in cooperation with suitable attenuation and protection circuitry 124. Bi-directional port G0 is coupled to the coil of the compressor start relay (connector P5) through circuitry 124.

Microprocessor 102 determines the status of compressor 22 by comparing the phase of the signal at the compressor start coil with the phase of the line frequency reference input (SI). If the phase (i.e., half cycle) of the signal detected at port G0 is the same as the phase of line frequency, then the compressor is running. If the phase detected at port G0 is opposite to the phase of the line frequency, the start relay coil is deemed to be reflecting the AC common signal, indicating that the compressor is off.

The phase (half cycle) of the line frequency is sensed through serial input port SI of microprocessor 102. Serial input port SI is receptive of a signal indicative of the 24 volt AC hot line input to power supply 106; serial input port SI is connected to the hot AC line (connector P2) through respective attenuation resistors 126 and 128 (e.g., 3.3K ohm). A Zener diode 130 (e.g. 5.1 volt) and parallel capacitor 132 (0.1 mfd) are coupled between the juncture of resistors 126 and 128 and ground, to provide voltage level shifting and regulation.

The voltage level of the level shifted AC line signal is thus sampled at port SI during each instruction cycle, and shifted through the internal 4-bit shift register of microprocessor 102. Thus, the contents of the internal shift register of microprocessor 102 are indicative of the state of the AC line signal during four successive instruction cycles (1=positive phase, 0=negative phase). To ensure that a comparison between the phases of the line signal and the signal at the start relay of compressor 22 is made under stable conditions, a comparison is made only if all 4 bits of the internal shift register contain the same value.

Defrost control unit 100 is adapted to selectively operate on a line signal of either 50 or 60 Hz. The adaptation is made by selectively grounding (suitably through a low, e.g. 10 ohm, resistance) port L2 of microprocessor 102. If port L2 is coupled to ground, microprocessor 102 will assume a 60 Hz line frequency. If the connection to ground is broken by, for example, removing the resistor, a 50 Hz line frequency is assumed.

As previously noted, the duration of the frost accumulation period ($T_a$) is adjusted in accordance with deviations of the actual time ($D_m$) required to defrost the coil (raise the coil temperature from first to second predetermined temperatures) from an optimum (target) defrost period ($D_t$). Indicia of the target optimum defrost time period ($D_t$) is provided to microprocessor 102 by selectively grounding, suitably through low value resistors, ports L6-L4. By selectively breaking the connection between one or more of ports L6-L4 and ground, e.g., by removing the intervening resistors, one of eight optimum defrost periods can be chosen. In operation, the state of ports L4-L6 is selectively loaded into accumulator ACC, to effect a jump to a table entry in the program contained in ROM 170 to establish a value corresponding to that particular state. As will be explained, that value is used as a prescaler in timing the defrost period.

Referring now to FIG. 2(1) and 2(2), RAM 200 is utilized to implement the various timers employed, store indicia of the various values generated during the operation of defrost control unit 100, and to store indicia of the status of various aspects of operation. As previously noted, RAM 200 of microprocessor 102 is configured having four nominal registers (R3-R0), each register including 16 four-bit cells (digits).

As previously noted, the individual cells of RAM 200 will be referred to using matrix notation, i.e., RAM (BR, BD). For example, the first cell (cell 0) of register 0 will be referred to as RAM (0, 0). Similarly, the most significant cell of register R3 will be referred to as RAM (3, 15). Additionally, specific bits of indicated locations will sometimes be referred to using subscripts; i.e., bit 2 of RAM (3, 13) will be indicated as RAM $(3, 12)_2$. Cooperative cells will also sometimes be referred to collectively, e.g., cells 0 and 1 of register R3 will be collectively referred to RAM (3, 0-1).

The system operating parameters, as sensed at the various L ports (L1-L3) and the status of input port L0 are stored in RAM (0, 13). Specifically, bit 0 of RAM (0, 13) provides indicia of the status of port L0 (e.g., 1=done, 0=capacitor 114 still charging). Bit 1 stores indicia of the selected compressor lockout period, i.e., the status of port L1 (e.g., 1=five-minute delay, 0=eight-minute delay). Bit 2 provides indicia of the line frequency, i.e., the status of port L2 (e.g., 1=50 hertz, 0=60 hertz). Bit 3 provides indicia of the time frame in which the system is to operate as reflected by the status of port L3; real time or an accelerated time for testing (e.g., 0=accelerated time; 1=normal real time). As will be more fully explained, if accelerated time is chosen, the various timer prescales are preset with lesser numbers than normal to cause defrost unit 100 to cycle through operation in an abbreviated time period.

Register 2, cell 13 is utilized to maintain indicia of various parameters relevant to the defrost operation. Specifically, bit 0 of RAM (2, 13) maintains indicia of whether a 27° C. coil temperature is attained for the first time in the defrost operation, or whether it had already been attained during a previous program cycle of defrost mode operation (e.g., 0=not yet attained, 1=has already been attained and defrost period timing initiated). Bit 1 of RAM (2, 13) provides indicia that there has been an interruption of a defrost cycle by compressor shutdown during the defrost period (e.g., 0=normal defrost, 1=interrupted defrost). RAM (2, 13) bit 2 provides indicia of default conditions in the temperature sensed for heat transfer unit 28; the bit is set if the value sensed indicates that temperature sensor 36 is either shorted or opened. As will be explained, upon sensing a coil temperature sensor fault condition, a 35° C. coil temperature is assumed, and the ambient temperature sensor is used as determinative of whether or not frost is building up on the coil.

Register 3, cell 13 of RAM 200 provides indicia of the operational status of defrost control unit 100. RAM (3, 13) bit 0 provides indicia of the current mode of operation (e.g., 0=frost build mode, 1=defrost mode). RAM (3, 13) bit 1 provides indicia of the impetus for entering the defrost mode (e.g., 0=normal entry of defrost at termination of the accumulation period, 1=defrost precipitated by abrupt changes in temperature). RAM (3, 13) bit 3 provides a further time frame flag (e.g., 0=normal real time operation, 1=accelerated time frame for testing). The second speed flag is employed for convenience of access and to facilitate initiation of accelerated operation at the beginning of the frost accumulation period.

Register 3, cell 14 of RAM 200 maintains indicia of the status of compressor 22. RAM (3, 14) bit 0 provides indicia of the current status of compressor 22, as sensed by port G0 of microprocessor 102 (0=off, 1=on). RAM (3, 14) bit 1 provides indicia of a debounced (verified) status of compressor 22 (0=off, 1=on). A debounced value is a value maintained for a predetermined number, e.g., two, of successive status tests. RAM (3, 14) bit 2 provides indicia of the debounced operational status of compressor 22 during the just previous status test (e.g., 0=off, 1=on) for use in detecting (by comparing RAM (3, 14) bits one and two) when compressor 22 shuts down. RAM (3, 14) bit 3 provides a flag respecting compressor lockout status (e.g., 0=in lockout delay period, 1=compressor enabled).

RAM 200 is also utilized to implement the various timers employed in the operation of defrost control unit 100: a one-half second timer, generally indicated as 202 and sometimes referred to herein as line cycle counter 202, implemented at RAM (3, 0-1); a recalibration time 204, implemented at RAM (0, 2-3); a compressor operation timer 206, implemented at RAM (1, 0-2); a frost build reset timer 208, implemented at RAM (2, 0-2); a basic mode timer 210 implemented at RAM (3, 3-6); and a temperature differential timer 216 (sometimes hereinafter referred to as the differential activation counter 216) implemented at RAM (3, 15).

Real time system operations are, in general, sequenced in accordance with a real time time-base derived from the AC line current. Register 3, cells 2-0 cooperate to provide a real time clock. More specifically, line cycle counter 202, RAM (3, 1-0), is preloaded with a count corresponding to the negative of the number of cycles occuring in the line signal in one-half second, i.e., either −30 or −25 in accordance the status of port L2 (reflected in RAM (0, 13) bit 2). Line cycle counter 202 is incremented once for each negative going transition of the line frequency, as sensed at port SI. Half-second timer 202 overflows upon counting cycles equivalent to one-half second, causing a half-second count in RAM (3, 2) to be incremented, and either 25 or 30 (in accordance with RAM (0, 13) bit 2, subtracted from the count in counter 202. The half-second count is also utilized to periodically increment or decrement timers 204, 206, 208, 210 and 216.

As will be more fully explained, the resistance determination process is suitably recalibrated (renormalized) on a periodic basis. Calibration timer 204 is employed to, in effect, initiate a recalibration at predetermined, e.g., two minute, eight second, intervals.

Compressor operation timer 206 provides timing periods relating to the operation of compressor 22; e.g., the compressor lockout delay period (during which compressor 22 is inhibited). To this end, timer 206 is preloaded with a value corresponding to the desired lockout period (5 minutes or 8 minutes, in accordance with RAM (0-13) bit 1 and thereafter periodically decremented in accordance with the contents of the half-second count in RAM (3, 2). In addition, control unit 100 suitably requires that compressor 22 run continuously for a predetermined period, e.g., 5 minutes, under frost accumulation conditions to ensure that the system has stabilized, prior to making any comparison between coil and ambient temperatures. To this end, timer 206 is suitably selectively preset with a count corresponding to the desired continuous use period, and thereafter periodically decremented in accordance with the one-half second count. Unless again preset in response to a compressor shut down during the interim, timer 206 will time out to indicate completion of the time period.

Frost build reset timer 208 is employed during frost accumulation mode operations, in measuring the duration of periods in which conditions exist under which frost is no longer accumulating, i.e., the coil temperature is above a predetermined temperature. Timer 208 is preset with a value corresponding to a predetermined period, e.g., 30 minutes, and periodically decremented in accordance with the half-second count in RAM (3, 2). Timer 208 is, however, reset upon detection of conditions conducive to frost buildup, i.e., a coil temperature below freezing. If timer 208 times out, signifying that the coil has remained warmer than the predetermined temperature for a 30 minute continuous period, i.e., self defrost by ambient temperature conditions, mode timer 210 is reloaded with the full value of the frost build period, and the frost accumulation period reinitiated without initiating a defrost operation.

Temperature differential activation timer (counter) 216 is similarly employed during the frost accumulation period, to prevent initiation of a defrost operation in response to spurious ambient conditions, e.g., conditions which prevail for less than eight seconds. Specifically, when the temperature differential between the coil and ambient exceeds the threshold value, the system begins to periodically increment timer 216 in accordance with the contents of the half-second count in RAM (2, 3). The defrost operation is initiated only after timer 216 overflows, indicating that at least eight seconds have passed. Timer 216 is, however, reset if, during the interim, the temperature differential ceases to exceed the threshold value.

Basic mode timer 210 is utilized to track the actual cycle time of the system. Specifically, basic mode timer 210 comprises a mode timer (second stage) portion 212 (RAM (3, 5-6)) and a prescale (first stage) portion 214 (RAM (3, 3-4)). In effect, the contents of timer prescale 214 sets the value of each decrement of mode timer portion 212. Prescale portion 214 is decremented in response to each one-half second count. Mode timer 212 is decremented in response to timing out (overflow) of prescale portion 214.

In connection with the defrost mode operation, timer 210 is, in essence, preloaded with a number indicative of a maximum defrost time. Timer portion 212 is preloaded with a predetermined value, e.g., 50, corresponding to a generalized optimum defrost time, e.g., 40, plus a predetermined number of time counts, e.g., 10, representing a predetermined percentage overshoot (e.g., 25 percent). Prescale portion 214 is preloaded with a number corresponding to the characteristics of the particular heat pump system in which control unit 100 is employed. As previously noted, the prescale value is obtained from a table in ROM 170, with the particular entry established by the status of ports L4-L6 of microprocessor 102.

In connection with the frost accumulation mode, a count indicative of the frost accumulation period (sometimes hereinafter referred to as the frost-build period), stored in RAM (2, 5-6), is preloaded into mode timer 212. A predetermined value, maintained in ROM 170, is preloaded into prescaler 214.

RAM 200 also stores various values generated during the operating cycle of defrost control unit 100. As previously noted, indicia of the calculated frost accumulation period is stored in RAM (2, 5-6). Resistance counts made in connection with the temperature measurements and calibrations are initially accumulated in RAM (0, 14-15). Coil, ambient, and calibration counts are temporarily stored in RAM (0, 9-10), RAM (1, 9-10), and RAM (2, 14-15), respectively. If the coil temperature and/or ambient temperature are constant over two successive readings, the temporary coil anld/or ambient counts are then stored "as of record" in RAM (2, 9-10) and RAM (3, 9-10), respectively.

Temperature differential data is stored in RAM (1, 11-12), RAM (2, 11-12) and RAM (3, 11-12). Upon updating of the coil and ambient record temperatures (resistances), indicia of the difference between those temperatures is suitably calculated and stored in RAM (1, 11-12). RAM (3, 11-12) stores indicia of a stabilized temperature differential value; RAM (3, 11-12) is updated only during the frost accumulation mode and after compressor 22 has run continuously for a predetermined period with temperatures conducive to frost accumulation (i.e., timer 206 times out). Indicia of target temperature differential corresponding to the temperature differential just prior to initiation of a defrost period of the optimum length, i.e., the normal operating differential, is maintained in RAM (2, 11-12). The target differential value in RAM (2, 11-12) is updated, with the stablized differential value in RAM (3, 11-12), upon completion of a defrost operation taking the optimum defrost time period.

As will be explained, the resistance determination operation utilizes an instruction cycle time base; a resistance count is incremented once for each occurrence of a predetermined number of instruction cycles during the time period required to charge capacitor 114 to a logic 1 value. The number of instruction cycles per resistance count is adjusted from a base count (e.g., 21) in accordance with an offset calculated in accordance with periodic calibration readings. The offset ranges from a minimum value of zero to a maximum value of 36. Indicia of primary and secondary offsets are stored in RAM (0, 11) and RAM (0, 12), respectively. Also, indicia of the previously calculated primary and secondary offsets are stored in RAM (0, 4) and RAM (1, 3). The primary offset, represented in RAM (0, 11), operates as a program router, initiating respective sequences of instructions of varying predetermined numbers of instruction steps, culminating in incrementing RAM (0, 14-15). Secondary offset (RAM 0, 12) is selectively accessed in accordance with the value of the primary offset in RAM (0, 11) to effect extended delays. As will be explained, incrementing RAM (0, 14-15) on the basis of predetermined sequences of instructions provides for optimum resolution in the resistance determination.

A plurality of resistance determinations occur during each frost accumulation period and during each defrost period. While the resistance determination operation utilizes an instruction cycle time base, the various counts entailed in the frost-build and defrost system operations are based upon real time as derived from the AC line signal. However, during the course of resistance determination, time limitations do not permit incrementing the various timers and counters involved in the system operation. Time does permit, however, sensing the occurence of rising edges in the line signal, and maintaining indicia of the phase of the cycle and the number of cycles occurring during the resistance determination process. Indicia of the phase of the line signal, and the number of cycles "missed" during the resistance determination process, are stored in the carry bit (c) of accumulator ACC and RAM (1, 14-15), respectively. The respective real time counts can thus be updated upon completion of the resistance determinations.

Power to defrost control unit 100 is provided through power supply 106. Power supply 106 operates upon a 24 volt AC, 50/60 hertz line voltage, to generate respective DC voltages for use by the various components of defrost control 100: $V_{unreg}$ (10V); VDD (e.g., 5.6 volts), VCC (e.g., 5 volts), and 24 volts DC. If desired, the 24 volt AC input signal (hot side) may be provided for selective application to a relay or solenoid (not shown) associated with reversing valve 24.

Figure 1C:
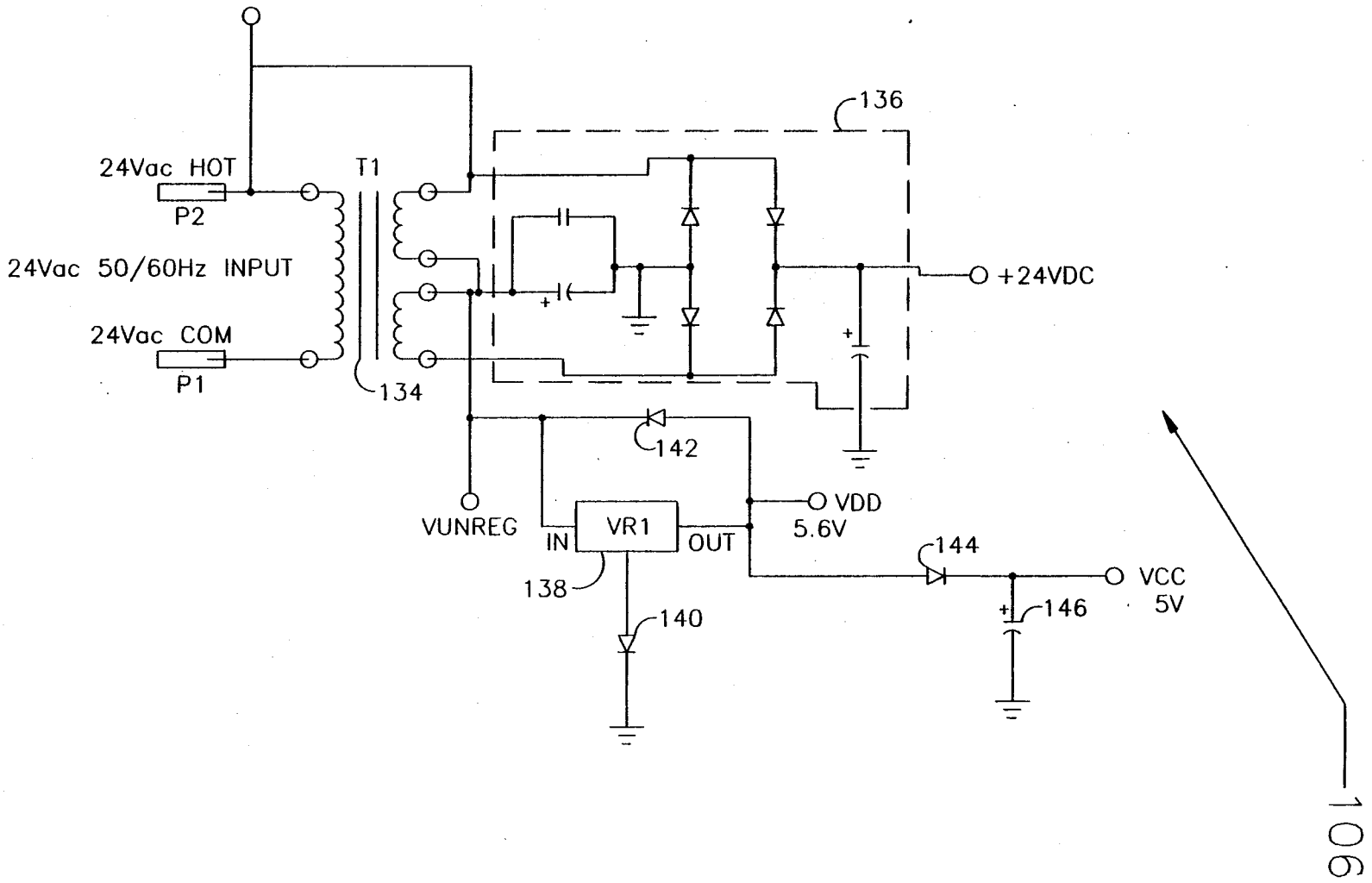

Referring now to FIG. 1C, power supply 106 includes a center tapped transformer 134, a suitable full wave bridge rectifier 136 to provide a 24 volt DC signal, and a conventional voltage regulator device 138, suitably a National Semiconductor 78L05ACZ. Voltage regulator device 138 typically generates an output voltage of 5 volts with respect to its ground terminal. A diode 140, however, is interposed between voltage regulator 138 and system ground. Diode 140 thus has the effect of shifting the level of the output voltage of voltage regulator 138 by a one diode drop (0.6 volt). An additional diode 142 is coupled between the input and output terminals of voltage regulator 138 to prevent the input to voltage regulator 138 from becoming reverse biased with respect to its output. Thus, a regulated signal (VDD), 5.6 volts with respect to system ground, is provided at the output of voltage regulator 138. A serially connected diode 144 (to compensate for the level shifting effect of diode 140) and filter capacitor 146 (suitably 2.2 mfd) are connected between the output of voltage regulator 138 and ground. A regulated 5 volt signal VCC is provided at the juncture between diode 144 and capacitor 146.

Figure 1D:
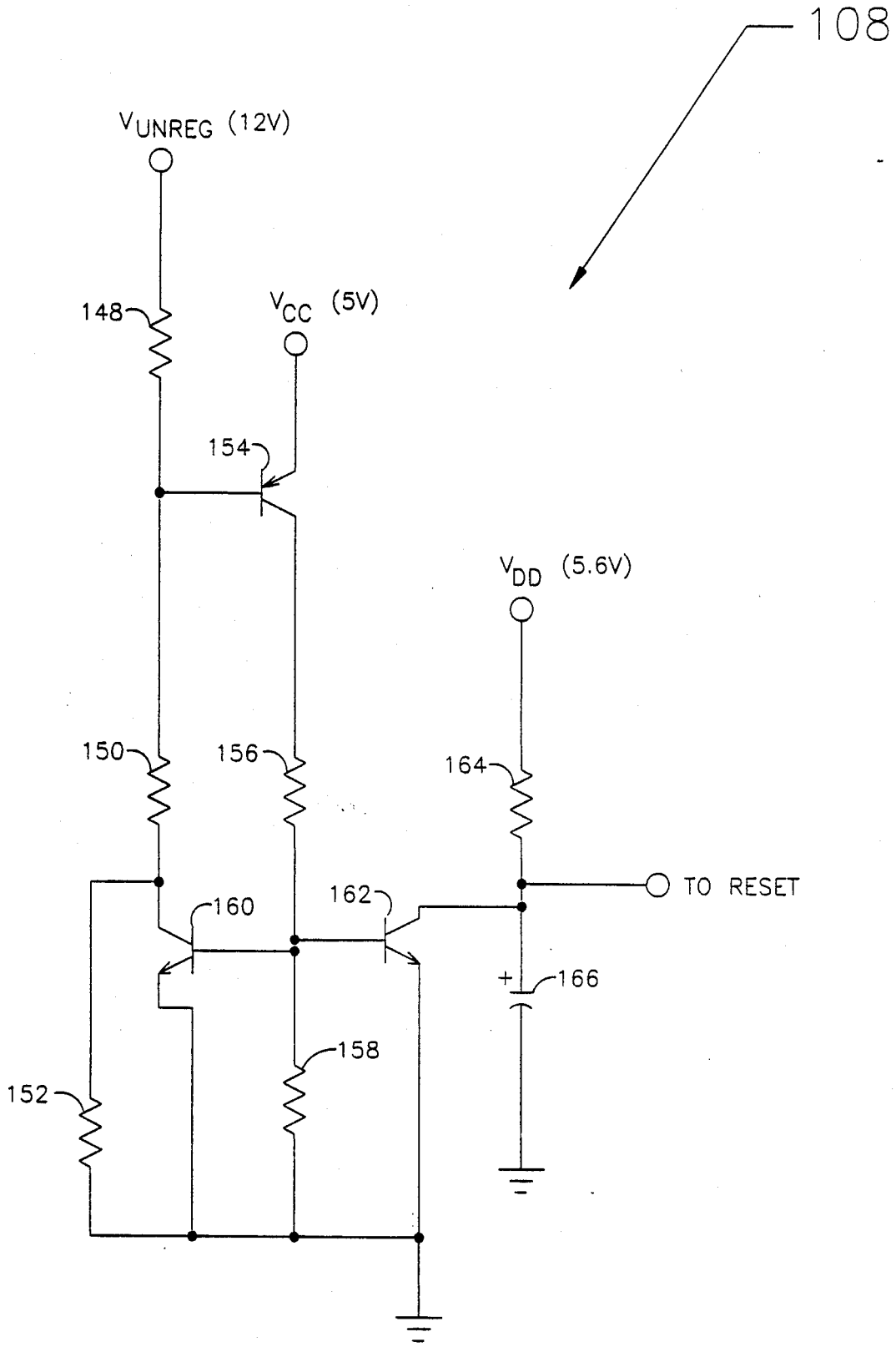

Referring now to FIG. 1D, power reset circuitry 108 generates the appropriate signals to the reset terminal of microprocessor 102 to effect initialization upon power up, and upon return to full power after a severe brown out situation. As previously noted, microprocessor 102 is reset (initialized) upon application of an appropriate signal (e.g., a pulse having a rise time less than 1 ms and greater than 1 microsecond) to the reset terminal, provided that logic zero is applied to reset input for at least three instruction cycles. Referring to FIGS. 1C and 1D, power reset circuitry 108, in essence, monitors the voltage differential across voltage regulator 138 of power supply 106 (FIG. 1B). A reset signal is generated any time the differential across voltage regulator 138 falls below a predetermined level, providing a signal having appropriate sharp edges, as required by the microprocessor initialization circuitry. Respective resistors 148, 150, 152 (suitably 39K, 30K, and 30K ohms, respectively) are serially connected between the $V_{unreg}$ (taken from the center tab of transformer 134; FIG. 1C) and ground, cooperating as a voltage divider. The base of a PNP transistor 154 is connected to the juncture of resistors 148 and 150. The emitter of transistor 154 is coupled to 5 volt source VCC. The collector of transistor 154 is connected through a second voltage divider formed of respective resistors 156 and 158 (suitably 47K and 1M ohms, respectively) to ground. Respective NPN transistors 160 and 162 are provided in common emitter configuration, with the respective bases thereof connected to the juncture between resistors 156 and 158. The collector of transistor 160 is connected to the juncture between resistors 150 and 152, and the collector of transistor 162 is connected to the juncture of a resistor 164 (suitably 82K ohms) and a capacitor 166 (suitably 1.5 mfd) connected between 5.6 voltage source VDD and ground. The connection to the reset port of microprocessor 102 is made at the collector of transistor 162.

The reset operation is initiated when less than 2 volts are provided across the regulator and is released when at least approximately 5 volts is provided. When the voltage across voltage regulator 138, i.e., the $V_{unreg}$ minus VDD drops below two volts, a rippling effect may be manifested. Accordingly, when the voltage across voltage regulator 138 drops below two volts, the reset signal is generated. Once the voltage differential across the regulator drops below two volts, however, operation is inhibited until a five volt differential is thereafter obtained, through the hysteresis effect caused by shunting out resistor 152. Provision of hysteresis avoids reset oscillation tending to occur where turn on and turn off potentials (voltages) are equal. Fluctuations in voltage are normal, especially when added loads (e.g., relays) are activated. Hysteresis accommodates such fluctuations.

When the A/C line signal is initially applied to power supply 106, $V_{unreg}$ tends to lead the output of regulator 138, VCC, by approximately two volts; until regulator output value VCC reaches five volts, the $V_{unreg}$ will be at a level approximately two volts greater than VCC. The values of resistors 148, 150 and 152 are chosen such that the first voltage divider provides approximately 60% $V_{unreg}$ at the base of PNP transistor 154. Thus, transistor 154 is effectively off for values of $V_{unreg}$ of from 0–5 Vdc. When $V_{unreg}$ exceeds 5 Vdc, (and VCC exceeds 3 Vdc), transistor 154 is rendered conductive. PNP transistor 154 thus provides a current path through the second voltage divider formed by resistors 156 and 158, biasing on NPN transistors 160 and 162. Rendering transistor 162 conductive holds the reset input low, resetting and temporarily inhibiting microprocessor 102. When transistor 160 is rendered conductive, resistor 152 is effectively shunted out of the first voltage divider network. This provides a hysteresis effect; once transistor 160 is turned on to shunt resistor 152, only approximately 0.435 $V_{unreg}$ is provided at the base of PNP transistor 154.

Once VCC has reached its limit of five volts, the $V_{unreg}$ continues toward a 12 volt value, and the differential between the $V_{unreg}$ and the VCC increases. Ultimately, when the $V_{unreg}$ reaches the vicinity of eleven volts, the base-emitter junction of PNP transistor 154 becomes reverse biased, rendering transistor 154 non-conductive, which effectively breaks the current path through the second voltage divider, and turns off NPN transistors 160 and 162. When transistor 162 is rendered non-conductive, capacitor 166 is permitted to charge through resistor 164, ultimately releasing microprocessor 102 for operation.

When transistor 160 is rendered nonconductive, resistor 152 is again placed in the first voltage divider network, providing, in effect, hysteresis between turn on and turn off of reset circuit 108. For transistor 154 to again turn on, effecting a reset, $V_{unreg}$ must drop to less than 8 Vdc.

Figure 3:
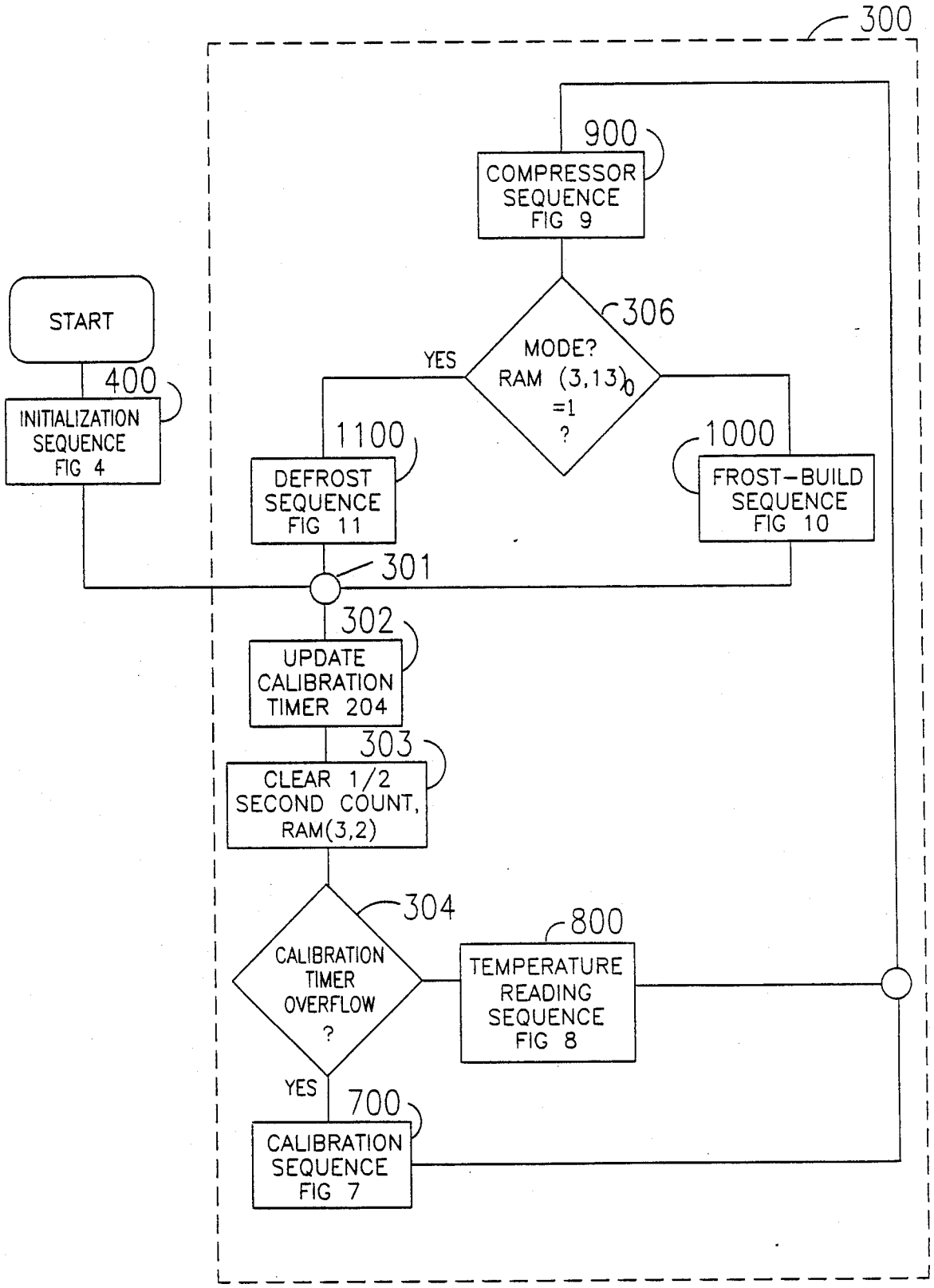
FIGS. 3, 4, 5(1), 5(2), 5(3), 5A, 5B, 5C, 6, 7, 8, 9, 10(1), 10(2), 11(1) 11(2) and 11A are flow diagrams of the operation of the system of FIGS. 1A–1D.

Referring now to FIG. 3, the general operation of the defrost control unit 100 will be explained. Upon power-up, reset circuit 108 generates the appropriate signal to microprocessor 102 to initiate an initialization sequence (generally indicated as 400). Briefly, initialization sequence 400 establishes initial I/O drive patterns, tests RAM 200, provides for initial calibration and resistance (temperature) determinations, and presets or clears various RAM locations in preparation for system operation. Initialization sequence 400 will be more fully described in conjunction with FIG. 4.

After initialization sequence 400 is completed, the system enters a normal operating loop 300 (sometimes hereinafter referred to as main loop 300), suitably at a point in the cycle, generally indicated as 301, just prior to respective steps relating to real-time timing functions. In general, in the course of normal operating loop 300, the system effects, alternatively, on a timed basis, either a calibration sequence 700 or a temperature reading sequence 800. Upon first entering normal operating loop 300 after initialization, however, the timing is such that temperature reading sequence 800 is effected.

As previously noted, system operation timing is effected, for the most part, on a real-time basis as derived from, and in synchronism with, the AC line signal. The "half-second" count developed in RAM (3, 2) is incremented upon zeroing of a count, representative of the number of line cycles corresponding to one-half second, in line cycle counter 202. As will be explained, the half-second count in RAM (3, 2) (and line cycle counter 202) is updated in conjunction with resistance determinations of calibration sequence 700 and temperature reading sequence 800, and is utilized to increment or decrement the various real-time counts during the course of execution of normal operating loop 300. In this regard, after the various real-time counts have been adjusted, but prior to the next updating (calibration or temperature sensor reading) sequence, the half-second count in RAM (3, 2) is cleared in preparation for the next execution of normal operating loop 300. Specifically, beginning at point 301, execution of normal operating loop 300 proceeds with updating calibration timer 204 (RAM (0, 2-3)) in accordance with the contents of the half-second count in RAM (3, 2) (Step 302), and clearing the half-second count in RAM (3, 2) (Step 303). Calibration timer 204 is then tested for overflow (Step 304) to determine the appropriate program flow path.

As previously noted, calibration timer 204 times out (overflows) at predetermined intervals, e.g., 2 minutes and 8 seconds, at which time calibration sequence 700 is effected. In general, resistance determination is performed on calibration resistor 112 and the appropriate offset for normalized resistance determinations are generated. Line cycle counter 202 and the half-second count in RAM (3, 2) are updated in connection with the resistance determinations. Calibration sequence 700 will be more fully described in conjunction with FIG. 7.

Assuming that calibration timer 204 has not overflowed, temperature reading sequence 800 is initiated. Briefly, resistance determinations are made with respect to ambient thermistor 38 and coil thermistor 36, and the coil temperature is tested to ensure that it is within limits. Line cycle counter 202 and the half-sescond count in RAM (3, 2) are updated in connection with the resistance determinations. Temperature reading sequence 800 will be more fully described in conjunction with FIG. 8.

After a calibration sequence 700 or temperature reading sequence 800 is completed, a compressor sequence generally indicated as 900 is initiated. In general, the compressor status (RAM (3, 14)) is updated, compressor operation timer 206 is updated in accordance with the half-second count in RAM (3, 2), and the compressor lockout feature is implemented. Compressor sequence 900 will be more fully described in conjunction with FIG. 9.

A test is then made of RAM (3, 13) bit 0, to determine whether the system is in defrost or frost accumulation (frost-build) mode (Step 306), and a frost accumulation (frost-build) sequence 1000 or defrost sequence 1100 is initiated, accordingly.

If frost accumulation mode operation is indicated, frost-build sequence 1000 is initiated. In essence, assuming conditions are conductive to frost accumulation, the difference between coil and ambient temperatures is monitored to detect abrupt changes in environmental conditions, and timer 210 (loaded during either initiation sequence 400, or defrost sequence 1100, with indicia of the duration of the frost accumulation period reflected in RAM (2, 5-6)) decremented in accordance with the half-second count in RAM (3, 2). Upon termination of the frost-build period (timing out of timer 210), or upon detection of an abrupt change in environmental conditions, defrost mode operation is effected; RAM (3, 13) bit 0 is set to indicate defrost mode operation, effectively activating defrost relay 118, and timer 210 is loaded with indicia of a maximum defrost period. If conditions not conducive to frost accumulation prevail, timer 208 is incremented in accordance with the half-second count in RAM (3, 2). Timer 208 is reset upon detection of conditions conducive to frost accumulation. If, however, non-conducive conditions prevail for a sufficiently long period (one-half hour), timer 210 is reloaded with indicia of the frost accumulation period, and frost accumulation mode operation is continued. Frost-build sequence 1000 will be more fully described in conjunction with FIG. 10.

If, however, the state of the mode flag, RAM (3, 13) bit 0, indicates defrost mode operation (Step 306), defrost sequence 1100 is initiated. In essence, timer 210, previously loaded in connection with frost-build sequence 1000 with indicia of a maximum defrost period, is decremented in accordance with the half-second count in RAM (3, 2). Timer 210 is, however, reset with indicia of the maximum defrost period upon the coil initially achieving a first predetermined value, e.g., 27° F. Timer 210 is decremented until the coil achieves the second predetermined temperature, e.g., 60° F., or timer 210 times out. Assuming that the second predetermined temperature is attained, the frost-build accumulation record in RAM (2, 5-6) is adjusted as appropriate. In any event, mode flag RAM (3, 13) bit 0 is alternately reset to indicate frost-build mode operation, in effect deactivating relay 118, and timer 210 is loaded with indicia of the frost-build period.

After completion of frost-build sequence 1000 or defrost sequence 1100, calibration timer 204 is again updated and execution of normal operating loop 300 is repeated.

Figure 4:
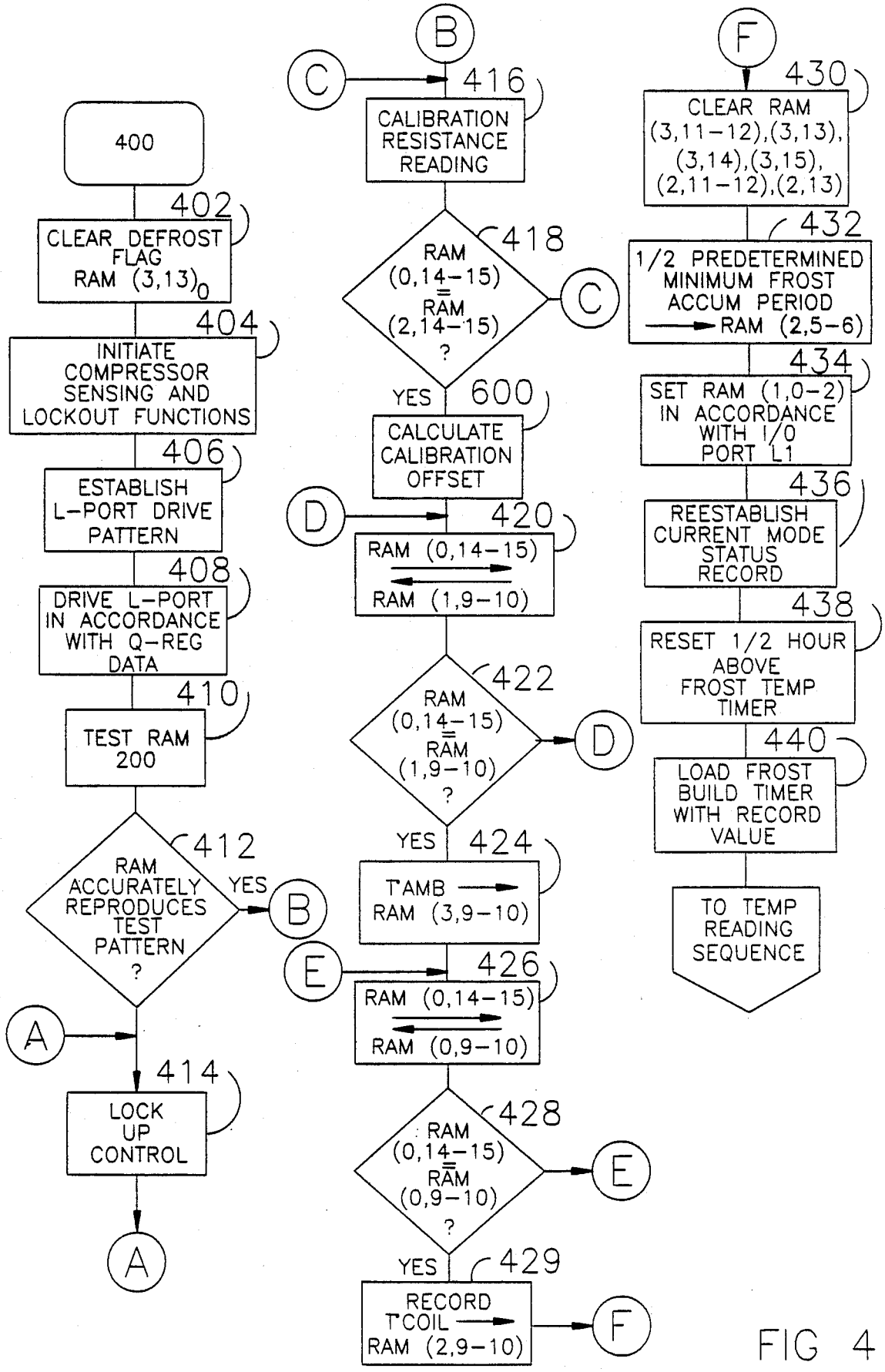

Referring now to FIG. 4, initialization sequence 400 will be described. Initialization sequence 400 is initiated each time an appropriate signal is applied to the reset terminal of microprocessor 102. First, the initial operating mode is established; frost accumulation mode operation is assumed by clearing the mode flag, RAM (3, 13) bit 0 (Step 402).

The compressor sensing and lockout functions are then initiated (Step 404). The compressor enable bit, RAM (3, 14) bit 3 is cleared, and the respective bits of the G registers corresponding to outputs G0 and G3 are loaded with ones. Thus, I/O Port G0 is placed in a sensing mode and lockout relay 120 actuated.

The L-port drive pattern is then established (Step 406). The Q register of microprocessor 102 is loaded with a predetermined pattern corresponding to the desired L-port drive pattern. Specifically, a zero is placed in the bit corresponding to port L0 and ones are placed in the bits corresponding to ports L1 through L7. The respective L ports are then driven in accordance with the Q register data (Step 408); the appropriate code is entered into the EN register of microprocessor 102 to drive the L ports.

A nondestructive test of RAM 200 is then effected (Step 410). More specifically, a predetermined value is taken from ROM 170 and placed into accumulator ACC. The contents of each 4-bit cell of RAM 200 is, in sequence, exchanged with the contents of accumulator ACC, reexchanged, and the value tested. The test sequence is suitably performed for the values (1, 0, 1, 0), (0, 1, 0, 0), and (0, 0, 1, 1). The results of the test are then reviewed (Step 412). If RAM 200 does not accurately reproduce the test patterns, the system is effectively shut down by, for example, placing the software in an endless loop (Step 414).

Assuming, however that RAM 200 accurately reproduces the test pattern (Step 412), a calibration resistance reading is then taken, with primary and secondary offsets of 1 and 15, respectively (Step 416). A resultant calibration count is then developed and initially retained in RAM (0, 14-15). The resistance determination procedure will hereinafter be described more fully in connection with FIG. 5.

In order to ensure that a stable reading is obtained, the resistance reading is accepted only if two successive readings of the same value are obtained. Accordingly, the contents of RAM (0, 14-15) and contents of RAM (2, 14-15) (initially without significance) are exchanged and compared (Step 418). If the contents of RAM (0, 14-15) and RAM (2, 14-15) are not equal, a new resistance reading is taken, and the results are overwritten into RAM (0, 14-15) (Step 416). The exchange of contents and test (Step 418) is then repeated and readings taken until two sequential resistance readings match.

Once successive identical resistance readings are obtained, a calibration offset is calculated (Step 600). As previously noted, the offset is employed to adjust the number of instruction cycles required to increment the resistance count. In general, the offset value is determined by comparing the calibration resistance count (taken with the primary and secondary offsets equal to 1 and 15, respectively) to a predetermined value. The calculation of the calibration offset will hereinafter be more fully described in conjunction with FIG. 6.

Initial readings of the ambient and coil temperatures are then obtained. More specifically, a resistance determination is performed with respect to ambient thermistor 38 and a count indicative of the thermistor resistance is accumulated in RAM (0, 14-15). The contents of RAM (0, 14-15) are then exchanged with the contents of RAM (1, 9-10) (Step 420), (initially without significance) and compared (Step 422). If the contents of the respective RAM cells are not equal, a new resistance reading is taken and overwritten in RAM (0, 14-15). Steps 420 and 422 are repeated until two successive equal temperature readings are obtained, whereupon the temperature value is copied into ambient record cells, RAM (3, 9-10) (Step 424).

A similar sequence is then performed with respect to the coil temperature. A resistance determination sequence is effected with respect to the resistance of coil thermistor 36, resulting in a count indicative of the thermistor resistance in RAM (0, 14-15). The count is then exchanged with the contents of RAM (0, 9-10) (indicative of the previous coil temperature count, initially without significance) (Step 426), and a comparison of the respective counts made (Step 428). If the values are not equal, Steps 426 and 428 are repeated, and the new resistance counts is overwritten into RAM (0, 14-15), until two successive coil temperature readings of equal value are obtained. The coil temperature count is then stored in RAM (2, 9-10) (Step 429).

Various of the RAM locations are then cleared in preparation for normal operation (Step 430): the temperature differential value, RAM (3, 11-12); the current mode status record, RAM (3, 13); the compressor status record, RAM (3, 14); the temperature differential activation timer, RAM (3, 15); the temperature differential target value, RAM (2, 11-12); and the defrost process flags and coil default flag, RAM (2, 13).

A predetermined value, suitably equal to one-half of a predetermined minimum frost accumulation period, is then loaded into the frost-build time record, RAM (2, 5-6), to establish the time frame for initiation of a first defrost period (Step 432). If desired, a defrost operation can be initiated without an initial frost-build period. However, it is desirable to permit at least a short period of normal system operation during which frost accumulates on the coil prior to initiating a defrost. The initialization establishes a frost-build period of less than the normal predetermined minimum value in order to facilitate adoption of the predetermined minimum frost-build time in the cycle subsequent to the initial defrost, i.e., ensure the minimum frost-build time is within the limits of system adaptive adjustment.

Compressor timer 206, RAM (1, 0-2), is then set to the selected lockout time period (five minutes, or eight minutes in accordance with the status of I/O port L1 reflected in RAM (0, 13) bit 1) (Step 434).

The operational status of the system is then reestablished (Step 436). RAM (3, 13) was previously cleared (Step 430); the speed bit (bit 3) of the current mode status cell (RAM 3, 13) is updated in accordance with the status of port L3, as reflected at bit 3 of RAM (0, 13).

Thirty-minute timer 208 is then reset (Step 438), to initiate tracking of conditions non-conducive to frost buildup.

The initial frost-build period is then established (Step 440). Specifically, mode timer 212 is loaded with the contents (one-half the normal minimum) of the frost-build record, RAM (2, 5-6), and timer prescale 214 is loaded with a predetermined value from ROM 170 (e.g., 180 for normal speed operation, 1 for accelerated operation). Normal operating loop 300 is then entered, suitably at point 301.

As previously noted, resistance determination sequence 500 is employed to develop a resistance count in RAM (0, 14-15). The resistance count is indicative of the time period required to charge capacitor 114 through the selected resistance, and thus, the value of the resistance and, in the case of thermistors 36 and 38, the coil and ambient temperatures. Resistance determination sequence 500 is effected in connection with initialization sequence 400 (Steps 416, 420, and 426), and, as will be explained, in calibration sequence 700 and temperature reading sequence 800.

Resistance determination sequence 500 is entered at a point corresponding to the subject of the resistance determination: calibration resistor 112 (Step 502); ambient thermistor 38 (Step 540); or coil thermistor 36 (Step 506). Microprocessor 102 then generates, at D outputs D0-D2, the appropriate command code corresponding to the selected device for application to MUX 104 (Steps 508–512). In the preferred embodiment, the D register of microprocessor 102, corresponding to output ports D0-D3, may be accessed only as a block. Accordingly, the defrost relay status, controlled by the state of output port D3, is updated in accordance with bit 0 of RAM (3, 13) concurrently with the selection of the resistance channels. Specifically, the desired MUX channel code is placed in the three least significant bits of the accumulator (ACC) of microprocessor 102 (Steps 508–512). The mode flag, RAM (3, 13) bit 0, is then checked (Step 514), and reflected in the most significant bit of the accumulator (Step 516). The contents of the accumulator (ACC) are transferred, via register BD, into the D register, which is used to select the appropriate MUX channel, and to concurrently update the defrost relay drive at port D3 (Step 517).

The system is then delayed a predetermined time period, e.g., two AC line cycles, by I/O port L0 in a low impedance drive mode (in effect shunting capacitor 114) to ensure that capacitor 114 is fully discharged. Specifically, the system detects first (Step 518) and second (Step 520) falling edges in the AC line frequency input. As previously noted in the discussion in conjunction with FIG. 1B, the voltage level of the (level shifted) AC line signal is sampled at port S1 during each instruction cycle, and shifted through internal 4-bit shift register SIO of microprocessor 102. To detect the negative going edges, the contents of the shift register are repetitively loaded into accumulator ACC of microprocessor 102, until a steady high (all ones) is detected. The contents of the shift register is then again periodically sampled and repetitively loaded into the accumulator (ACC) until a steady low is detected (all zeros). The transition from a steady high to a steady low signifies a falling edge.

Referring again to FIGS. 2(1), 2(2), 5(1), 5(2), 5(3), 5A, 5B and 5C, half-second line cycle timer 202, RAM (3, 0-1), initially loaded with a negative 25 or 30 in accordance with the line cycle frequency, is then twice incremented to account for the two-cycle delay (Step 522). Various RAM cells are then initialized in preparation for developing the resistance count: RAM (0, 14-15) is cleared (Step 524); missed cycle counter, RAM (1, 14-15), is presen to a predetermined value, suitably hexidecimal EF (Step 526); and a flag, indicative of a line cycle having been counted (in the preferred embodiment, the carry flag associated with the accumulator of microprocessor 102), is set (Step 528).

Three-state I/O port L0 (sometimes hereinafter referred to as sense line L0) is then switched from low impedence drive mode to high impedence input mode (Step 530), permitting capacitor 114 to be charged through the selected resistance. Specifically, he appropriate code is loaded into the EN register of microprocessor 102, causing the L ports (L0-L7) to assume the high impedence input state, the L ports are subsequently updated, as will be explained.

The resistance count in RAM (0, 14-15) is then incremented on a periodic basis (once for each occurrence of a predetermined number of instruction cycles as determined by the offset represented in RAM (0, 13) bit 0, assumes a logic high value, indicating that capacitor 114 has charged, or until the count overflows, indicating an out-of-limits (default) condition. Accordingly, the system then enters a resistance count generation loop 531. In accordance with one aspect of the present invention, each of the respective program routes through resistance count generation loop 531 entail precisely the same number of instruction cycles, and each culminates by incrementing the resistance count. To provide enforced resolution, it is desirable that the number of steps required to traverse the loop, i.e., the minimum number of instruction cycles per resistance count increment, be relatively small. In the preferred embodiment, the minimum loop execution time (i.e., offset equal zero) is equal to 21 instruction cycles. Loop 531 is exited only when sense line assumes a logic one, or upon overflow.

Upon entry into loop 531, L port copy cell RAM (0, 13) is accessed (Step 532), the status of L ports 0-3 is loaded into RAM (0, 13) (Step 534), and the status of sense line L0, reflected in RAM (0, 13) bit 0, is tested (Step 536).

Assuming that the sense line L0 has not yet assumed a logic high value, the lower half of the resistance count RAM (0, 14) is incremented (Step 538), and tested for overflow (Step 540).

If an overflow condition is not present in cell RAM (0, 14), the AC line signal is monitored to develop the missed cycle count (Step 540). Briefly, indicia of the number of line cycles occurring during the resistance determination process is stored in RAM (1, 14-15), and indicia of the phase of the line cycle is provided, e.g., in the carry bit (c) of accumulataor ACC of microprocessor 102. The missed cycle count in RAM (1, 14-15) is then decremented from the initial value of EF in response to positive going transitions in the line signal. Line cycle monitoring Step 540 will hereinafter be more fully described in conjunction with FIG. 5A.

If, however, incrementing the lower half of the resistance count in RAM (0, 14) (Step 538) resulted in an overflow, the upper half of the resistance count, RAM (0, 15), is incremented (Step 544), and tested for overflow (Step 546).

Assuming that no overflow occured, the system delays a number of instruction cycles determined in accordance with the offset represented in RAM (0, 11-12) (Step 548). Likewise, if incrementing the lower half of the resistance count in RAM (0, 14) did not result in an overflow, after effecting line signal monitoring Step 540, offset delay Step 548 us effected, Offset delay Step 548 will hereinafter be more fully explained in conjunction with FIG. 5C.

After there has been a delay of an appropriate number of instruction cycles determined in accordance with the offset (Step 548), the sequence is repeated beginning at Step 532. Loop 531 contunues until sense line L0 assumes a logic 1 value, indicating that capacitor 114 has charged (Step 536), or, that the resistance count in RAM (0, 14-15) has overflowed (Step 546), indicating a default condition. If an overflow is detected, the resistance count in RAM (0, 14-15) is set to a predetermined maximum value (e.g., 255) (Step 550), and processing continues.

After the resistance count has been developed in RAM (0, 14-15), capacitor 114 is discharged, and the defrost relay status updated. The appropriate codes are then entered into the EN register of microprocessor 102 to switch the L ports from the high impedence input mode to the low impedence drive mode (Step 552). In addition, a code indicative of an unused channel of MUX 104 is entered into the three least significant bits of the accumulator (ACC) (Step 554). The mode status bit, RAM (3, 13) bit 0, is then tested to determine whether or not the system is in the defrost mode (Step 556). If so, a 1 is loaded into the most significant bit of the accumulator (ACC) (Step 558). The contents of the accumulator (ACC) are then loaded, via register BD, into the D register of microprocessor 102 to provide control signals to MUX 104, and to selectively drive defrost relay 118 (Step 560).

The L port copy, RAM (0, 13), is then updated with the L ports in the low impedence drive state to provide valid information with respect to the three most significant bits of RAM (0, 13) (speed, frequency, lock out delay status) (Step 562).

The missed cycle count in RAM (1, 14-15) is then adjusted in accordance with the present phase of the line signal. As previously noted, line signal monitoring (Step 540) provides indicia of the present phase of the line signal; a line cycle counted flag, e.g., the accumulator carry bit, is set, or cleared, in accordance with whether a steady high and steady low value, respectively, was detected in the AC signal. Accordingly, the line cycle counted flag is tested to determine present line cycle phase (Step 564). If the line cycle counted flag is 0, indicating that the present line cycle is in its first half, then the instantaneous line cycle was not reflected in the missed cycle record in RAM (1, 14-15). Accordingly, the primary missed cycle record value in RAM (1, 14) is decremented to account for the instantaneous line cycle (Step 566) and a check made to determine if decrementing RAM (1, 14) caused an overflow (Step 568). An overflow is flagged by setting bit 0 in secondary missed cycle record RAM (1, 15) (Step 570).

After the overflow condition is tested, and the flag set accordingly, the program operation is resynchronized with the line signal. In effect, program progression is delayed until a first positive going transition followed by a negative going transition are sensed in the AC line signal. Specifically, the AC line signal status in the shift register of microprocessor 102 is respectively loaded into the accumulator (ACC) of microprocessor 102 (Step 572), until a steady high state (four successive highs) is detected (Step 574).

The contents of the microprocessor shift register is then again respectively loaded into the accumulator (Step 576) until a steady low value (four successive lows) is detected (Step 578).

After the program operation has been brought back into synchronism with the AC line signal, one-half second timer 202 and the one-half second count in RAM (3, 2), as appropriate, are updated to accomodate the missed line cycles (Step 580). Step 580 will be hereafter described in conjunction with FIG. 5C. After one-half second timer 202 (and one-half second count RAM (3, 2)) is updated, a return to the calling point in the program is effected. To maintain equal execution times in each of the alternative paths through loop 531, line cycle monitoring Step 540, and the steps of incrementing and testing the most significant bits of the resistance count in RAM (0, 15) (Steps 544 and 546, respectively), are implemented to entail an identical predetermined number of instruction cycles.

Figure 5:
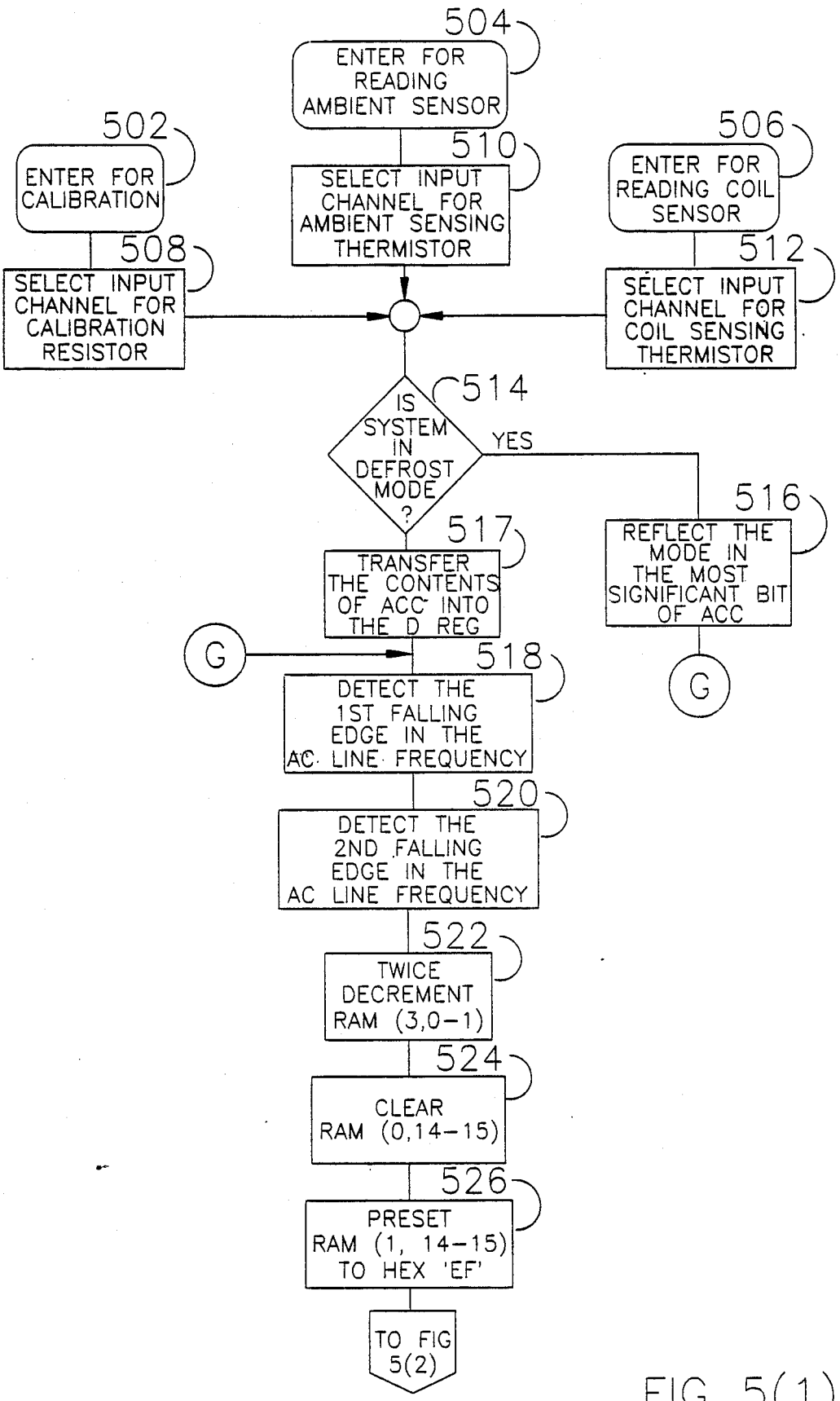
Figure 5:
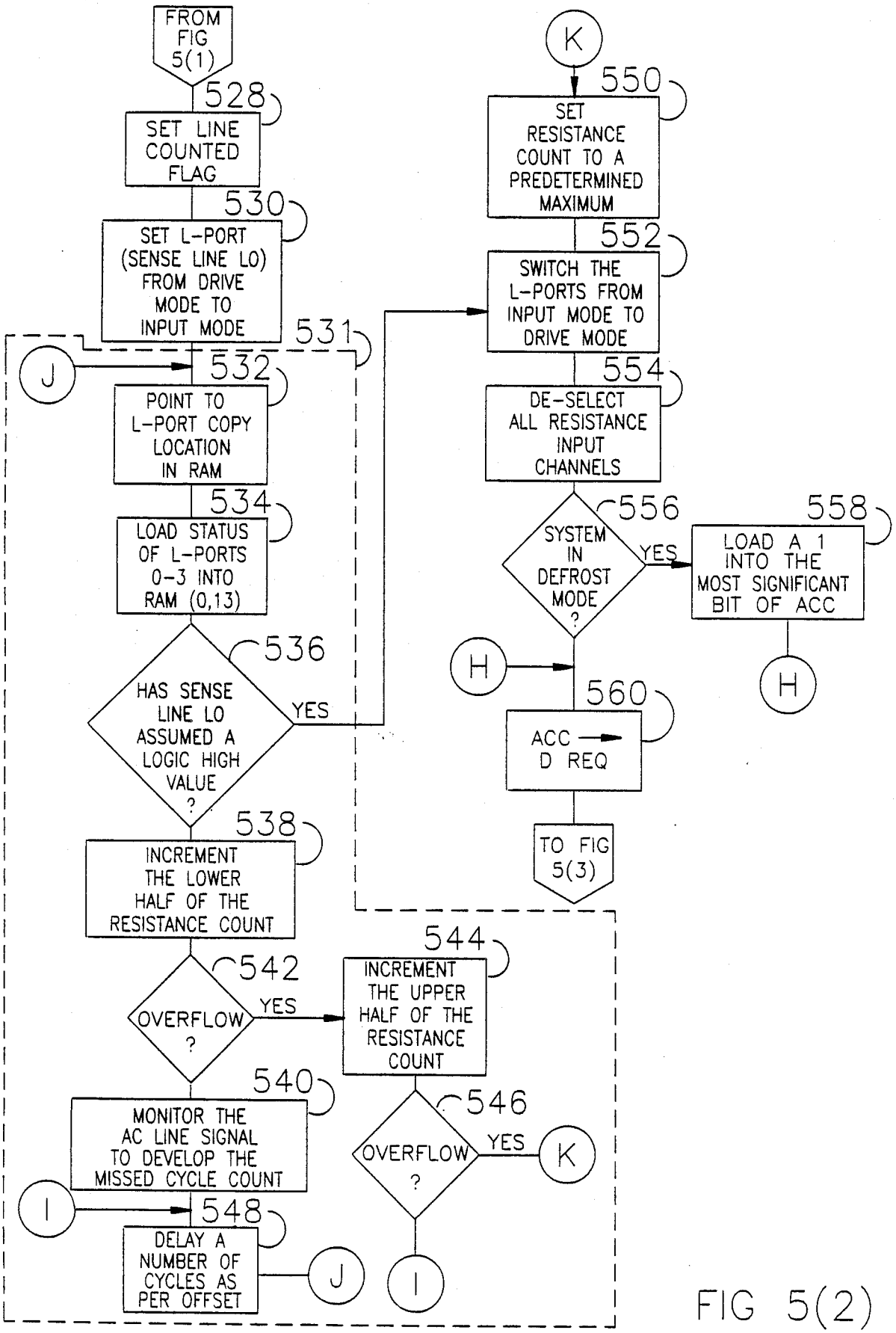
Figure 5:
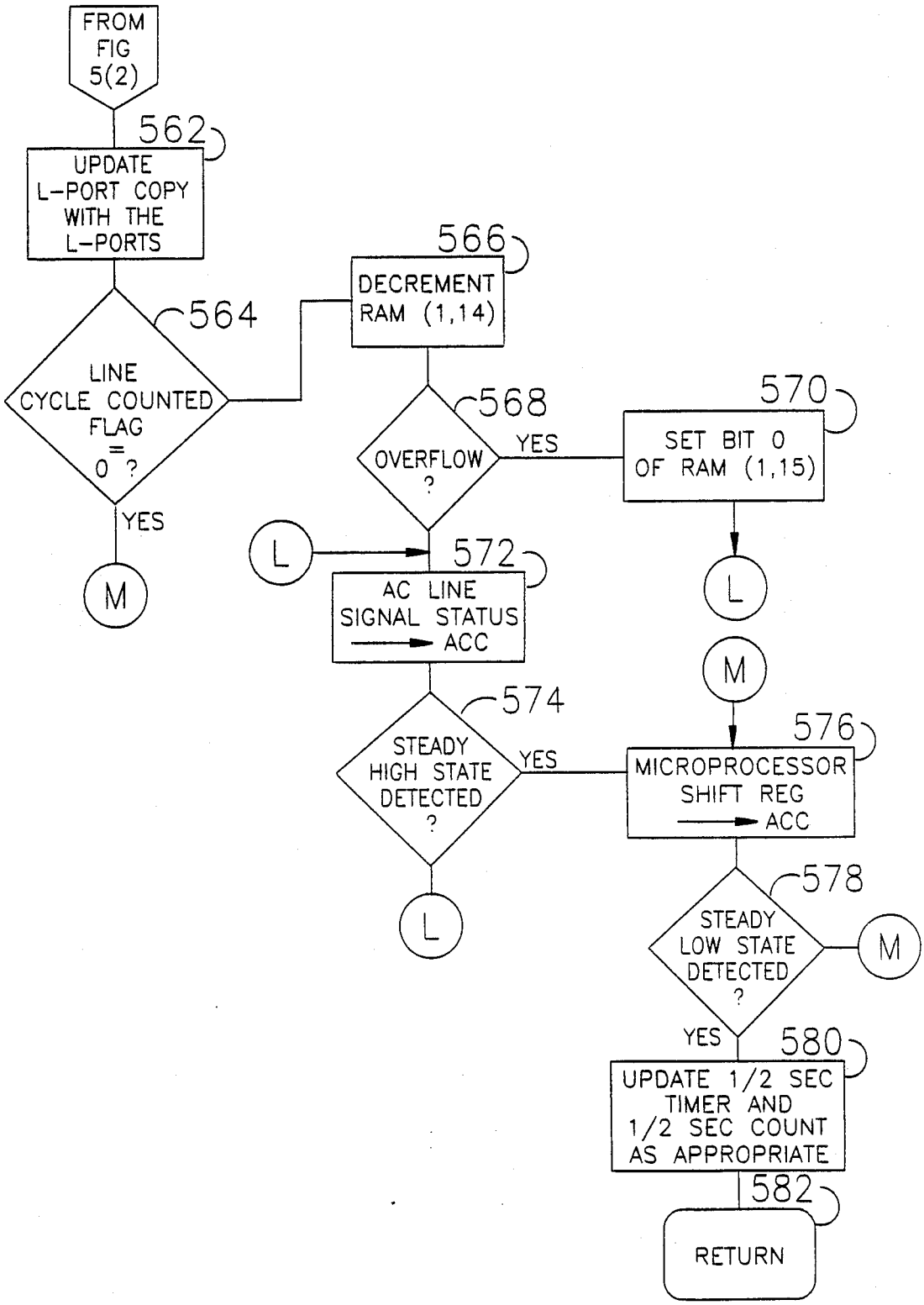
Figure 5A:
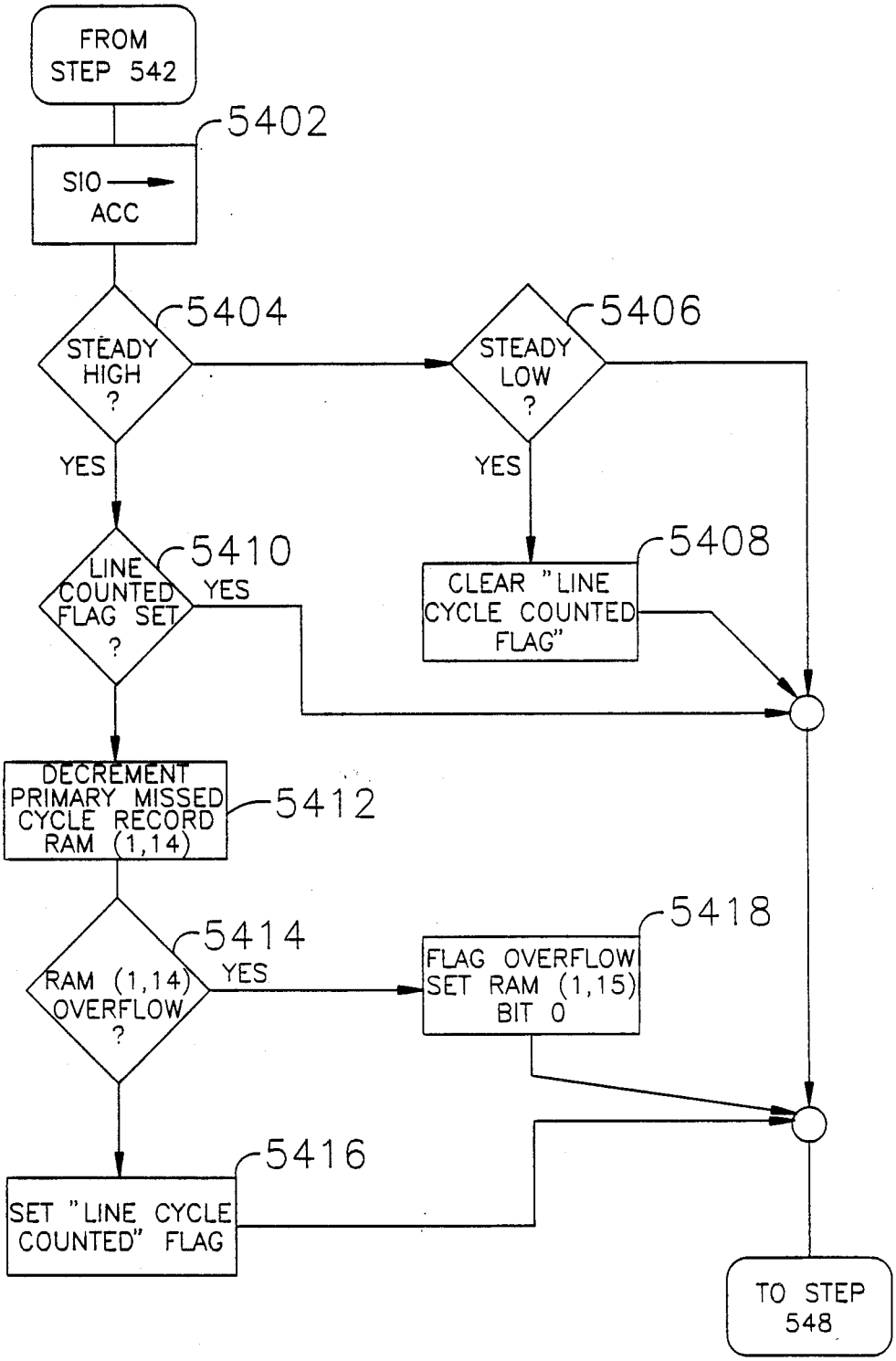

Referring briefly to FIG. 5A, line monitoring Step 540 will be described. The instantaneous phase of the line cycle is first determined. The contents of microprocessor shift register SIO, reflecting the AC line status for four successive instruction cycles, is loaded into accumulator ACC of microprocessor 102 (Step 5402). A test is then made to determine if the AC line signal exhibits a stesdy state high value (four successive highs) (Step 5404).

If not, a test is made to determine if the line sign exhibits a steady low (four successive lows) value (Step 5406). If the line signal state is neither steady high nor steady low, the system assumes that the AC line signal is in transition, and proceeds to offset delay Step 548. If, however, a steady low state value is detected (Step 5406), a line cycle counted flag, suitably the accumulator carry bit, is cleared (Step 5408) prior to proceeding to offset delay Step 548.

If a steady high state line signal value is detected (Step 5404), the line cycle counted flag (carry bit) is tested (Step 5410). If the line cycle counted flag is set, indicating that the instantaneous line cycle has already been reflected in the missed cycle record, the system proceeds to offset Step 548. If, however, the line cycle counted flag is not set, the primary missed cycle record value in RAM (1, 14) (initially set to 15) is decremented (Step 5412), and tested for overflow (Step 5414). If no overflow occurs, the line cycle counted flag (e.g., carry bit) is set (Step 5416) and the system proceeds to offset delay Step 548. If an overflow does occur, the overlow is flagged by setting bit 0 of the secondary missed cycle record, RAM (1, 15) (Step 5418), and the system proceeds to offset delay Step 548.

To ensure that Step 540 entails precisely the same number of instruction cycles as the alternate program route, (i.e., incrementing and testing the most significant bits of the resistance count in RAM (0, 15), Steps 544 and 546), each possible path through line monitoring Step 540 (i.e., Steps 5402, 5404, and 5406; Steps 5402, 5404, 5406, and 5408; Steps 5402, 5404, and 5410; Steps 5402, 5404, 5406, 5410, 5412, 5414, and 5416; Steps 5402, 5404, 5406, 5410, 5412, 5414, and 5418), is implemented to expend precisely the same number of instruction cycles. This is effected through the use of microprocessor commands incorporating skip operations. In effect, although skipped instructions are not executed, one instruction cycle is expended in skipping each byte of the skipped instruction. To the extent necessary, the number of instruction cycles expended are balanced through the use of no-operation commands.

Additionally, logical non-parallelism between respective routes may be employed, With respect to Step 540, for example, the line cycle counted flag is set (Step 5416) after decrementing the missed cycle record. Logically, the line cycle counted flag should be set each time the missed cycle record is decremented, irrespective of whether an overflow condition exists with respect to the primary missed cycle record, to ensure that the missed cycle record is not decremented more than once for any given line cycle. However, in order to maintain the requisite number of instruction cycles in the respective program execution paths, line cycle counted flag is set (Step 5410) only in the absence of an overflow of the primary missed cycle record RAM (1, 14) (Step 5414). Thus, the primary missed-cycle record is typically decremented again during the next successive execution of the loop.

The extraneous decrement results in an apparent ambiguity; two different composite missed record counts are, in fact, reflective of the same number of missed cycles. Primary missed cycle record RAM (1, 14) is decremented from a preset value, hexidecimal F (i.e., decimal 15, binary 1, 1, 1, 1), and resumes the preset value upon counting out (overflow). Secondary missed cycle record RAM (1, 15) is preset with a hexidecimal E (i.e., decimal 14, binary 1, 1, 1, 0). Thus, setting bit zero of RAM (1, 15) in response to an overflow condition in RAM (1, 14) results in a composite missed cycle record RAM (1, 14-15) of hexidecimal F, F. Assuming lopp 531 is not exited, and further assuming that the failure to set the line cycle flag caused RAM (1, 14) to be extraneously decremented during the next execution of loop 531, the result will be a composite missed cycle record of hexidecimal F, E. The potential extraneous decrement of the missed cycle record is accommodated by the process of updating line cycle counter 202 (Step 580).

Figure 5B:
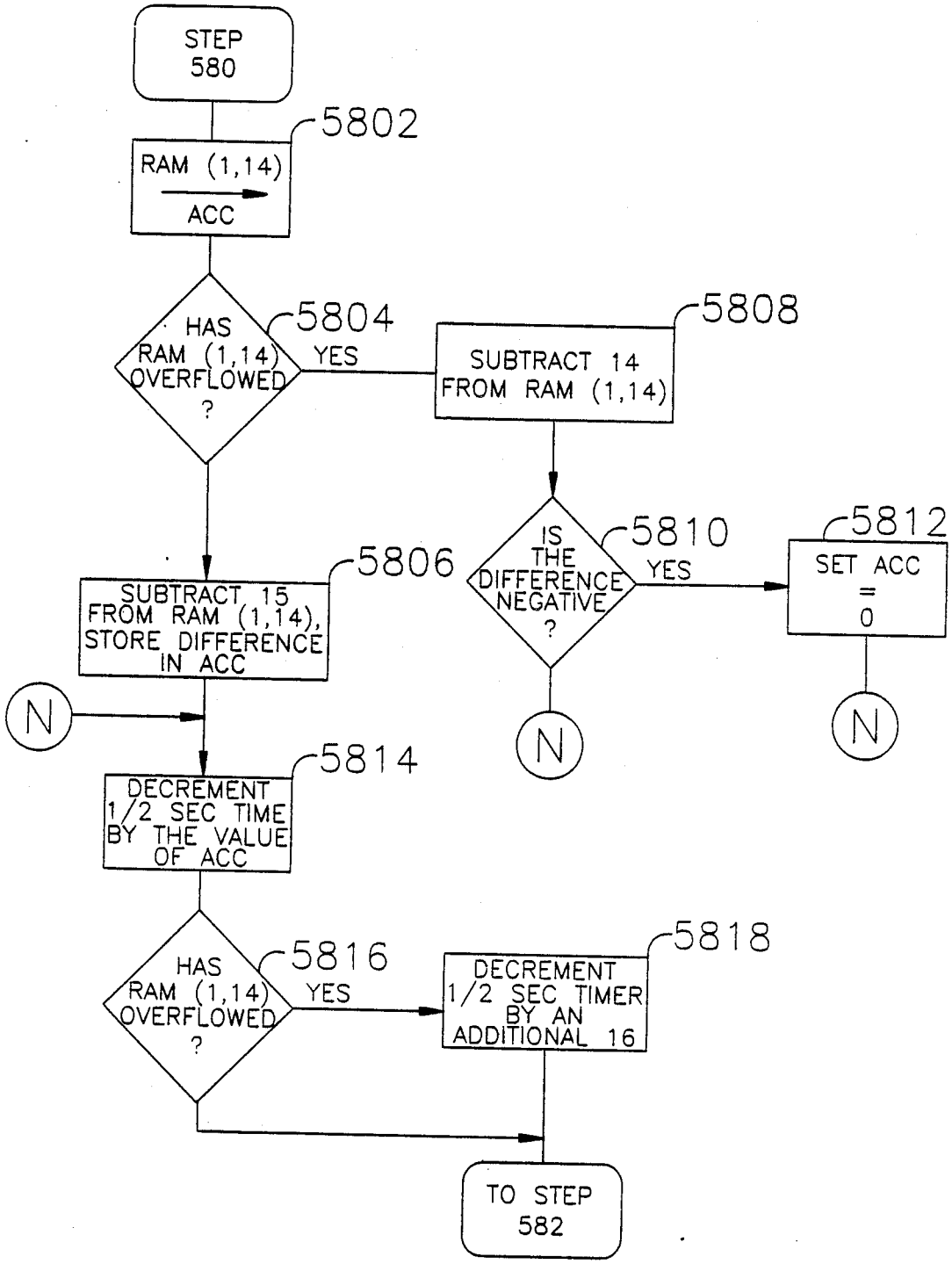

Referring now to FIG. 5B , the updataing of line cycle counter 202 (Step 580) will be described. The updating process is initiated by loading the primary missed cycle record contained in RAM (1, 14) into microprocessor accumulator ACC (Step 5802). If an overflow condition exists in the primary missed cycle record, and if as a result of the overflow, the line cycle flag was not properly set after decrementing the primary counter, the system must accommodate the error. Accordingly, bit 0 of RAM (1, 15) is checked to determine whether or not the primary missed cycle record RAM (1, 14) overflowed during the course of generating the resistance count (Step 5804). If no overflow occurred, the difference between the primary missed cycle record and the preset value 15 reflects the actual number of missed cycles. Accordingly, primary missed cycle record in RAM (1, 14) is substracted from 15 and the result is maintained in accumulator ACC (Step 5806).

Alternatively, if secondary RAM (1,15) contains the value 15, i.e., bit zero was set, the primary missed cycle record was potentially decremented one time more than the actual number of cycles missed. Accordingly, the primary missed cycle record is substracted from 14 to determine the number of cycles actually missed (Step 5808). If, however, no extraneous decrementation had, in fact, occurred, the contents of primary missed cycle record would be equal to 15 and the result of the subtraction (Step 5808) would be negative. Accordingly, the results of the subtraction are tested to determine if they are negative (Step 5810), and if so, the contents of accumulator ACC set to zero (Step 5812).

Once the system has determined whether an overflow condition exists with respect to the primary missed cycle record, and made appropriate adjustment if so indicated, i.e., if the overflow resulted in the line cycle flag not being properly decremented, then the system proceeds to increment the contents of one-half second timer 202 by the contents of accumulator ACC, i.e., by the number of missed cycles (Step 5814).

A determination is then again made as to whether or not primary missed cycle record RAM (1, 14) overflowed, by checking the value of bit zero of RAM (1, 15) (Step 5816). If an overflow has resulted, the contents of one-half second timer 202 are incremented by an additional 16, representing the number of line cycles required to produce an overflow of the primary missed cycle record (Step 5818). The system then proceeds to Step 582; a return is made to the point where resistance determination sequence 500 was summonded.

Figure 5C:
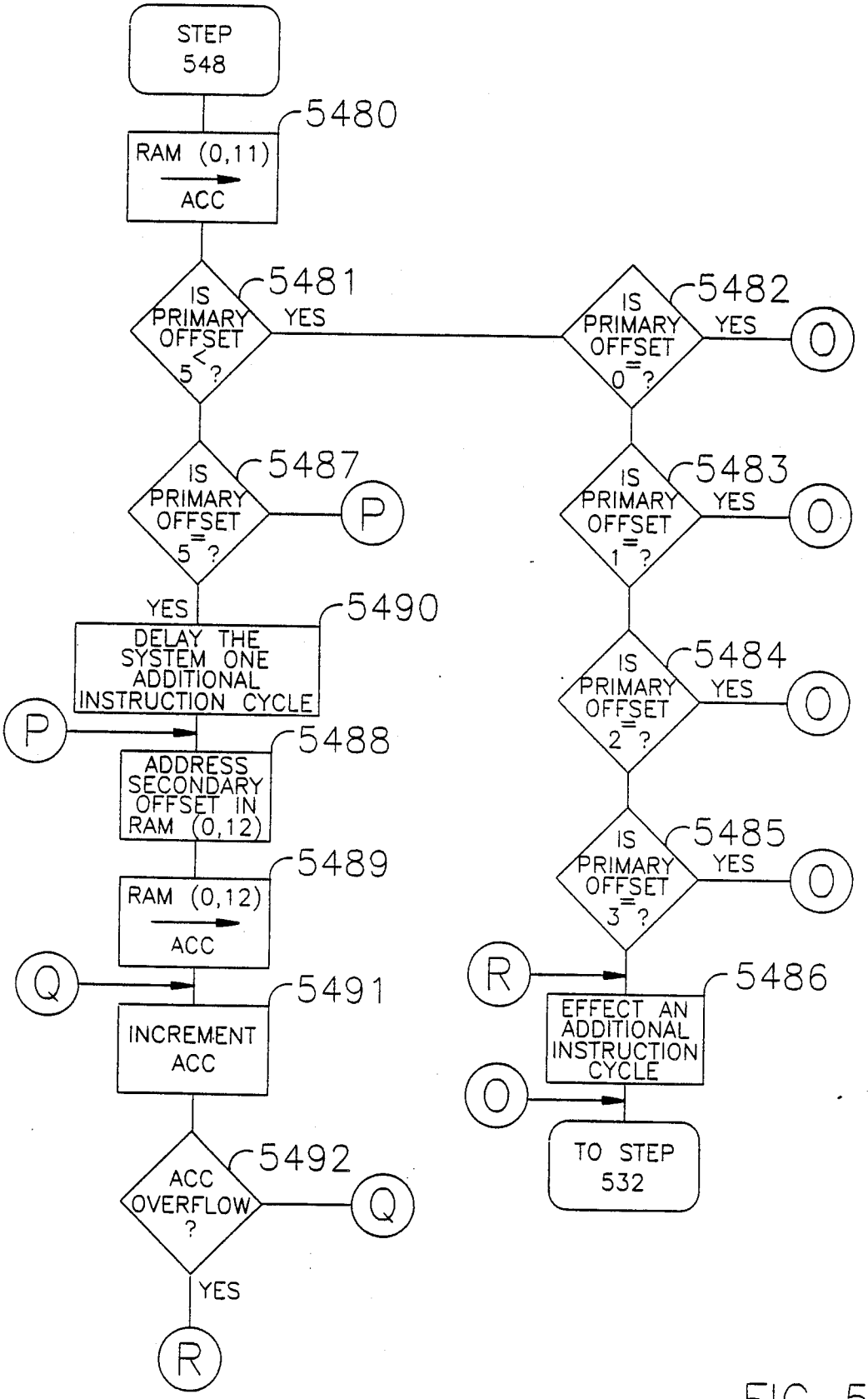

As previously noted, the resistance determination is calibrated (normalized) by adjusting the number of instruction cycles expended in executing resistance determination loop 531 in accordance with the primary and secondary offset reflected in RAM (0, 11-12). Referring now to FIG. 5C, offset delay Step 548 will be described. The primary offset in RAM (0, 11) is initially loaded into microprocessor accumulator ACC (Step 5480). The primary offset contains meaningful values ranging from zero to 6. The primary offset value is first tested to determine if it is less than 5 (Step 5481).

If so, it is tested in sequence, against the numbers zero (Step 5482), 1 (Step 5483), 2 (Step 5484) and 3 (Step 5485), exiting offset delay Step 548 upon a match. In the event that the offset is less than 5, but not equal to zero, 1, 2, or 3, one additional instruction cycle is expended (a pause requiring one instruction cycle) (Step 5486) prior to exiting offset delay Step 548.

If the primary offset is equal to 5 or 6, the secondary offset is employed to generate an additional delay. The secondary offset, reflected in RAM (0, 12), is permitted values ranging from zero to 15. The primary offset is tested to determine whether it is equal to 5 (5487). If it is not, an odd nymber offset is indicated, and the secondary offset in RAM (0, 12) is addressed (Step 5488) and loaded into microprocessor accumulataor ACC (Step 5489). If, however, the primary offset is equal to 5, an even number offset is indicated, and a delay of one additional instruction cycle is effected (Step 5490) prior to addressing the secondary offset (Step 5488) and loading it into accumulator ACC (Step 5489). In practice, steps 5481-5487 are suitably implemented using "jump indirect " instructions.

The offset in accumulator ACC is then incremented until it overflows (Steps 5491 and 5492). After the accumulator overflows, a delay of one additional instruction cycle is effected (Step 5486), prior to exiting offset delay Step 548.

As previously noted, the resistance determination process is initially calibrated, i.e., the offset used in the resistance determinations is established, during the initialization sequence 400, and thereafter reestablished on a periodic basis. In general, the calculation of the appropriate offset entails first performing a resistance determination on precision calibration resistor 112 with a primary offset of 1 and a secondary offset of 15, and comparing the resultant calibration resistance count to a predetermined value. The new offset is calculated in accordance with the degree of deviation.

More specifically, referring briefly to FIGS. 5(1), 5(2), 5(3), 5A, 5B and 5C, execution of resistance count generation loop 531 requires 21 instruction cycles plus an additional number of cycles in accordance with the value of the offset, interjected by offset delay (step 548).

Accordingly, with an offset of 1 for the calibration resistance determination, executing loop 531 entails 22 instruction cycles. Calibration resistor 112 has a known value of 33.2 K ohms. It is desirable to equate each resistance, e.g., 500 ohms per count. Accordingly, for the 33.2 K ohms calibration resistor 112, a resistance count of 66 is desirable. In practice, the actual calibration resistance count is typically somewhat larger than 66 in view of component tolerances, etc. Accordingly, knowing that the calibration count was established at a rate of 22 cycles per count, the offset necessary to bring the calibration count to the desired value of 66 can be calculated. Specifically, the number of instruction cycles per count (22) multiplied by the actual calibration count, divided by the desired count (66) is equal to the base number (21) of instruction cycles expended in executing resistance count generation loop 531, plus the necessary offset. Solving for the offset:

$$\text{Offset} = (\text{Actual count} - 63)/3$$

In practice, to facilitate rounding operations in calculations, a value of 62 may be assumed, rather than 63. Total offset is represented, and implemented through, the primary and secondary offsets.

Figure 6:
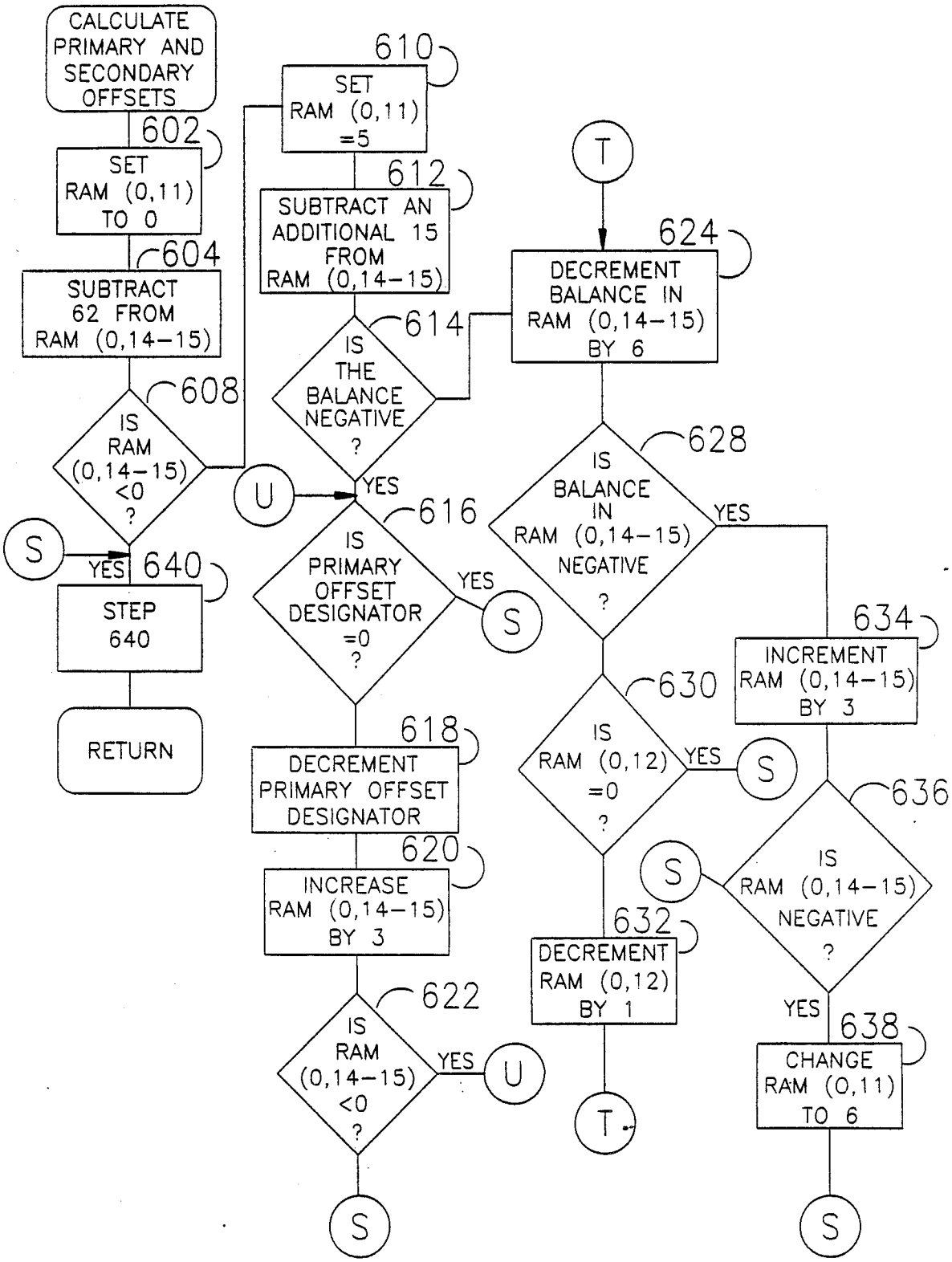

The primary and secondary offsets are suitably iteratively determined. Referring now to FIG. 6, implementation of the calculation of the primary and secondary offsets will be described. Recalling that the calibration resistance count is presently held in RAM (0, 14-15), the primary offset in RAM (0, 11) is first set to zero (Step 602).

The value of 62 is then subtracted from the calibration resistance count in RAM (0, 14-15) (Step 604), and the resultant difference is loaded back into RAM (0, 14-15) and tested to determine whether it is less than zero (Step 608). A positive result or a value of zero indicates the calibration count is greater than or equal to 62. Under normal circumstances, the calibration resistance count is greater than or equal to the desired count of 66; the calibration count does not ordinarily drop below 66 except in the instance of component failure. This situation will be discussed in more detail below.

Assuming that the calibration count is greater than or equal to 62, the system determines whether the necessary offset can be implemented solely with a primary offset. Accordingly, the primary offset in RAM (0, 11) is set equal to 5. Initially, an even-valued offset is assumed in the event that a secondary offset is necessary, as will be explained (Step 610). An additional 15 is then subtracted from the difference held in RAM (0, 14-15) (Step 612), and the resultant value tested to determine if it is negative (Step 614). If the results are negative, the desired offset can be implemented solely through the primary offset record, which is maintained in RAM (0, 11). Accordingly, the necessary primary offset value is determined through an interative process, as will be explained.

Specifically, the primary offset designator is decremented, and the balance count in RAM (0, 14-15) is incremented in steps of three until the balance count becomes positive. As a failsafe, the primary offset designator is first tested to determine if it is equal to zero (Step 616). If the primary offset designator is not equal to 0, it is decremented (Step 618), and the balance count in RAM (0, 14-15) is increased by three (Step 620) and tested against zero (Step 622). This process is repeated until the balance becomes greater than or equal to zero. At that point, the primary offset record value in RAM (0, 11) will effect the desired offset.

If, however, the result of Step 614 was positive, i.e., the measured calibration count was greater than or equal to 77, a secondary offset must be empolyed to implement the desired total offset. In that event, an iterative process is effected to determine the necessary secondary offset. Accordingly, the secondary offset record is decremented by one, and the balance count in RAM (0, 14-15) decremented in steps of 6 until the balance in RAM (0, 14-15) comes negative. A decrement of 6 is empolyed, since each additional increment of secondary offset record is reflective of two additional instruction cycles in the execution of resistance count generation loop 531. Specifically, the balance in RAM (0, 14-15) is decremented by 6 (Step 624), and the balance tested to determine if it is negative (Step 628). If the balance is not negative, the secondary offset record in RAM (0, 12) is tested against 0 as a failsafe (Step 630). Assuming that the secondary offset register is not equal to 0, it is then decremented by 1 (Step 632), and the loop repeated. When a negative balance is attained in RAM (0, 14-15), the contents of RAM (0, 12) are indicative of the desired secondary offset.

The appropriate value for the primary offset is then determined. Where the secondary offset is empolyed, the primary offset, in addition to indicating that a secondary offset is to be employed, indicates whether the overall effective offset will be an even or odd value. Specifically, the balance, now negative, in RAM (0, 14-15) is incremented by 3 (Step 634), and the new balance tested to see if it is still negative (Step 636). If so, the effective total offset will be odd, and the primary offset record in RAM (0, 11) is changed to the value of 6 (Step 638).

In the event that the calibration count is less than 62 (Step 608), or if either the primary offset record or secondary offset record reaches 0 (Step 616, 630), an out-of-limits situation is assumed, and the system proceeds empolying a value of zero in the respective off-set record. As previously mentioned, under normal operating circumstances, this will not occur; such circumstances are typically encountered only upon component failure. After the primary and, if applicable, secondary offset record values haave been established (Steps 622, 636, 638), or after an out-of-limits condition has been detected (Steps 608, 616, 630) and appropriately addressed, the system waits for the next falling edge of the AC line signal (Step 640) in a manner similar to that previously described in conjunction with FIG. 5, and a return to the calling point is effected (Step 642).

Figure 7:
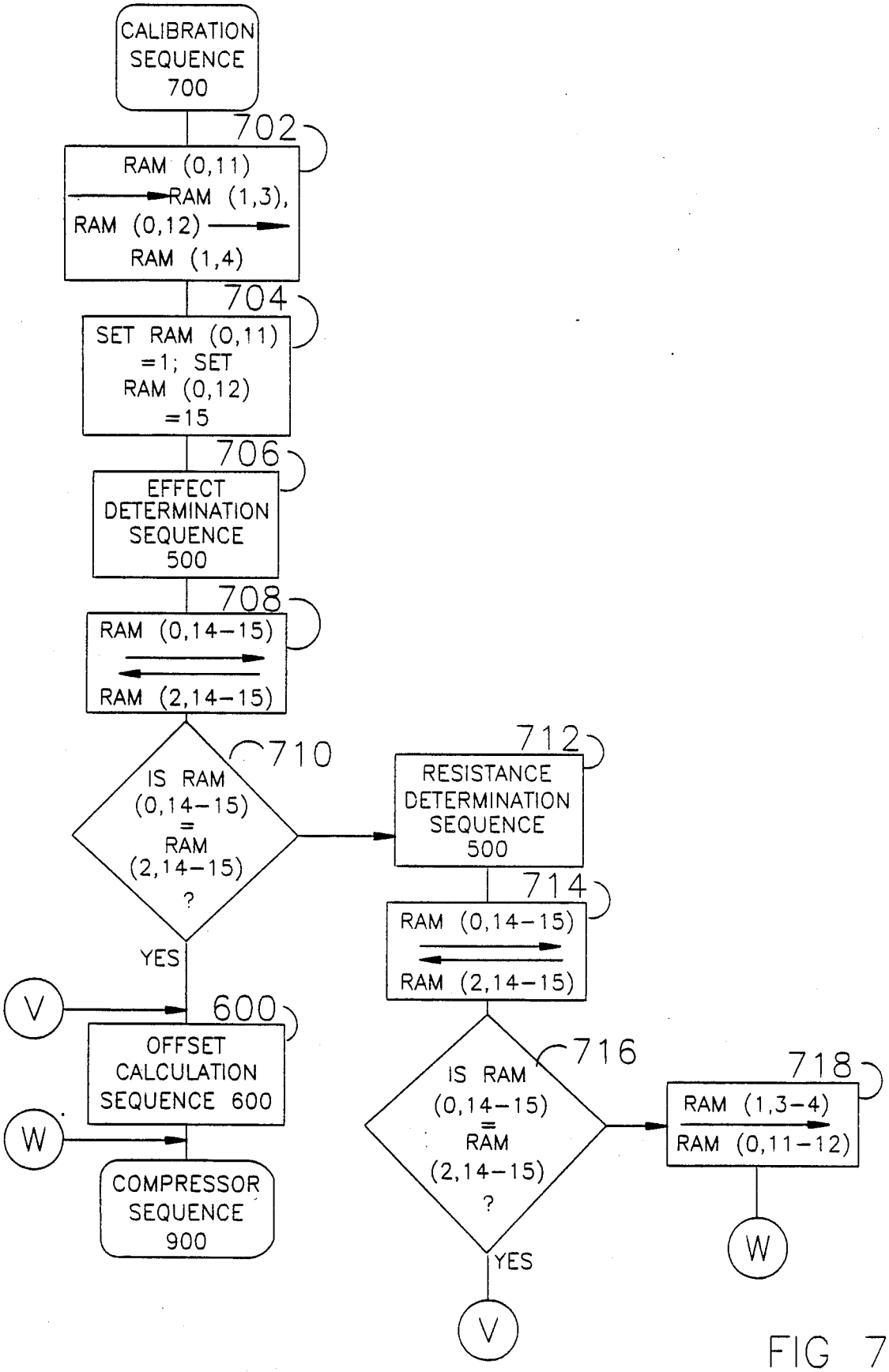

As previously noted, the resistance determination process is initially calibrated during initialization sequence 400, and is thereafter calibrated on a periodic basis, e.g., every 2 minutes and 8 seconds, upon overflow of counter 204, following several cycles of thermistor resistance determinations. Referring now to FIG. 7, calibration sequence 700 will be described. Upon initiation of calibration sequence 700, the present offset record values maintained in RAM (0, 11-12) are copied into RAM (1, 3) and RAM (0, 4), respectively (Step 702). The primary and secondary offset records in RAM (0, 11-12) are set to 1 and 15, respectively (Step 704), and resistance determination sequence 500 is effected with respect to calibration resistor 112 (entry at point 502) (Step 706), resulting in a calibration resistance count in RAM (0, 14-15). The calibration count in RAM (0, 14-15) is then exchanged with the last calibration count contained in RAM (2, 14-15) (Step 708), and the values contained therein are compared (Step 710). If the calibration counts match, offset calculation sequence 600 (previously described in conjunction with FIG. 6) is effected with respect to the calibration count, and program execution proceeds to compressor sequence 900. If, however, the newly generated calibration count does not match the previous value, the resistance determination sequence 500 is again performed on calibration resistor 112 (Step 712) and the new calibration count is written into RAM (0, 14-15). The contents of RAM (0, 14-15) and RAM (2, 14-15) are again exchanged (Step 714), and another coparison is made (Step 716). If a match is found, offset calculation sequence 600 (previously described in conjunction with FIG. 6) is effected with respect to the calibration count, and program execution proceeds to comperssor sequence 900. If the calibrations do not match, the previous offset record stored in RAM (1, 3) and RAM (0, 4) are reloaded into RAM (0, 11-12) (Step 718), and program execution proceeds with compressor sequence 900.

Figure 8:
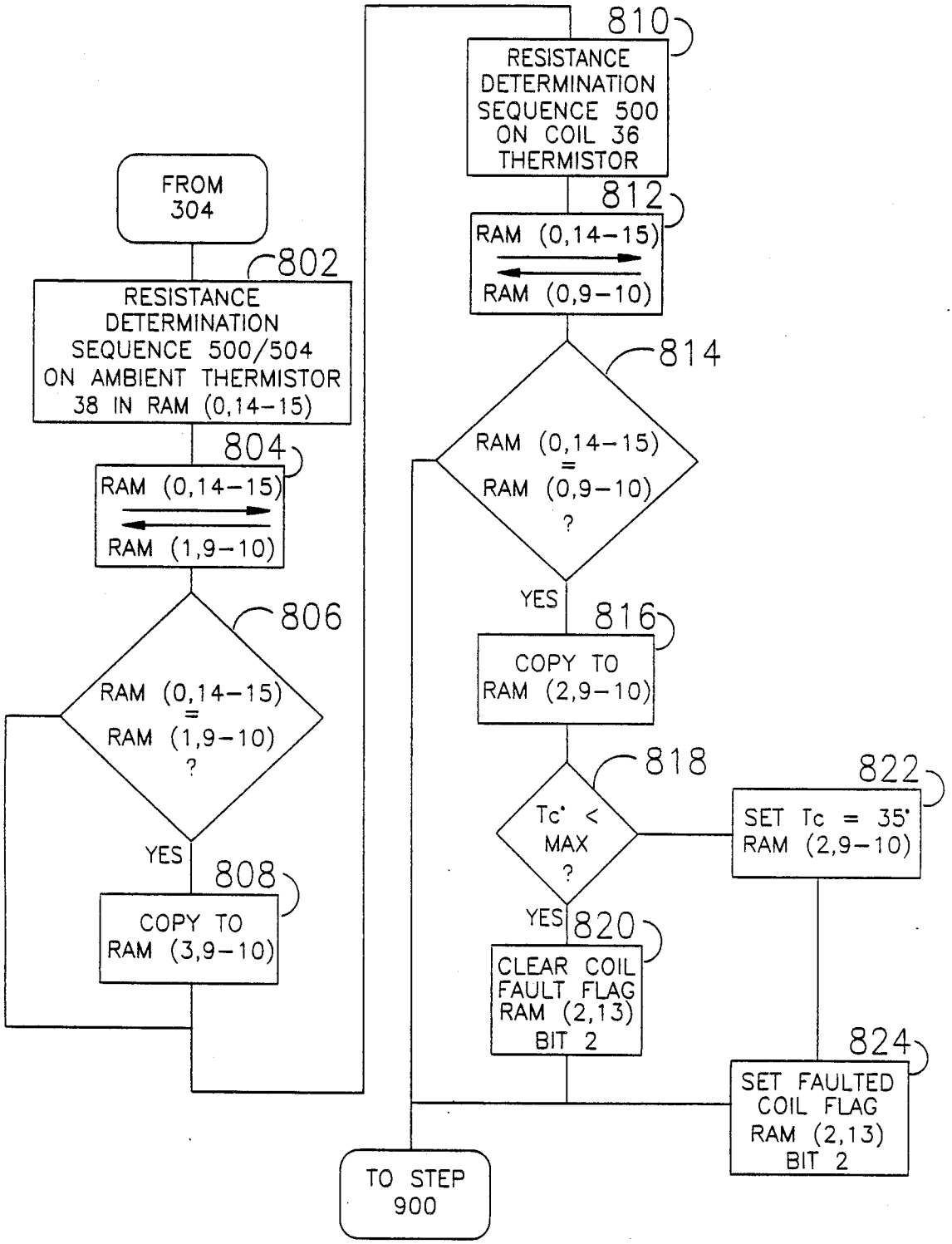

As previously noted, when a calibration sequence is not called for in normal operation loop 300, the system performs a temperature reading sequence 800 to establish ambient and coil temperatures. Referring now to FIG. 8, temperature reading sequence 800 will be described.

Upon initiation of temperature reading sequence 800, the ambient temperature is made of record, Specifically, a resistance determination sequence 500 is effected on ambient thermistor 38, i.e., sequence 500 is entered at point 504. The resultant resistance count is generated into RAM (0, 14-15) (Step 802). The newly developed ambient resistance count in RAM (0, 14-15) is then exchanged with the ambient resistance count developed in conjunction with the just previous cycle maintained in RAM (1, 9-10) (Step 804), and a comparison effected (Step 806). If the respective resistance counts match, the contents of RAM(1, 9-10) are copied into ambient record RAM (3, 9-10) (Step 808), and the system proceeds with resistance determination sequence 500 being effected on coil thermistor 36 (Step 810). If, however, the respective resistance determinations do not match, Step 808 is omitted (i.e., the previous ambient record value is maintained in RAM (3, 9-10) and the system proceeds to resistance determination sequence 500 (Step 810).

Indicia of the temperature of heat exchange unit (e.g., coil) 28 is then made of record. Specifically, a resistance determination sequence 500 is effected on coil thermistor 36 (Step 810), resulting in a resistance count in RAM (0, 14-15). The newly developed resistance count is then exchanged with the previous coil resistance count in RAM (0, 9-10) (Step 812), and a comparison of the respective counts is made (Step 814). If the respective resistance counts are equal, the coil record, RAM (2, 9-10), is updated with the new value from RAM (0, 9-10) (Step 816). If however, the respective resistance counts do not correspond, the system exits temperature reading sequence 800 and proceeds in normal operating loop 300 with comperssor sequence 900.

Assuming that a new coil temperature is made of record, it is then analyzed for indicia of fault conditions. The coil temperature is first compared to a predetermined maximum value (Step 818). Specifically, indicia of the predetermined maximum value is subtracted from the resistance count in RAM (0, 14-15). If the resultant content of RAM (0, 14-15) is negative, the temperature is within limits, and accordingly, coil fault flag RAM (2, 13) bit 2 is the main loop to compressor sequence 900. If, however, the subtraction indicates a coil temperature not less than the maximum value, the coil temperature record value at RAM (2, 9-10) is set to the equivalent of 35° (Step 822) and the coil fault flag, RAM (2, 13) bit 2, is set (Step 824) prior to proceeding to compressor sequence 900.

Figure 9:
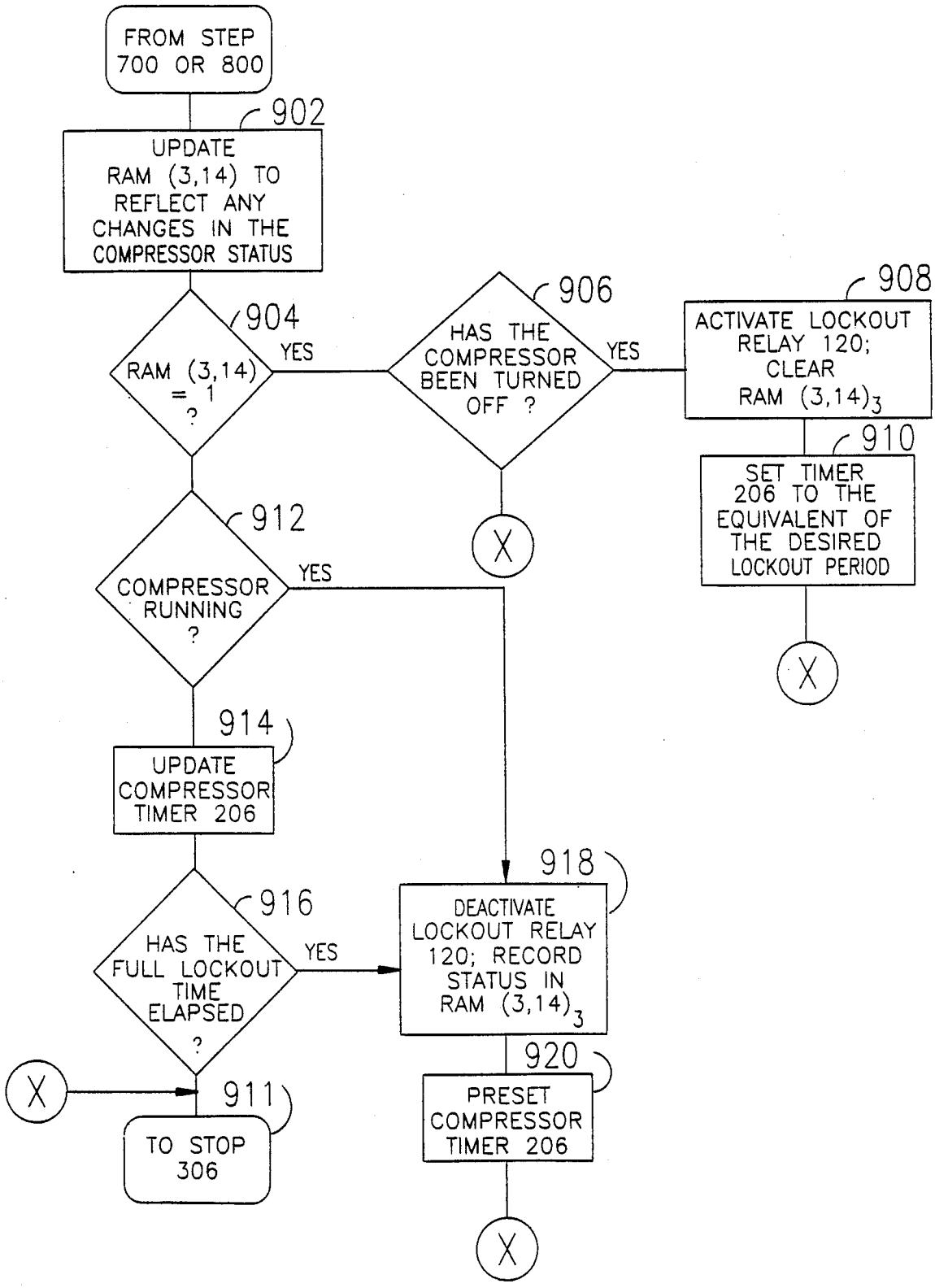

In normal operating loop 300, after the calibration sequence 700 or temperature reading sequence 800 is completed, compressor sequence 900 is effected. Referring now to FIG. 9, compressor sequence 900 will be described.

As a preliminary step, compressor status data maintained in RAM (3, 14) is updated to reflect any changes in compressor status (Step 902). Specifically, RAM (3, 14) is addressed. The "last status" bit, bit 2, is then updated; debounce status bit 1 is copied into bit 2. The contents of RAM (3, 14) are then copied into accumulator ACC, and the compressor-run sense input (port G0 of microprocessor 102) is tested. If the compressor is running, i.e., the input is low, RAM (3, 14) bit 0 is set. Conversely, if G0 is high, RAM (3, 14) bit 0 is cleared. The contents of RAM (3, 14) are then compared with the previous compressor status reflected in accumulator ACC to determine if the compressor status has changed. If no change has occured, i.e., a match occurs, the debounced status reflected in bit 1 is updated with the current status in bit 0. Conversely, if there is no match, debounce status bit 1 is not changed.

The lockout function, whereby compressor 22 is disabled for a predetermined period after being turned off to ensure that head pressure dissipates prior to restarting, is then implemented. A test is then made to determine if the compressor is presently enabled; bit 3 of RAM (3, 14) is tested for a 1 value (Step 904). Assuming that the compressor is presently enabled, a test is made to determine whether the compressor had been turned off by thermostat 34 since RAM (3, 14) was last updated (Step 906). Specifically, bits 1 and 2 of RAM (3, 14) are tested; if last status bit 2 is set, indicating the compressor was previously on, and debounce status bit 1 is 0, indicating that the compressor is presently off, the compressor had been turned off since RAM (3, 14) was last updated.

If the compressor had been turned off since the last update, initiation of lockout is indicated. Accordingly, lockout relay 120 is activated by generating a high level value on port G3 of microprocessor 102, and bit 3 of RAM (3, 14) is cleared to reflect the new compressor status (Step 908). Compressor timer 206 (RAM (1, 0-2)) is then set to the equivalent of the desired lockout period duration, a five-minute or eight-minute value in accordance with RAM (0, 13) bit 1, reflecting the input to port L1 of microprocessor 102 (Step 910). After compressor timer 206 is preset, the system proceeds in normal operating loop 300 with the mode test Step 306 (Step 911). If, however, it appears from the comparison of Step 906 that the compressor has not been turned off, the program proceeds directly to mode determination Step 306 (Step 911).

If, after the compressor status is updated (Step 902), it is determined that the compressor is not enabled, i.e., the lockout period is in progress (Step 904), RAM (3, 14) bit 1, the current debounced status of the compressor, is tested to ensure that the compressor lockout relay has not faulted or otherwise by-passed (Step 912). Assuming that the compressor is not running, compressor timer 206 is updated; the contents of timer 206 are decremented in accordance with the contents of half-second count RAM (3, 2) (Step 914). The contents of timer 206 are then tested to determine if the compressor lockout time has elapsed (Step 916). If the compressor lockout time has not elapsed, the system proceeds in normal operating loop 300 with mode test Step 306. If the compressor lock-out time has elapsed, lockout relay 120 is deactivated by clearing port G3 of microprocessor 102, and indicia that compressor 22 has been enabled is written into RAM (3, 14) bit 3 (Step 918).

If, as a result of the testing of RAM (3, 14) bit 0, it is determined that the compressor is running notwithstanding a disabled status (Step 912), Steps 914 and 916 asre bypassed and Step 918 executed to deactivate lockout relay 120 and force RAM (3, 14) bit 3 accurately reflect the compressor status. After the new compressor status has been established (Step 918), compressor timer 206 is preset to a value reflective of a five minute interval in preparation for establishing a period of continuous compressor run (Step 920).

Figure 10:
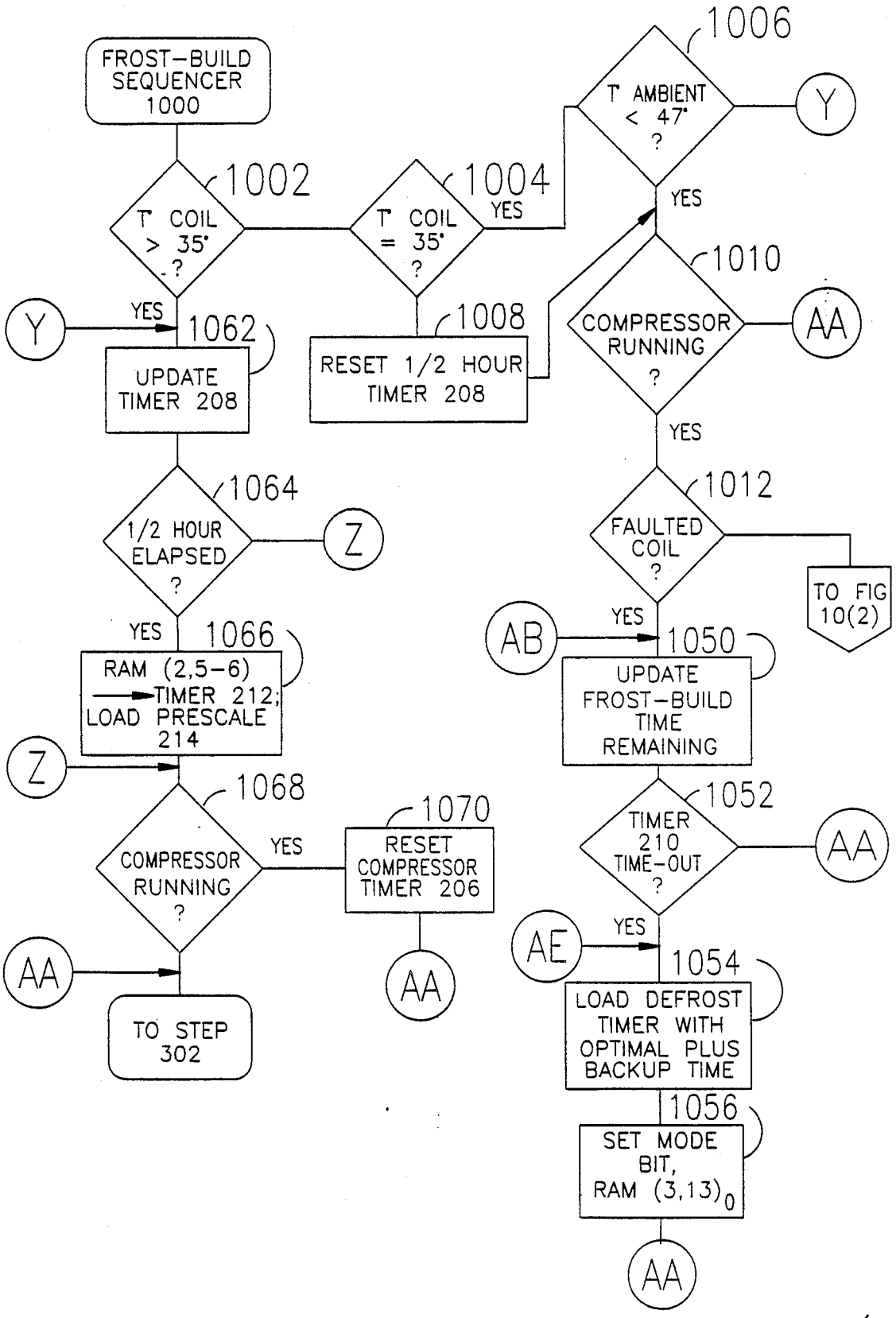
Figure 10:
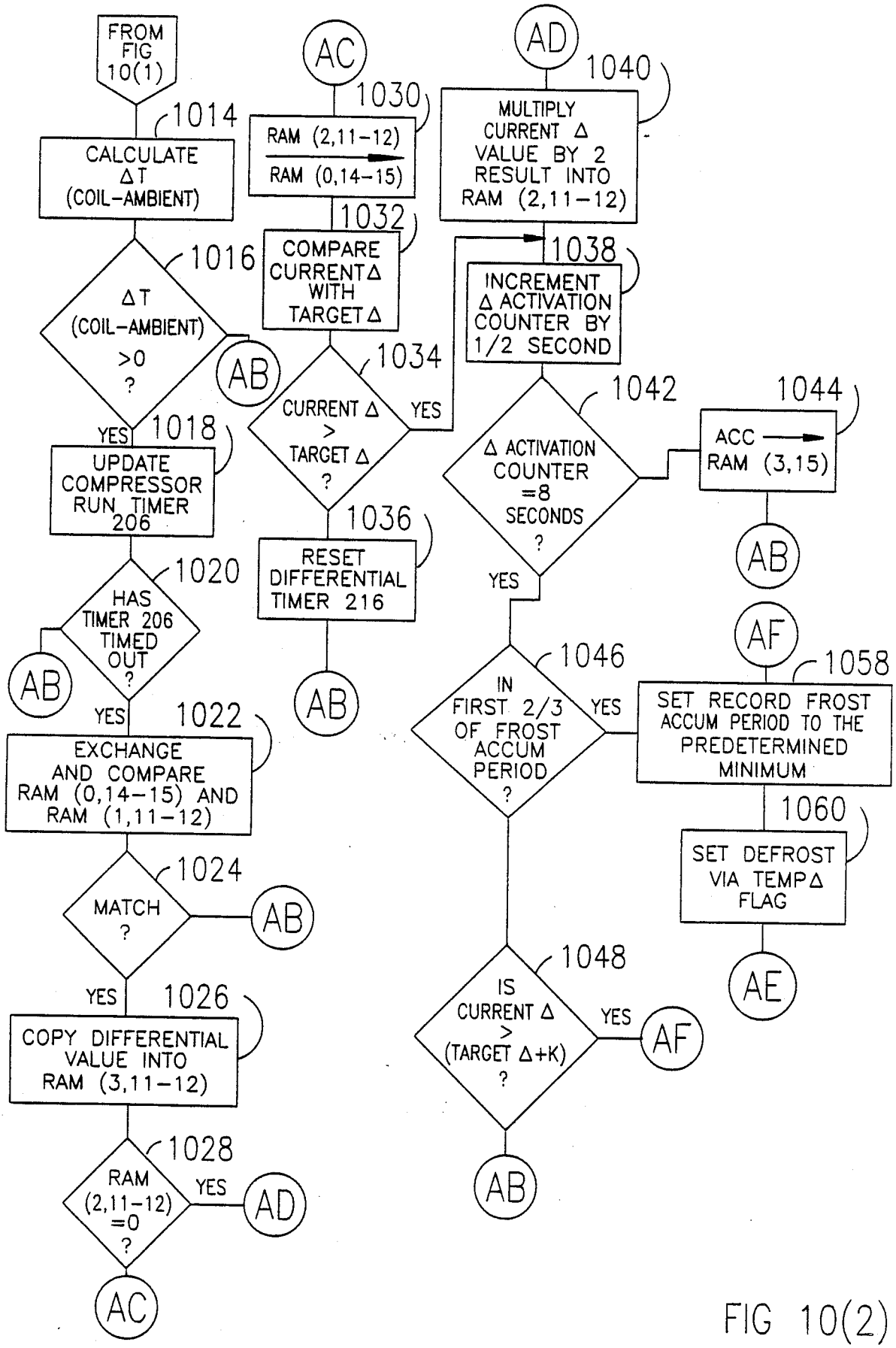

In normal operating loop 300, after compressor sequence 900 is completed, either frost-build sequence 1000 or defrost sequence 1100 is executed, in accordance with the present mode of the system as reflected in RAM (3, 13) bit 0 (Step 306). Assuming that the system is in the frost accumulation mode, i.e., bit 0 of RAM (3, 13) contains a 0, frost-build sequence 1000 is executed. Referring now to FIG. 10, frost-build sequence 1000 will be described.

A determination is first made as to whether of not the coil temperature is conducive to an accumulation of frost. Specifically, the coil record, RAM (2, 9-10), is tested for values indicative of a coil temperature in excess of 35° (Step 1002). If the coil temperature is greater than 35°, conditions are deemed not conducive to frost accumulation.

If, however, the coil record value indicates a temperature not greater than 35°, a test is made to determine if the coil temperature is equal to 35° (Step 1004). A coil temperature of 35° is equivocal as to whether or not conditions are conducive for frost accumulation. In addition, 35° is a system default value; in the event of a coil default condition as determined in Step 818, the coil record, RAM (2, 9-10), is set to a value equivalent to 35°

(Step 822). Accordingly, if the contents of RAM (2, 9-10) equate to 35°, the ambient temperature is deemed determinative as to whether conditions are conducive to frost accumulation. The ambient temperature, represented in RAM (3, 9-10), is then tested for a value indicative of a temperature less than 47° (Step 1006). If the ambient temperature is not less than 47°, conditions are deemed not conducive to frost accumulation.

Assuming that conditions are deemed unequivocally conducive to frost accumulation, i.e., the coil temperature is less than 35° (Steps 1002, 1004), 30-minute timer 208 is reset (Step 1008). As previously noted, if 30-minute timer 208 times out, indicating a half-hour period of conditions which are not conducive to frost accumulation, timer 210 is reloaded with indicia of the frost-build record, RAM (2, 5-6), to reinitiate the frost-build period. Timer 208 is suitably not reset when ambient conditions are deemed determinative of frost accumulation conditions (Step 1006).

After timer 208 is reset (Step 1008), or upon a determination to proceed in view of ambient temperature (Step 1006), compressor status, as reflected in RAM (3, 14) bit 1, is tested (Step 1010). If RAM (3, 14) bit 1 indicates that the compressor is not running, the normal frost accumulation cycle has been interrupted and the system proceeds in normal operation loop 300 to execute update calibration timer step 302.

Assuming, however, that the compressor is running, i.e., RAM (3, 14) bit 1 contains a 1, the system proceeds in frost-build sequence 1000 with an analysis of the temperature values. Specifically, RAM (2, 13) bit 2 is tested (Step 1012) to determine if a coil fault was detected. If a coil fault is detected, the coil temperature indicia in RAM (2, 9-10) was falsified to reflect 35° (Steps 818, 820, 824). Accordingly, analysis of the temperature data is omitted, and the system proceeds to decrement the frost accumulation period in timer 210 in accordance with the half-second count in RAM (3, 2) (Step 1050). In the absence of a coil fault, however, the coil record value in RAM (2, 9-10) accurately reflects the coil temperature, and the system proceeds to check for abrupt environmental changes.

Accordingly, the temperature differential between coil and ambient is calculated (Step 1014). Specifically, the coil record in RAM (2, 9-10) is copied into RAM (0, 14-15). The ambient record in RAM (3, 9-10) is then subtracted from the indicia of coil temperture and the difference is established in RAM (0, 14-15).

Under normal frost accumulation conditions, the coil temperature is lower than ambient. Accordingly, the difference in RAM (0, 14-15) is tested to ensure it is positive (Step 1016). If the difference is a nonpositive value, further temperature analysis is omitted, and the system proceeds to decrement timer 210 (Step 1050).

Assuming that the coil temperature is less than ambient, compressor timer 206, which was initially loaded with indicia of the desired continuous run timer, e.g., 5 minutes, is updated, i.e., decremented in accordance with the contents of the half-second count in RAM (3, 2) (Step 1018), and tested for overflow (Step 1020). If compressor timer 206 has not timed out, the temperature is deemed not to have stabilized. In that event, further analysis of the temperature readings is omitted and the system proceeds to decrement timer 210 (Step 1050).

Assuming, however, that compressor timer 206 has timed out, evidencing that compressor 22 has run conuinuosly for five minutes in a frost accumulation condition and has thus attained a stable condition, the differential value in RAM (0, 14-15) is exchanged with the previous differential value in RAM (1, 11-12), and a comparison of the values effected (Step 1022). If the respective differentials do not match, conditions are deemed unstable, Accordingly, further analysis of the temperature reading is omitted and the system proceeds to decrement timer 210 (Step 1050).

If the current differential does match the last differential, however, the differential value is copied into the debounced differential record RAM (3, 11-12) (Step 1026). The system then proceeds to either establish a target differential or to compare the current differential to the target value, depending on whether a target value was previously established.

The target differential indicia in RAM (2, 11-12) is first tested to determine if a target value has been established. Initially, the target differential was set to 0. Thus, if the contents of RAM (2, 11-12) are 0, a target differential has not yet been established (Step 1028). In that case, twice the current differential value is assumed as the target. Specificaly, indicia of the current differential is, at this point, contained in RAM (0, 14-15). The value of the current differential is doubled by adding the contents of RAM (0, 14-15) to itself, and the result is transferred into differential target record RAM (2, 11-12) (Step 1040).

Assuming that the target differential in RAM (2, 11-12) is not 0, the current and target differentials are compared. Accordingly, the target differential in RAM (2, 11-12) is copied into RAM (0, 14-15) (Step 1030). The current differential in RAM (3, 11-12) is then subtracted from the target differential, and the difference is established in RAM (0, 14-15) (Step 1032).

The system then determines whether the current differential has exceeded the target differential, i.e., whether the contents of RAM (0, 14-15) are negative (Step 1034). If the current differential does not exceed the target differential, differential activation timer 216 is reset (Step 1036) and timer 210 is decremented (Step 1050). If, however, the current differential is greater than the target differential, i.e., if the contents of RAM (0, 14-15) are ngegtive (Step 1034), the contents of differential activation counter 216 are loaded into accumulator ACC. Accumulator ACC is then incremented by the contents of the half-second count in RAM (3, 2) (Step 1038) and the result tested is for overflow (Step 1042). Step 1038 is similaraly effected after first establishing a target differential (Step 1040).

Assuming that an eight-second period has not been achieved, i.e., accumulator ACC did not overflow when incremented, the incremented value in accumulator ACC is saved in the differential actuation counter 216, RAM (3, 15) (Step 1044) and timer 210 is decremented (Step 1050).

Assuming, however, that the differential has exceeded the target differential for at least eight seconds (Step 1042), i.e., conditions have prevailed for the eight-second period (resulting in an overflow condition of accumulator ACC), a determination is made as to whether the system is in the appropriate portion of the frost accumulation cycle to respond to a sudden environmental change. Specifically, a determination is made as to whether the system is still in the first two-thirds of the frost accumulation period (Step 1046). This is suitably accomplished by loading indicia of the frost build period contained in RAM (2, 5-6) into RAM (0, 14-15), and then subtracting, from the contents of RAM (0,

14-15), the time remaining in count timer 212 three successive times. If the result of any of the successive subtractions is negative, the system is still in the first two-thirds of the frost build time.

If the system has proceeded beyond the first two-thirds of the frost accumulation period, as determined in Step 1046, a further test of the current differential temperature is made to determine if excessive frost accumulation exists. Specifically, the current temperature differential is compared against the target differential plus an additional factor (together creating an adjusted target value) such as, for example, a predetermined percentage of the targer differential (Step 1048). If the current temperature differential does not exceed the adjusted target value, environmental conditions are deemed within limits and the system proceeds to decrementing timer 210 (Step 1050).

As previously noted, if the system establishes that an analysis of the temperature readings is not warranted, or that environmental conditions were within limits, the frost accumulation time remaining in basic mode timer 210 is updated in accordance with the half-second count in RAM (3, 2). The half-second count is subtracted from prescaler 214 (Step 1050). If prescaler 214 overflows, timer 212 is decremented and the prescale added back into prescaler 214. Timer 212 is then tested for a time out condition (Step 1052).

Assuming that the frost accumulation period has not elapsed, the system proceeds in normal operating loop 300 to execute the update calibration timer step 302. If, however, the frost build period has elapsed, mode timer 210 is loaded with predetermined values from ROM 170 which are indicative of the predetermined optimal defrost and percentage backup times, as previously described (Step 1054), and the mode bit, RAM (3, 13) bit 0, is set to indicate that the system has entered the defrost mode (Step 1056). As previously described, the output signal to defrost relay 118 provided at output port D3 of microprocessor 102 is updated to reflect the new status during the next successive resistance determination sequence. The system then proceeds to calibration timer step 302.

In the event that environmental conditions are deemed to warrant an immediate defrost, as determined by Steps 1046 or 1048, the record frost accumulation period, RAM 2, 5-6), is set to the predetermined minimum value (Step 1058), the defrost via temperature differential flag, RAM (3, 13) bit 1, is set (Step 1060), and the defrost mode is entered through Steps 1054 and 1056. After mode bit, RAM (3, 13) bit 0, has been appropriately set to indicate that the system is in defrost mode (Step 1056), the system then proceeds in normal operating loop 300 with update calibration timer step 302.

If in Step 1002 it was determined that the coil temperature was greater than 35°, and thus not conducive to frost accumulation, or, if it was determined in Steps 1004 and 1006 that the record coil temperature was 35°, and that the ambient temperature not less than 47°, "above frost temperature" timer 208 is updated in accordance with the half-second count in RAM (3, 2) (Step 1064). If conditions not conducive to frost buildup have prevailed for more than one-half hour, frost accumulation mode operation will be maintained, basic mode timer 212 will be reloaded with the frost build record in RAM (2, 5-6) and prescale 214 will be loaded in accordance with the preset value for frost build mode found in ROM 170 (Step 1066). If it is determined in Step 1064 that the half-hour period has not elapsed, Step 1066 is omitted.

After basic mode timer 210 is reinitialized, if appropriate as determined in Step 1064, a test is made to determine if compressor 22 is running; RAM (3, 14) bit 1 is tested (Step 1068). If compressor 22 is running, compressor run timer 206 is reset (Step 1070).

After the compressor status has been tested (Step 1068) and compressor timer 206 set (Step 1070) as appropriate, the system proceeds in the execution of normal operating loop 300 with update calibration timer step 302.

Figure 11:
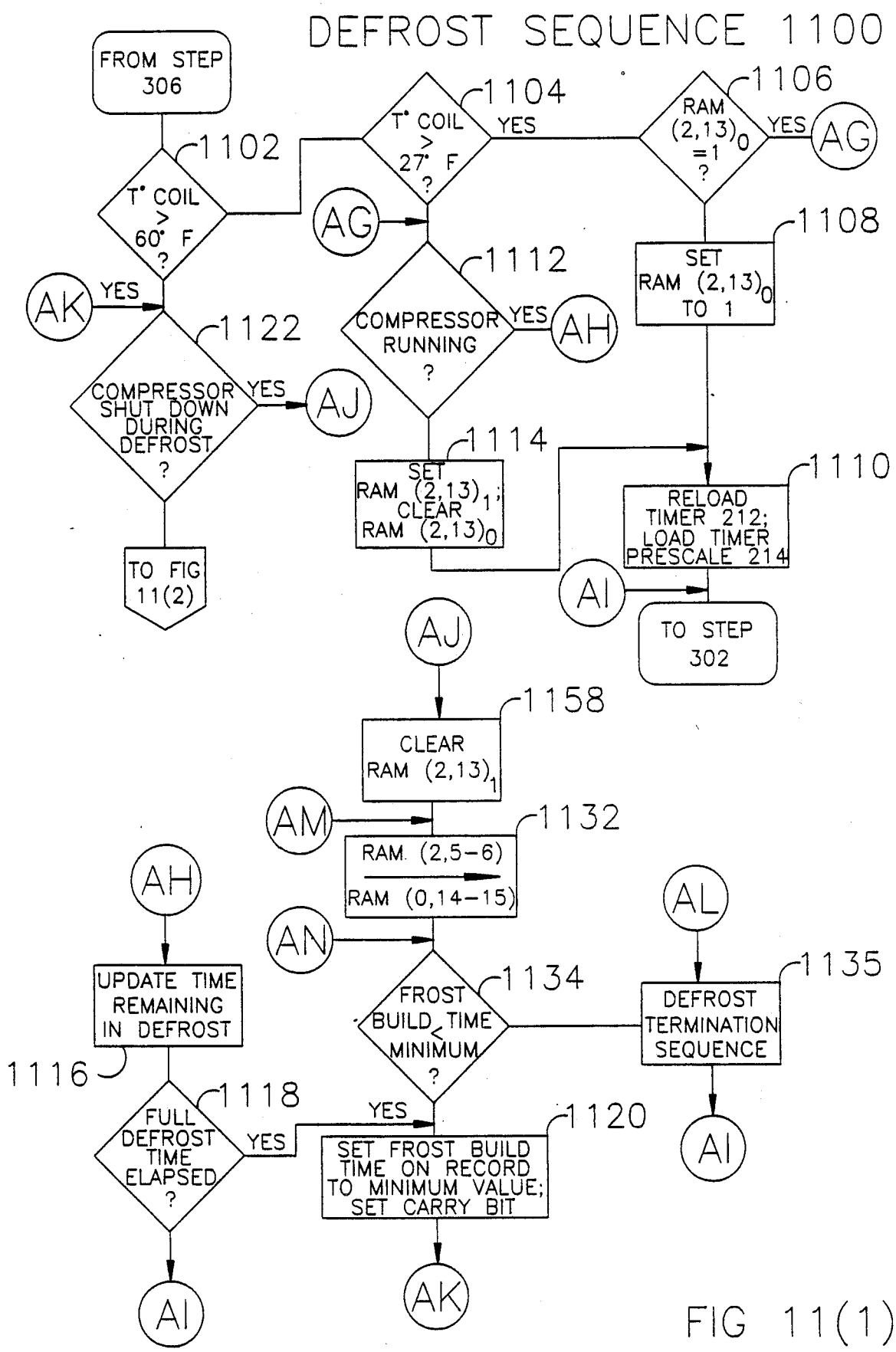
Figure 11:
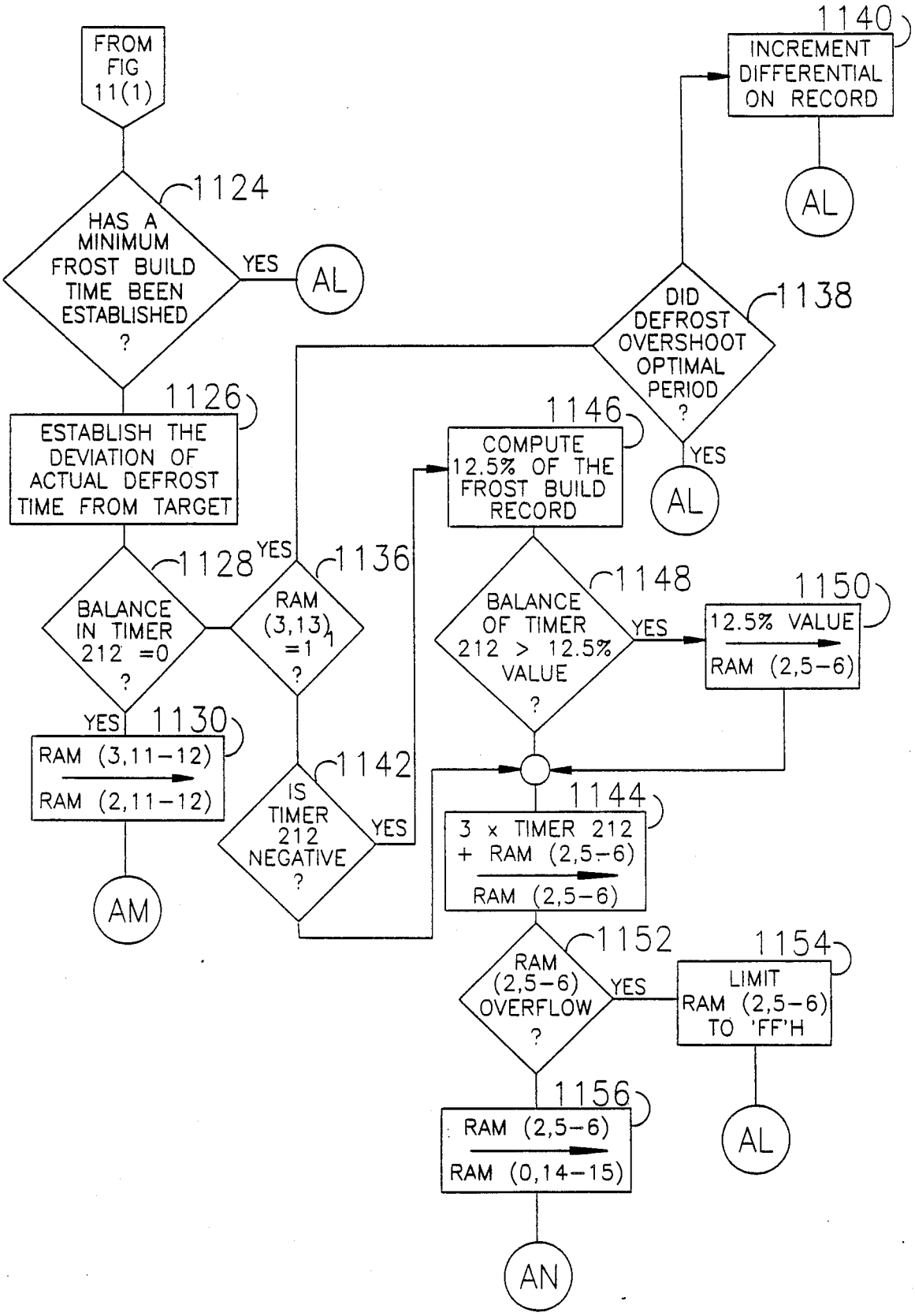

As previously noted, at the culmination of the frost accumulation period, timer 210 is loaded with indicia of a maximum defrost period (the optimum defrost time plus an overshoot) (Step 1054) and defrost relay 118 actuated (Step 1056). In essence, defrost sequence 1100 decrements timer 210 until the maximum period is exceeded, or until the coil temperature is determined to be greater than a predetermined value, e.g., 27°. Upon detecting a temperature of 27°, timer 210, is reset, and will thereafter be decremented until the coil temperature reaches a second predetermined value, e.g., 60° or the maximum defrost period expires. The actual time period required to increase the temperature from 27° to 60° is then determined with references to the count remaining in timer 210, and the frost build period is adjusted accordingly. Referring now to FIG. 11, defrost sequence 1100 will now be described. p Upon initiating defrost sequence 1100, the coil temperature is first checked against the upper predetermined value, e.g., 60° Fahrenheit (Step 1102). Specifically, the coil record in RAM (2, 9-10) is copied into RAM (0, 14-15), and a value indicative of 60° Fahrenheit is subtracted to effect the comparison.

Assuming that the coil temperature is not greater than 60° Fahrenheit, i.e., a positive value remains in RAM (0, 14-15), the coil temperature is tested against the lower predetermined value, e.g., 27° (Step 1104). In practice, this is effected by subtracting an additional amount from the balance value remaining in RAM (0,14-15).

Assuming that the coil temperature exceeds 27°, a test is made to determine whether a 27° temperature had previously been detected, i.e., whether the 27° detection flag, RAM (2, 13) bit 0, contains a one (Step 1106).

Assuming the 27° detection flag had not previously been set, i.e., a 27° condition has not previouslly existed, coil temperature has just attained the 27° temperature. Accordingly, the detection flag, RAM (2, 13) bit 0, is set (Step 1108), and timing of the defrost period reinitiated; basic timer 212 is reloaded with the optimal time plus backup time as predetermined in ROM 170, and timer prescale 214 is loaded with a value in accordance with the status of microprocessor ports L4-L6, as previously described (Step 1110). The system then proceeds in executing main loop 300 with update calibration timer step 302.

If, however, the coil temperature does nor exceed 27° (Step 1104), or if a 27° temperature had previously been detected (Step 1106), the compressor status, i.e., RAM (3, 14) bit 1, is tested (Step 1112). If the compressor is not running, as reflected by a status bit value of 0, interrupted defrost flag RAM (2, 13) bit 1 is set, the 27° detection flag, RAM (2, 13) bit 0, is cleared (Step 1114), and the defrost period is reinitiated (Step 1110).

Assuming, however, that the compressor was found to be running (Step 1112), timer prescale 214 is decremented in accordance with the half-second count in RAM (3, 2), and timer 212 is decremented accordingly (Step 1116). The time remaining in the defrost period as reflected in basic mode timer 210 is then tested (Step 1118). If the full defrost time has not elapsed, the system proceeds in main loop 300 with execution of updatae calibration timer step 302. If, however, the full defrost period has elapsed, the frost accumulation record in RAM (2, 5-6) is set to the predetermined minimum value, and the accumulator carry bit (C) of microprocessor 102 is set to provide an indication that the defrost period timed out (Step 1120).

In the event that a coil temperature in excess of 60° is detected (Step 1102), or after the defrost period has timed out and the minimum frost-build period has been established, the interrupted defrost flag, RAM (2, 13) bit 1, is tested to determine whether a compressor shutdown occurred during defrost (Step 1122). Assuming that the defrost was not interrupted, the carry bit is tested to determine if a minimum frost-build time has already been established (Step 1124). If not, the frost accumulation period is adjusted in accordance with deviations of the defrost time from the optimal value.

More specifically, if the carry bit is 0, Step 1124 was reached via Step 1102, rather than through Step 1120. Thus, the count remaining in timer 212, less the count indicative of the backup time, represents the deviation of the actual defrost period (the time required to raise the temperature of the coil from 27° to 60 °) from the optimum defrost period. The backup time incoprorated in the initial setting of mode timer 212, established in ROM 170, is subtracted from the time remaining in mode timer 212 to establish the deviation of the actual defrost time from the predetermined optumum (target) value (Step 1126), and the balance is tested (Step 1128).

If the balance equals 0, i.e., the time remaining equals the backup time, the optimal defrost time has been achieved, and a new temperature differential target value is established. The current debounced temperature differential indicia in RAM (3, 11-12), representing the temperature differential just prior to an optimal period of defrost, is copied into RAM (2, 11-12) as the new target value (Step1130).

After a new target differential has been recorded (Step 1130), the system proceeds without making adjustment to the frost-build time. Specifically, the frost-build time presently on record in RAM (2, 5-6) is transferred into RAM (0, 14-15) (Step 1132). A failsafe check is then run to ensure that the frost-build time contained in RAM (2, 5-6) is not less than the predetermined minimum; the predetermined minimum is subtracted from the frost-build time reflected in RAM (0, 14-15) (Step 1134). Assuming a positive result from that subtraction, i.e., the frost-build time is not less than the minimum value, the system proceeds to execute a defrost termination sequence 1135, as will be described in conjunction with FIG. 11A.

If, however, after subtracting the count indicative of the backup time from the count in mode timer 212, the balance is not equal to 0 (Step 1128), a deviation from the optimal defrost time is indicated. The system determines if the defrost operation had been initiated in response to sensing an change in environmental conditions; the "defrost via delta T" flag, RAM (3, 13) bit 1, is tested (Step 1136).

If the defrost operation was initiated in response to environmental changes, the differential between actual and optimum defrost is used to selectively adjust the target differential. Recalling that during frost build sequence 1000, the temperature differential target indicia in RAM (2, 11-12) is initially arbitrarily set at twice the measured differential (Step 1040), it is possible that the arbitrarily set temperature differential target results in the initiation of a defrost operation prematurely, as evidenced by a measured defrost time less than the optimum value (a positive balance in timer 212 after subtraction of the backup time). Accordingly, in such a case the target differential is increased. Specifically, the system determines whether the actual defrost time overshot the optimal defrost period; timer 212 is tested to determine if the results of the subtraction of the backup time (Step 1126) are negative (Step 1138). If the results were negative, the system proceeds to the defrost termination sequence (Step 1135). If, however, the balance count in timer 212 is not negative, an adjustment is made to the target differential temperature represented in RAM (2, 11-12) (Step 1140). After the target differential is increased , the defrost termination sequence (Step 1135) is initiated.

Assuming, however, the defrost was not initiates as a result of an temperature change (Step 1136), a non-zero balance in timer 212 indicated that an adjustment to the frost accumulation period must be made in accordance with the deviation from the optimal defrost period. In essence, the frost build accumulation time is adjusted by adding three times the balance (positive or negative) in timer 212 to the frost accumulation period. In the case of a postive balance, however, the incremental adjustment is limited to a maximum of 12.5 percent of the present frost accumulation period reflected in RAM (2, 5-6), resulting in an overall effective positive adjustment of 37.5%.

Accordingly, the balance count in timer 212 is first tested (Step 1142). If, after subtracting the count indicative of the backup time, the balance in timer 212 is negative, an adjustment is made to the frost-build time in RAM (2, 5-6) by successively adding three times the contents of mode timer 212 to the frost-build record in RAM (2, 5-6) (Step 1144).

If, however, the balance in timer 212 is not negative, the incremental adjustment is limited to 12.5 percent of the frost-build record. Accordingly, the 12.5 percent limit value is determined (Step 1146). The contents of RAM (2, 5-6) are copied into the two least significant cells (e.g., RAM (1, 4-5)) of a group of three cooperating scratch pad cells. The most significant cell (e.g., RAM 1, 6) is initially cleared. The contents of RAM (1, 4-6) are then doubled by adding it with itself. The contents of the two most significant cells, representing 0.125 of the balance in RAM (2, 5-6), are then copied into another group of scratch pad cells, e.g., RAM (0, 5-6). The result is retained in RAM (0, 14-15). The balance in timer 212 is then compared to the 12.5 percent limit value in RAM (1, 5-6) (Step 1148). Specifically, the balance in timer 212 is subtracted from the 12.5 percent value in RAM (1, 5-6), with the results retained in the scratch pad location RAM (1, 5-6). If the results of the subtraction are negative, adjustment step 1144 is effected. If, however, after the subtraction, the contents of the scratch pad register are positive, the balance exceeds the 12.5 percent value and the 12.5 percent value in RAM (0, 5-6) is transferred into timer 212, overwriting the previous value (Step 1150). Adjustment Step 1144 is then effected.

After the adjustment to the frost accumulation record has been made (Step 1144), the frost-build record, RAM (2, 5-6), is tested for overflow (Step 1152). If overflow occurs, RAM (2, 5-6) is limited to a value of hexidecimal FF (Step 1154), and defrost termination sequence 1135 initiated. Assuming, however, that overflow does not occur, the now frost build accumulation period record in RAM (2, 5-6) is loaded into RAM (0, 14-15) (Step 1156) in preparation for comparison against the predetermined minimum value (Step 1134). The minimum time is subtracted from the frost build period in RAM (0, 14-15), and the result is tested (Step 1134). In the event that frost-build time is less than the minimum value, the frost build time on record in RAM (2, 5-6) is set to the minimum value and flagged by setting the accumulator carry bit (Step 1120). Assuming, however, that the frost build time is not less than the minimum value, defrost termination sequence 1135 is initiated.

If during the defrost operation the compressor shut down, i.e., defrost was interrupted or, if the frost build time on record is set to a minimum value due to, for example, timing out of the defrost period, adjustment of the frost accumulation period is omitted. Specifically, if in Step 1122, it is determined from examination of RAM (2, 13) bit 1 that the compressor shut down during the defrost operation, the interrupted defrost flag RAM (2, 13) bit 1is cleared (Step 1158) and the system proceeds to execute Step 1132, testing the frost build time against the minimum (Steps 1132 and 1134), setting the frost build time to the minimum value, if necessary (Step 1120), and initialting defrost termination sequence 1135. Likewise, if the frost build time on record is set to a minimum value (Step 1120), as determined in Step 1124, the defrost termination sequence 1135 is initiated.

Figure 11A:
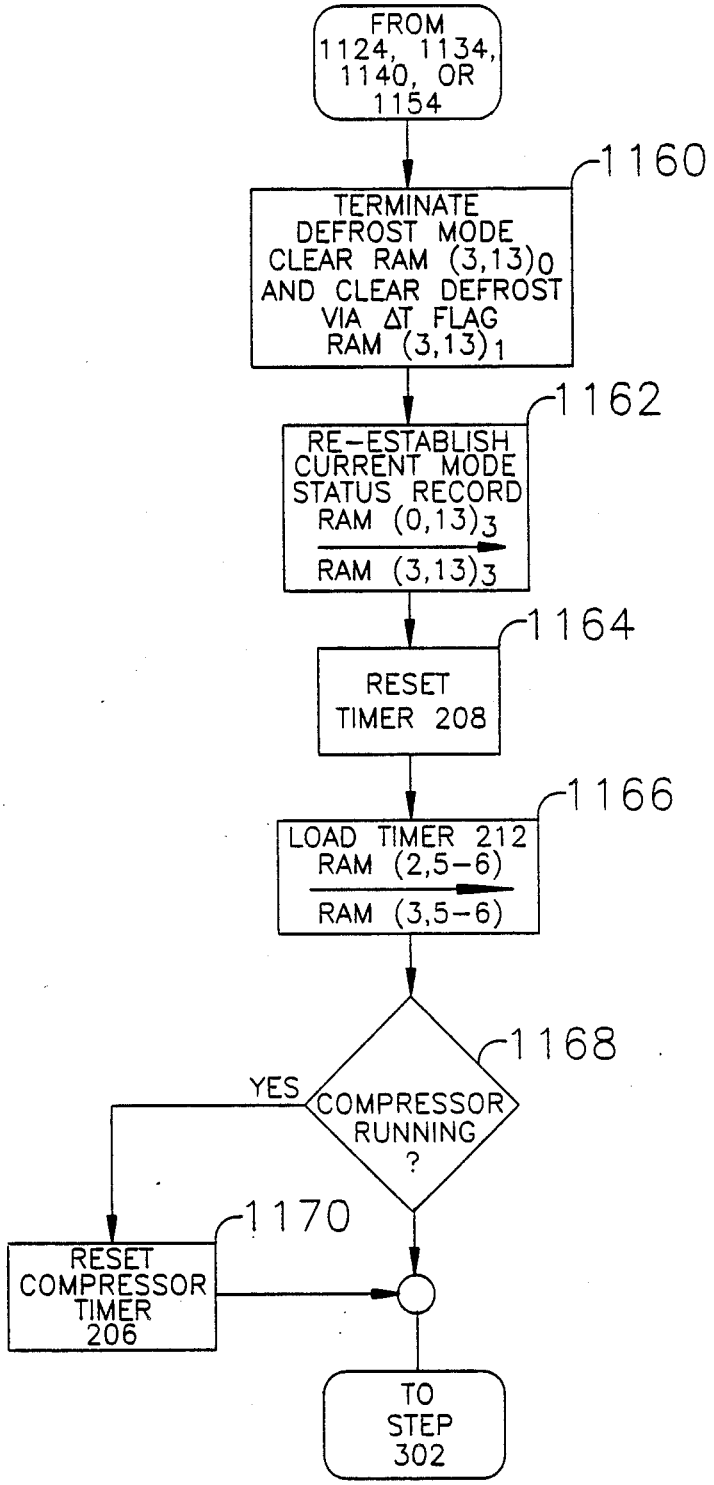

Referring now to FIG. 11A, upon initiation of defrost termination sequence 1135, the defrost mode is terminated by clearing RAM (3, 13) bit 0, and clearing "defrost via delta T" flag, RAM (3, 13) bit 1 (Step 1160). In practice, this is effected by clearing RAM (3, 13), then reestablishing the current mode status record by selectively setting RAM (3, 13) bit 3in accordance with the status of bit 3 of RAM (0, 13) (reflective of the state of port L3) (Step 1162). Timer 208 is then reset to initiate monitoring of the period during which conditions are not conducive to frost accumulation (Step 1164). Timer 212 is then loaded with the frost accumulation period record from RAM (2, 5-6), and prescale 214 is loaded with the frost accumulation prescale value from ROM (1, 70) (Step 1166). The compressor status is then tested (Step 1168) and timer 206 selectively reset, as appropriate (Step 1170), in the manner previously described in conjunction with Steps 1066–1070. The system then proceeds with the main loop, executing Step 302.

It would be understood that, while certain of the conductors/connections are shown in various figures of the drawing as single lines, they are not so shown in a limiting sense, and may comprise plural conductors/-connections as is understood in the art. Further, the above description is of a preferred exemplary embodiment of the present invention, and the invention is not limited to the specific forms shown. For example, while the various timers and storage mechanisms employed in the preferred exemplary embodiment are shown as respective cells in a RAM device, separate timers and storage cells may be employed, if desired. Likewise, while in the preferred exemplary embodiment a single set of memory cells provides for timing (i.e., indicia of temporal advancement through both the frost accumulation and defrost periods), separate sets of cells or timers can be utilized. These and other modifications may be made in the design and arrangement of the elements within the scope of the invention as expressed in the appended claims.

What is claimed is:

1. A method for controlling the defrosting of a heat transfer unit of a temperature conditioning system by initiating a defrost operation when a predetermined amount of frost has accumulated on the unit during a frost accumulating period that occurs between defrost operations, a predetermined desired defrost time being required to defrost said unit when it has the predetermined amount of frost accumulated thereon, said method being of the type comprising the steps:

determining the time required to actually defrost said unit during an actual defrost operation;

increasing the frost accumulating period before initiating the next defrost operation if the time to complete the last defrost was less than said desired defrost time period; or decreasing the frost accumulating period before initiating the next defrost operation if the time to complete the last defrost was greater than said desired defrost time period;

improved wherein said method further comprises the steps of:

sensing ambient temperature in the vicinity of said heat transfer unit;

determining if the temperature of said unit has stabilized;

determining if the system operation is within a first predetermined portion of said frost accumulation period;

determining the temperature differential between said unit and ambient; and if said unit temperature has stabilized and said system operation is within said first predetermined portion of said frost accumulating period, initiating said defrost operation upon said temperature differential exceeding a threshold value.

2. The method of claim 1 wherein said threshold value is indicative of the temperature differential sensed just prior to initiation of a defrost operation of said desired defrost time.

3. The method of claim 1 further including the step of setting said frost accumulating period to a predetermined value upon said temperature differential exceeding said threshold value.

4. The method of claim 3 wherein said predetermined value is a predetermined minimum value.

5. A method of selectively defrosting a heat transfer unit, said method comprising the steps of:

a. selectively effecting a defrost operation at the end of a period of frost accumulation of a duration adjusted in accordance with the deviation from a desired defrost time required to defrost said unit in a previous defrost operation;

b. determining if the temperature of said unit has stabilized;

c. determining if the system operation is within a first predetermined portion of said frost accumulation period;

d. determining the temperature differential between said unit and ambient;

e. if said unit temperature has stabilized and said system operation is within said first predetermined portion of said period of frost accumulation, selectively effecting a defrost operation responsive to said temperature differential exceeding a threshold value.

6. The method of claim 5 wherein said threshold value is determined in accordance with the temperature differential between said unit and ambient just prior to a previous defrost operation of said desired defrost time.

7. The method of claim 6 wherein said threshold value is equal to the temperature differential between said unit and ambient just prior to a previous defrost operation of said desired defrost time.

8. The method of claim 5 wherein:

said desired defrost time is approximately equal to the time required to increase the temperature of said unit from a first predetermined temperature to a second predetermined temperature, when said defrost operation is initiated with a predetermined amount of frost accumulated on said unit, and wherein step (a) comprises:

adjusting the duration of said period of frost accumulation in accordance with the deviation from said desired defrost time of the time required to increase the temperature of said unit from said first to said second predetermined temperatures.

9. The method of claim 5 wherein said defrost operation comprises the steps of:

sensing the temperature of said unit; initiating defrost conditions;

determining the time period required to increase the temperature of said unit from a first predetermined temperature to a second predetermined temperature; and terminating said defrost condition upon the earlier of the temperature of said unit exceeding said second predetermined temperature or elapsing of a predetermined maximum time period after said initiating of defrost conditions.

10. The method of claim 5 wherein step (e) comprises:

effecting a defrost operation upon said temperature differential exceeding said threshold value for in excess of a predetermined time period.

11. The method of claim 5 further including the steps of, during said period of frost accumulation, restarting said period of frost accumulation without effecting a defrost operation, responsive to conditions not conducive to frost accumulation being prevalent for in excess of a predetermined period of time.

12. The method of claim 11 further including the step of:

responsive to apparent temperatures of said unit outside of predetermined limits, with an ambient temperature above a predetermined level, occurring during said period of frost accumulation; restarting said period of frost accumulation without effecting a defrost operation.

13. A method of selectively defrosting a heat transfer unit, said method comprising the steps of:

selectively effecting a defrost operation at the end of a period of frost accumulation of a duration adjusted in accordance with the deviation from a desired defrost time required to defrost said unit in a previous defrost operation;

determining the temperature differential between said unit and ambient;

during at least a first portion of said period of frost accumulation, selectively effecting a defrost operation responsive to said temperature differential exceeding a threshold value; and during a second portion of said period of frost accumulation, selectively effecting a defrost operation responsive to said temperature differential exceeding a second threshold differential.

14. The method of claim 13 wherein said second threshold value is greater than said first mentioned threshold value.

15. The method of claim 13 wherein said first mentioned threshold value is equal to the temperature differential between said unit and ambient just prior to a previous defrost operation of said desired defrosst time.

16. The method of claim 15 wherein said second threshold value is greater than said first mentioned threshold value.

17. The method of claim 16 wherein said second threshold value equals said first mentioned threshold value increased by a predetermined percentage thereof.

18. The method of claim 17 wherein said first portion of said period of frost accumulation is in the range of the first $\frac{1}{2}$ to $\frac{2}{3}$ of said period.

19. The method of claim 15 wherein said first portion of said period of frost accumulation is in the range of the first $\frac{1}{2}$ to $\frac{2}{3}$ of said period.

20. A system for selectively generating a defrost control signal to controllably defrost a heat transfer unit, said system comprising:

temperature sensor means for providing indicia of the temperature of said unit and of the ambient temperature in the vicinity of said heat transfer unit;

storage means for accessibly storing indicia of:

a frost accumulation period duration; and a target temperature differential value;

timer means, receptive of indicia of a time period communicated thereto, for providing indicia of temporal advancement through said time period;

means, cooperating with said storage means, for selectively communicating said indicia of said frost accumulation period duration to said timer means, whereby said timer means provides indicia of temporal advancement through said frost accumulation period;

means for determining if the temperature of said heat transfer unit has stabilized;

means for determining if the system operation is within a first predetermined portion of said frost accumulation period;

temperature differential actuation means, cooperating with said storage means, responsive to the difference between the temperature of said unit and ambient temperature exceeding said target temperature differential when said heat transfer unit temperature has stabilized and said system operation is within said first predetermined portion of said frost accumulation period, for initiating generation of said defrost control signal;

means, cooperating with said timer means, responsive to indicia of the expiration of said frost accumulation period, for initiating generation of said defrost control signal;

means for selectively terminating generation of said defrost control signal; and means for adjusting said frost accumulation period in accordance with the deviation, from a desired value, of the time required to defrost said unit.

21. The system of claim 20, further comprising:

means for selectively communicating indicia of a maximum defrost time period to said timer means, whereby said timer means provides indicia of temporal advancement through said maximum defrost period;

and wherein said means for selectively terminating generation of said defrost control signal comprises:

means for terminating generation of said defrost control signal, responsive to the first to occur of said unit attaining a defrosted condition; or expiration of said maximum defrost period.

22. The system of claim 21 further comprising:

means, responsive to expiration of said maximum defrost period, for setting said frost accumulation period to a predetermined value.

23. The system of claim 21 further comprising:

means, responsive to continuous prevalence of conditions not conducive to frost accumulation for a period in excess of a predetermined duration, for restarting advancement through said frost accumulation period in said timer means without generating said defrost control signal.

24. The system of claim 20 further comprising:

means, responsive to continuous prevalence of conditions not conducive to frost accumulation for a period in excess of a predetermined duration, for restarting advancement through said frost accumulation period in said timer means without generating said defrost control signal.

25. The system of claim 24 wherein said means for restarting advancement through said frost accumulation period comprises:

second timer means for generating indicia of the duration of continuous periods during which conditions not conducive to frost accumulation are prevalent; and means, responsive to indicia of a continuous period of conditions not conducive to frost accumulation of at least a predetermined duration, for resetting indicia of said frost accumulation period in said first mentioned timer means.

26. The system of claim 21 wherein said means for adjusting said frost accumulation period comprises:

means for adjusting said frost accumulation period in accordance with the deviation from a desired value of the time required to increase the temperature of said heat transfer unit from a first predetermined temperature to a second predetermined temperature.

27. The system of claim 26 further comprising:

means, responsive to expiration of said maximum defrost period, for setting said frost accumulation period to a predetermined value.

28. The system of claim 26 further comprising:

means, responsive to said heat transfer unit temperature initially reaching said first predetermined temperature, for restarting advancement through said maximum defrost period.

29. The system of claim 26 wherein said means for adjusting said frost accumulation period further comprises:

means for determining the time remaining in said maximum defrost period upon said heat transfer unit attaining said predetermined temperature corresponding to a defrosted condition; and comparing said time remaining to a predetermined value.

30. The system of claim 20 wherein said first portion of said frost accumulation period comprises at least the first half of said frost accumulation period.

31. The system of claim 30 wherein said first portion of said frost accumulation period comprises approximately the first two-thirds of the frost accumulation period.

32. The system of claim 20 wherein said temperature differential actuation means comprises:

means, responsive to the continuous prevalence of a temperature difference value in excess of said target differential for a time period in excess of a predetermined duration, for initiating generation of said defrost control signal.

33. The system of claim 20 further comprising:

means for storing indicia of the contemporaneous temperature differential between said unit and ambient at the end of said frost accumulation period; and means, cooperating with said storage means, responsive to the time required to defrost said unit being equal to said predetermined value, for setting said target temperature differential value equal to said contemporaneous temperature differential.

34. The system of claim 20 wherein said temperature sensor means comprises:

a first thermistor disposed to manifest a resistance value in accordance with the temperature of said unit;

a second thermistor disposed to manifest a resistance value in accordance with the ambient temperature in the vicinity of said unit;

means for selectively coupling one of said first or second thermistors to a capacitance of known value such that said capacitance is charged through the selectively coupled thermistors;

counter means for selectively generating a count; and processor means, having an instruction cycle associated therewith, for adjusting said count by a predetermined amount in response to each occurrence of a predetermined number of instruction cycles during the time period required for said capacitance to charge to a predetermined voltage level through said selectively coupled thermistors.

35. The system of claim 34 further comprising:

a resistance of known value;

means for periodically coupling said resistance to said capacitance such that said capacitance is charged through said known resistance;

means for developing a calibration count indicative of the time required to charge said capacitance to said predetermined voltage level through said known resistance; and means for varying said predetermined number of instruction cycles in accordance with deviations of said calibration count from a predetermined calibration value.

36. A system for selectively generating a defrost control signal to controllably defrost a heat transfer unit, said system comprising:

temperature sensor means for providing indicia of the temperature of said unit and of the ambient temperature in the vicinity of said heat transfer unit;

storage means for accessibly storing indicia of:

a frost accumulation period duration; and a target temperature differential value;

timer means, receptive of indicia of a time period communicated thereto, for providing indicia of temporal advancement through said time period;

means, cooperating with said storage means, for selectively communicating said indicia of said frost accumulation period duration to said timer means, whereby said timer means provides indicia of temporal advancement through said frost accumulation period;

temperature differential actuation means, cooperating with said storage means, responsive to the difference between the temperature of said unit and ambient temperature exceeding said target temperature differential during a first portion of said frost accumulation period, for initiating generation of said defrost control signal;

means cooperating with said timer means, responsive to indicia of the expiration of said frost accumulation period, for initiating generation of said defrost control signal;

means for selectively terminating generation of said defrost control signal;

means for adjusting said frost accumulation period in accordance with the deviation, from a desired value, of the time required to defrost said unit; and second temperature actuation means, responsive to the difference between the temperature of said unit and ambient temperature exceeding a second target differential during a second portion of said frost accumulation period, for initiating generation of said defrost control signal.

37. The system of claim 36 wherein said second portion of said frost accumulation period is subsequent to said first portion and said second target differential is greater than said first mentioned target differential.

38. A system for regulating the temperature of an area, said system comprising:

a compressor, responsive to compressor control signals applied thereto;

first and second heat transfer units, fluidically coupled to said compressor, said first heat transfer unit being disposed in said area, said second heat transfer unit being disposed outside of said area;

defrost means, responsive to defrost control signals applied thereto, for controllably defrosting said second heat transfer unit;

a first temperature sensor, disposed to provide indicia of the temperature of said second heat transfer unit;

a second temperature sensor, disposed to provide indicia of the ambient temperature in the vicinity of said second heat transfer unit;

storage means for accessibly storing indicia of:
a frost accumulation period duration; and
a target temperature differential;

timer means, receptive of indicia of a time period communicated thereto, for providing indicia of temporal advancement through said time period;

means, cooperating with said storage means, for selectively communicating said indicia of said frost accumulation period duration to said timer means, whereby said timer means provides indicia of temporal advancement through said frost accumulation period;

means for determining if the temperature of said heat transfer unit has stabilized;

means for determining if the system operation is within a first predetermined portion of said frost accumulation period;

temperature differential actuation means, cooperating with said storage means, responsive to the difference between the temperature of said unit and ambient temperature exceeding said target temperature differential when said heat transfer unit temperature has stabilized and said system operation is within said first predetermined portion of said frost accumulation period, for initiating generation of said defrost control signal;

means, cooperating with said timer means, responsive to indicia of the expiration of said frost accumulation period, for initiating generation of said defrost control signal;

means for selectively terminating generation of said defrost control signal; and means for adjusting said frost accumulation period in accordance with the deviation, from a desired value, of the time required to defrost said unit.

39. The system from claim 38 further comprising:

means for sensing the operational status of said compressor; and means for inhibiting said timer means, responsive to said compressor having a nonrunning operational status.

40. The system of claim 39, wherein:

said compressor includes compressor control means, responsive to a control signal selectively applied thereto, controllably actuating said compressor;

said system further comprising means for selectively applying an AC line signal as said control signal to said compressor control means; and said means for sensing the operational status of said compressor comprises:
means for sensing the phase of said AC line signal;
means for sensing the phase of the control signal applied to said compressor control means; and
means for generating indicia of compressor operational status in accordance with a comparison of the phases of said AC line signal and the signal applied to said compressor control means.

41. The system of claim 40, wherein said means for selectively applying an AC line signal to said control signal comprises:

means for inhibiting said compressor for a predetermined period responsive to said compressor entering a non-running operational state.

42. The system of claim 39, further comprising:

means for inhibiting said compressor for a predetermined period responsive to said compressor entering a non-running operational state.

43. The system of claim 38 wherein said means for terminating generation of said defrost control signal comprises:

means for selectively communicating indicia of a maximum defrost period to said timer means, whereby said timer means provides indicia of temporal advancement through said maximum period;

means for terminating generation of said defrost control signal responsive to the first to occur of:
said second heat transfer unit attaining a predetermined temperature indicative of a defrosted condition; or
expiration of said maximum defrost period.

44. A system for regulating the temperature of an area, said system comprising:

a compressor, responsive to compressor control signals applied thereto;

first and second heat transfer units, fluidically coupled to said compressor, said first heat transfer unit being disposed in said area, said second heat transfer unit being disposed outside of said area;

defrost means, responsive to defrost control signals applied thereto, for controllably defrosting said second heat transfer unit;

a first temperature sensor, disposed to provide indicia of the temperature of said second heat transfer unit;

a second temperature sensor, disposed to provide indicia of the ambient temperature in the vicinity of said second heat transfer unit;

storage means for accessibly storing indicia of:
a frost accumulation period duration; and
a target temperature differential;

timer means, receptive of indicia of a time period communicated thereto, for providing indicia of temporal advancement through said time period;

means, cooperating with said storage means, for selectively communicating said indicia of said frost accumulation period duration to said timer means, whereby said timer means provides indicia of temporal advancement through said frost accumulation period;

temperature differential actuation means, cooperating with said storage means, responsive to the difference between the temperature of said unit and ambient temperature exceeding said target temperature differential during a first portion of said frost accumulation period, for initiating generation of said defrost control signal;

means, cooperating with said timer means, responsive to indicia of the expiration of said frost accumulation period, for initiating generation of said defrost control signal;

means for selectively terminating generation of said defrost control signal; and means for adjusting said frost accumulation period in accordance with the deviation, from a desired value, of the time required to defrost said unit;

means for sensing the on/off state of said compressor;

wherein said means for terminating generation of said defrost control signal comprises:

means for selectively communicating indicia of a maximum defrost period to said timer means, whereby said timer means provides indicia of temporal advancement through said maximum period;

means for selectively restarting temporal advancement through said maximum defrost period in said timer means responsive to said compressor assuming an off state;

means for terminating generation of said defrost control signal responsive to the first to occur of:
said second heat transfer unit attaining a predetermined temperature indicative of a defrosted condition; or
expiration of said maximum defrost period.

45. The system of claim 44 further including means for inhibiting said means for adjusting said frost accumulation period in response to said compressor assuming an off state during the previous defrosting of said second heat transfer unit.

46. A method of selectively defrosting a heat transfer unit, said method comprising the steps of:

selectively effecting a defrost operation at the end of a period of frost accumulation;

determining the temperature differential between said unit and ambient;

if, during at least a first portion of said period of frost accumulation, said temperature differential exceeds a target differential, terminating said period of frost accumulation and effecting said defrost operation;

storing indicia of the temperature differential occurring just prior to initiating a defrost operation;

determining the deviation of the time required to defrost said unit from a desired defrost time;

adjusting said predetermined duration of said period of frost accumulation in accordance with said deviation;

if there is no deviation, establishing a target temperature differential in accordance with said temperature differential occurring just prior to initiating said defrost operation.

47. The method of claim 46 further including the step of, during a second portion of said period of frost accumulation, selectively effecting a defrost operation responsive to said temperature differential exceeding a second threshold differential.

48. The method of claim 46 wherein said second threshold value is greater than said first mentioned threshold value.

49. The method of claim 46 wherein said second threshold value equals said first mentioned threshold value increased by a predetermined percentage thereof.

50. The method of claim 46 wherein said first portion of said period of frost accumulation is in the range of the first $\frac{1}{2}$ to $\frac{2}{3}$ of said period.

* * * * *